US012553441B2

(12) United States Patent
Ekambaram et al.

(10) Patent No.: US 12,553,441 B2
(45) Date of Patent: Feb. 17, 2026

(54) ELECTRICAL SUBMERSIBLE PUMPING SYSTEMS

(71) Applicant: Schlumberger Technology Corporation, Sugar Land, TX (US)

(72) Inventors: Raju Ekambaram, Singapore (SG); Ruslan Alexandrovich Bobkov, Moscow (RU); Maksim Radov, Singapore (SG); Alejandro Camacho Cardenas, Singapore (SG); David Milton Eslinger, Bartlesville, OK (US); Pradeep Mahadevan, Singapore (SG); Teng Fei Wang, Singapore (SG); Kean Wee Cheah, Singapore (SG); Jaiprakash Natarajan, Singapore (SG); Sethuraj Arumugam, Singapore (SG); Benoit Deville, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/735,552

(22) Filed: Jun. 6, 2024

(65) Prior Publication Data

US 2024/0410372 A1 Dec. 12, 2024

Related U.S. Application Data

(63) Continuation of application No. 17/442,642, filed as application No. PCT/US2020/024909 on Mar. 26, 2020, now Pat. No. 12,025,136.

(30) Foreign Application Priority Data

Mar. 26, 2019 (SG) ..... 10201902682T
Apr. 12, 2019 (SG) ..... 10201903324S

(51) Int. Cl.
*F04D 13/08* (2006.01)
*E21B 43/12* (2006.01)
(Continued)

(52) U.S. Cl.
CPC ..... *F04D 13/086* (2013.01); *E21B 43/128* (2013.01); *F04D 1/06* (2013.01);
(Continued)

(58) Field of Classification Search
CPC ..... F04D 13/086; F04D 1/06; F04D 13/024; F04D 13/0646; F04D 29/0513;
(Continued)

(56) References Cited

U.S. PATENT DOCUMENTS 4,872,808 A * 10/1989 Wilson ..... F04D 29/0413 415/199.2
5,209,650 A * 5/1993 Lemieux ..... F04D 29/0413 415/199.5
(Continued)

FOREIGN PATENT DOCUMENTS

CN 2763589 Y * 3/2006
CN 209638005 U * 11/2019
WO WO-2018022198 A1 * 2/2018 ..... E21B 43/12

*Primary Examiner* — Dominick L Plakkoottam
(74) *Attorney, Agent, or Firm* — Jeffrey D. Frantz

(57) ABSTRACT

Systems and methods facilitate pumping of various fluids such as well fluids. An electric submersible pumping system is constructed with an outer housing that contains an integrated pump and motor. The pump may include an impeller disposed within a stator of the motor. The integration of the pump and the motor enables elimination of various components of traditional electric submersible pumping systems to thus provide a simpler and more compact system for pumping fluids.

12 Claims, 46 Drawing Sheets

(51) Int. Cl.

| | |
|---|---|
| ***F04D 1/06*** | (2006.01) |
| ***F04D 13/02*** | (2006.01) |
| ***F04D 13/06*** | (2006.01) |
| ***F04D 29/046*** | (2006.01) |
| ***F04D 29/051*** | (2006.01) |
| ***F04D 29/44*** | (2006.01) |
| ***F04D 29/62*** | (2006.01) |

(52) U.S. Cl.
CPC ..... *F04D 13/024* (2013.01); *F04D 13/0646* (2013.01); *F04D 29/046* (2013.01); *F04D 29/0513* (2013.01); *F04D 29/445* (2013.01); *F04D 29/628* (2013.01)

(58) Field of Classification Search
CPC ..... F04D 29/445; F04D 29/628; F04D 13/10; F04D 29/046; E21B 43/128
See application file for complete search history.

(56) References Cited

U.S. PATENT DOCUMENTS

| | | | | |
|---|---|---|---|---|
| 6,254,359 | B1 * | 7/2001 | Aber | A61M 60/538 417/423.12 |
| 2008/0111434 | A1 * | 5/2008 | Head | H02K 3/50 310/67 R |
| 2015/0023815 | A1 * | 1/2015 | Tetzlaff | F04D 1/04 417/365 |
| 2016/0115998 | A1 * | 4/2016 | Jayaram | F04D 29/448 384/296 |
| 2018/0223854 | A1 * | 8/2018 | Brunvold | E21B 43/128 |
| 2018/0328365 | A1 * | 11/2018 | Eslinger | F04D 29/0413 |
| 2019/0040863 | A1 * | 2/2019 | Davis | F04D 29/445 |

* cited by examiner

ELECTRICAL SUBMERSIBLE PUMPING SYSTEMS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a continuation of U.S. patent application Ser. No. 17/442,642 filed Sep. 24, 2021, which is a National Stage of International Application No. PCT/US2020/024909 filed Mar. 26, 2020, which claims priority benefit of Singapore Application No. 10201902682T filed Mar. 26, 2019, and Singapore Application No. 10201903324S filed Apr. 12, 2019, the entirety of each of which is incorporated by reference herein and should be considered part of this specification.

BACKGROUND

Field

The present disclosure generally relates to artificial lift systems and, more particularly, to electric submersible pumping systems having electromagnetically-driven impellers.

Description of the Related Art

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Following discovery of a desired subterranean resource, e.g. oil, natural gas, or other desired subterranean resources, well drilling and production systems often are employed to access and extract the resource or resources. For example, a wellbore may be drilled into a hydrocarbon bearing reservoir and then a pumping system may be deployed downhole. The pumping system is operated to pump oil and/or other fluids to the surface for collection when the natural drive energy of the reservoir is not strong enough to lift the well fluids to the surface. The pumping system may comprise an electric submersible pumping system having a submersible centrifugal pump powered by a separate submersible electric motor.

SUMMARY

A summary of certain embodiments described herein is set forth below. It should be understood that these aspects are presented merely to provide the reader with a brief summary of these certain embodiments and that these aspects are not intended to limit the scope of this disclosure.

In general, the present disclosure provides a system and methodology for pumping fluids. According to an embodiment, an electric submersible pumping system is constructed with an outer housing which contains an integrated pump and motor. For example, the pump may comprise an impeller disposed within a stator of the motor. A tube can be disposed along an interior of the stator, e.g. along the interior of stator laminations, to define a passage extending longitudinally through the stator. The tube may be sealed with respect to the stator to prevent contact between the stator and a fluid moving along the passage. The integration of the pump and the motor enables elimination of various components of traditional electric submersible pumping systems to thus provide a simpler, protected, and more compact system for pumping fluids.

Some embodiments of the present disclosure include an electric submersible pumping system having a housing defining a fluid intake and a fluid discharge. The electric submersible pumping system also includes a stator disposed radially within the housing. The electric submersible pumping system further includes one or more pump/motor stacks disposed radially within the stator. Each pump/motor stack of the one or more pump/motor stacks includes one or more impeller/diffuser stages. Each impeller/diffuser stage includes a diffuser in a locked position with respect to the stator, and an impeller disposed adjacent the diffuser. The impeller includes one or more magnetic components, wherein application of electric power to the stator causes rotation of the impeller relative to the stator. Each pump/motor stack can include a thrust bearing disposed radially between a shaft and an interior bore of a diffuser of an impeller/diffuser stage of the one or more impeller/diffuser stages. The shaft extends axially through the one or more impeller/diffuser stages. Each pump/motor stack can include at least one radial bearing disposed radially between the shaft and an interior bore of a diffuser of a respective impeller/diffuser stage of the one or more impeller/diffuser stages.

Some embodiments of the present disclosure include an electric submersible pumping system having a housing defining a fluid intake and a fluid discharge. The electric submersible pumping system also includes a stator disposed radially within the housing. The electric submersible pumping system further includes one or more pump/motor stacks disposed radially within the stator. Each pump/motor stack of the one or more pump/motor stacks includes a plurality of impeller/diffuser stages. Each impeller/diffuser stage includes a diffuser in a locked position with respect to the stator, and an impeller disposed adjacent the diffuser. The impeller includes one or more magnetic components, wherein application of electric power to the stator causes rotation of the impeller relative to the stator. At least two of the impeller/diffuser stages can include a radial/thrust bearing configured to support radial and thrust loads of the plurality of impeller/diffuser stages.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE FIGURES

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
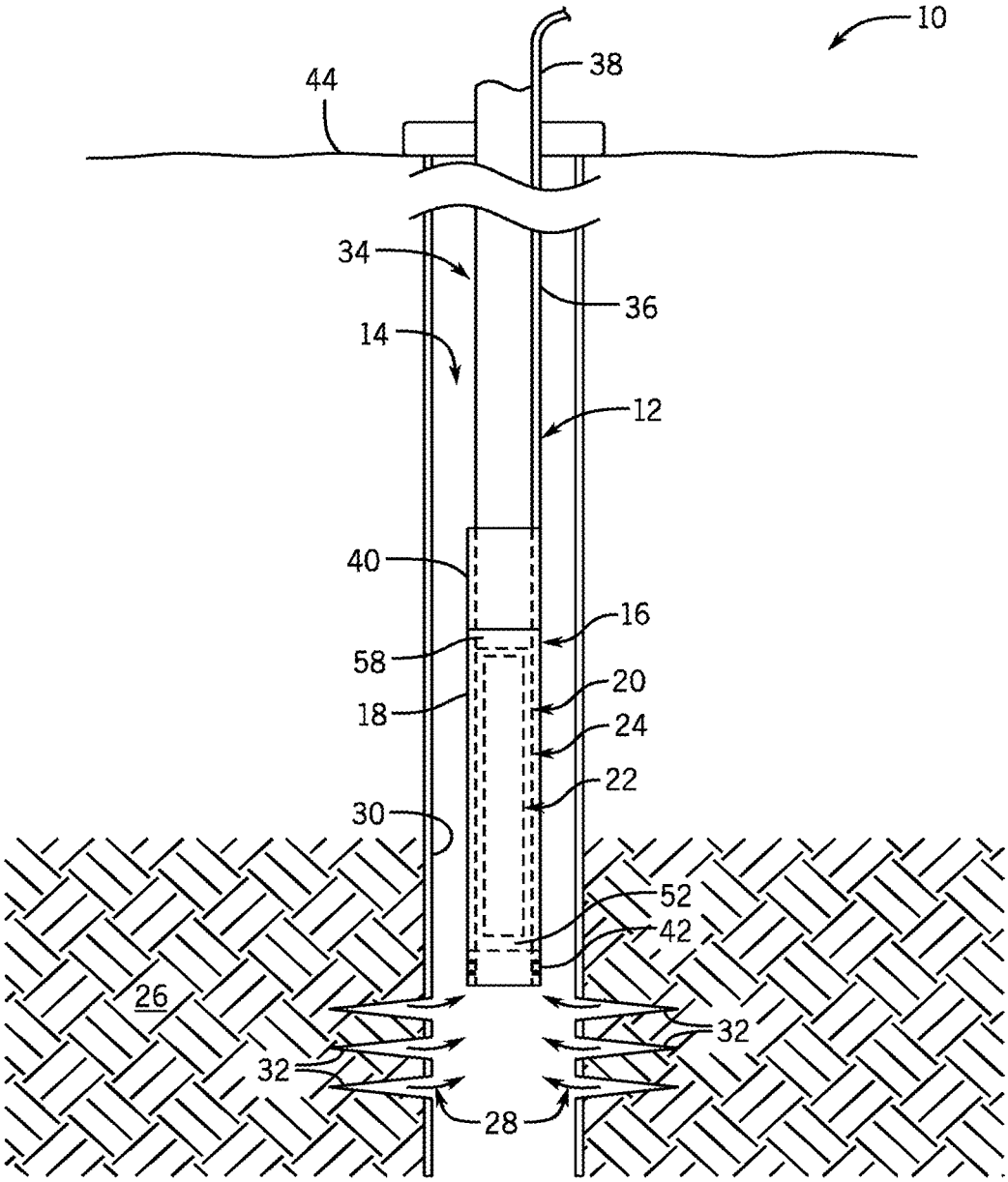
FIG. 1 is a schematic view of a well system including an electric submersible pumping system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

The present disclosure generally relates to systems and methods for pumping fluids, for example, well fluids. In certain embodiments, an electric submersible pumping system is configured for deployment in a borehole or other suitable location to pump desired fluids. In certain embodiments, the electric submersible pumping systems may include an outer housing containing one or more integrated pump and motor stacks. For example, in certain embodiments, the pump may include an impeller disposed within a stator of the motor. The integration of the pump and the motor enables elimination of various components of traditional electric submersible pumping systems to, thus, provide a relatively simpler and more compact system for pumping fluids.

In some embodiments of the integrated pump and motor, or pump and motor stacks, the stator is disposed within, e.g., radially within, the outer housing, and comprises a stack of stator laminations having an open interior or bore extending longitudinally through the stack. The stator, e.g., the stack of stator laminations, can be protected by a tube deployed along its interior and having an internal passage. The tube may be constructed to provide a sealed stator environment to prevent exposure of the stator laminations to undesirable fluids, e.g. pumped well fluids, which could otherwise contact the stator and cause failures. The tube may be employed as a scaling mechanism for use with a variety of motors, including integrated motors, traditional induction motors, permanent magnet motors, or other suitable motors to increase system reliability. The stator may further comprise a plurality of slots disposed around the bore and/or externally of the tube. Magnet or maintenance wire can be disposed within the slots.

An impeller is disposed within the stator and may comprise an impeller body combined with a magnet. For example, the impeller may comprise the impeller body combined with a magnetic component positioned about the impeller body and a permanent magnet. By way of example, the permanent magnet may be mounted about the magnetic component. In some embodiments also including a tube, the impeller can be positioned within the passage extending through the tube located within the stack of stator laminations. In various embodiments, the integrated pump and motor comprises a stack of impellers and corresponding diffusers located within the stator.

For well applications, the electric submersible pumping system may be used for lifting well fluids to, for example, a surface location. Embodiments of the electric submersible pumping system integrate an electrical motor with a pump to provide a simple pumping system of convenient size. In some embodiments, the electrical motor may be constructed with a stator having a magnetic core and a winding sealed from the ambient environment, or made of materials which are not susceptible to the ambient environment. In various embodiments, centrifugal pump stages may be installed within an inside diameter of the stator.

By way of example, the centrifugal pump stages may comprise stationary diffusers, which may be fixed to the stator and/or tube in embodiments including a tube. The diffusers can be located within the inner passage or bore of the stator. In embodiments including a tube, the diffusers can be located within the inner passage of the tube and stator. In some embodiments, the stationary diffusers may be positioned within the stator and fixed along a stationary shaft.

The impellers may be equipped with components that generate torque while being exposed to a rotating magnetic field resulting by applying electric power to the stator. Examples of components that generate torque include permanent magnets, squirrel cage rotors, switched reluctance or synchronous reluctance rotors, or other suitable torque generating components. In some embodiments, the impellers may be installed on a rotating shaft in packs. The packs may be radially stabilized by radial fluid film bearings installed in corresponding, stationary diffusers.

The stator may be constructed with multi-phase winding and may be fed with AC voltage to generate a rotational magnetic field within the stator inner diameter. The rotating magnetic field interacts with the torque generating components of the impellers, thus causing the impellers to rotate and to thus pump fluid through the integrated pump and motor.

FIG. 1 is a schematic view of a well system 10 including an electric submersible pumping system 12, in accordance with embodiments of the present disclosure. As illustrated in FIG. 1, the electric submersible pumping system 12 is deployed downhole in a borehole 14 (e.g., a wellbore) for production of desired fluids (e.g., oil). The electric submersible pumping system 12 may include a variety of components, depending on the particular application or environment in which it is used. For example, in certain embodiments, the electric submersible pumping system 12 may include a pumping section 16 having an outer housing 18 containing one or more integrated pump and motor stacks 20, each of which effectively combines a pump 22 and a motor 24 within the outer housing 18 to provide a relatively simple, compact structure for pumping fluids, (e.g., well fluids). In certain embodiments, the pump 22 of the integrated pump and motor stack 20 may include floater stages, compression stages, or modular compression with impeller flow passages oriented to provide radial flow, mixed flow, axial flow, or other desired flow patterns through the integrated pump and motor stack 20. Although often illustrated as including a single integrated pump and motor stack 20, in certain embodiments, the electric submersible pumping system 12 may include a plurality of integrated pump and motor stacks 20 disposed within the outer housing 18 of the pumping section 16 axially along a longitudinal axis 50 of the electric submersible pumping system 12.

Figure 51:
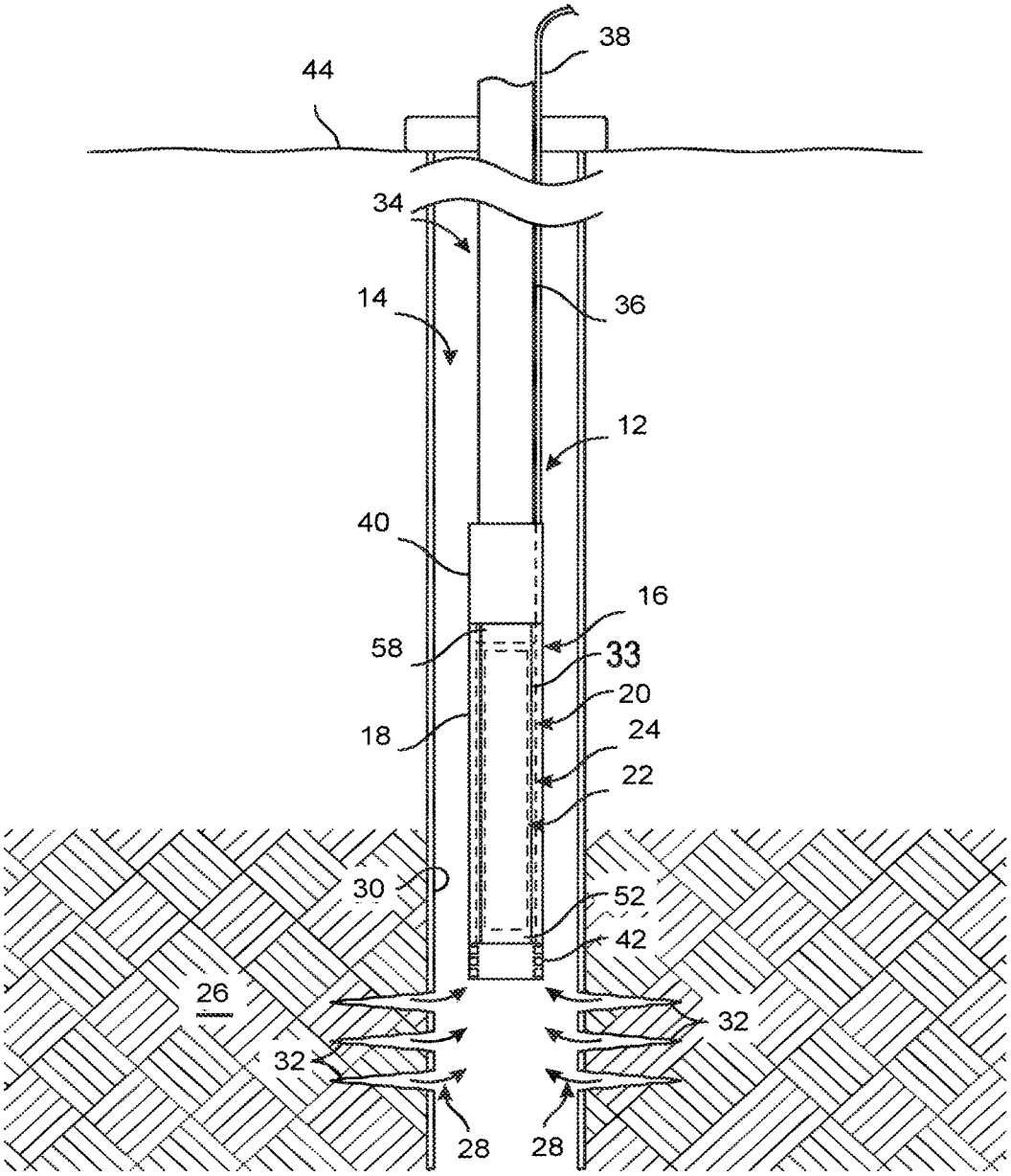
FIG. 51 is a schematic illustration of an example of a well system including an electric submersible pumping (ESP) system having a tube protecting a submersible motor, according to an embodiment of the disclosure.

As shown in FIG. 51, components of the motor 24, e.g. the stator, may be protected by a tube 33. As described in greater detail below, the tube 33 may be positioned along an interior of the stator of motor 24 to protect stator laminations from exposure to well fluids being pumped through the integrated pump and motor 20. The tube 33 may be constructed as a scaling mechanism to provide a sealed environment for the stator.

Depending on the type of motor 24 or integrated pump and motor 20, the tube 33 may have a variety of structures and shapes which provide a conduit surrounding the region of fluid flow through the integrated pump and motor 20. By way of example, the tube 33 may be cylindrical in shape or it may have a variety of other cross-sectional shapes, e.g. rectangular shapes or custom shapes to accommodate various motor components. The tube 33 also may be a thin, single long cylindrical section or a plurality of short sections joined together (and/or joined to other system components) via welding or other sealing techniques, e.g. O-rings. The ends of the tube 33 also may be sealed to components of the integrated pump and motor 20 via welding, O-ring seals, or other suitable sealing techniques. In some embodiments, the tube 33 may be sealed to the head and the base of the corresponding equipment section.

In the embodiments illustrated in FIGS. 1 and 51, the borehole 14 is in the form of a wellbore drilled into a geological formation 26 that contains a desirable fluid 28 (e.g., a production fluid, such as oil). In certain embodiments, the borehole 14 may be lined with a tubular casing 30, and perforations 32 may be formed through the tubular casing 30 to enable flow of the fluids 28 between the surrounding formation 26 and the borehole/wellbore 14. In certain embodiments, the electric submersible pumping system 12 may be deployed down into the borehole 14 via a conveyance system 34, which may include tubing 36 (e.g., coiled tubing, production tubing, and so forth) and/or cable 38 coupled to the pumping section 16 via a connector 40.

Electric power may be provided to the motor 24 of the pumping section 16 via a power cable 38, which allows the motor 24 to power the pump 22, as described in greater detail herein, so as to draw in the fluid 28 through a suitable fluid intake 42 of the electric submersible pumping system 12. In certain embodiments, the pump 22 may include an impeller or impellers, which are rotated by electromagnetic interaction with a rotating magnetic field generated by the motor 24 to produce the fluid 28 through the integrated pump and motor stack 20. In certain well applications, the fluid 28 may be produced up through the tubing 36 (or along an annulus surrounding the tubing 36) to a desired collection location, which may be at a surface 44.

The pump 22 may be a multi-stage centrifugal pump. In such embodiments, each stage may include a rotating impeller working in cooperation with a stationary diffuser. In certain embodiments, the impellers are driven by a magnetic field of the motor 24 such that vanes of the rotating impellers convert the driver/motor energy to kinetic energy, which is applied to the fluid 28, which may be directed radially outwardly by the impeller vanes in a direction away from the center of the impeller. In certain embodiments, the fluid 28 discharged from the impeller may first contact an inner wall of an adjacent, cooperating diffuser. In certain embodiments, the impeller may be rotatably mounted within the cooperating diffuser. The cooperating diffusers may direct the flowing fluid 28 from one impeller to the next until the flowing fluid 28 is discharged from the pumping section 16. In certain downhole centrifugal pumping systems, the number of pump stages may be determined by the total dynamic head (TDH), stage-type performance characteristics, desired flow rate, and so forth. For example, for relatively deep wells where high TDH is desired, the overall pumping system may include a plurality of the pumping sections 16 connected in tandem, both hydraulically and electrically.

In certain embodiments, a motor stator and hydraulic centrifugal pump are combined in a single assembly. For example, the stator may be represented by a laminated magnetic core with multi-phase windings distributed in slots. The windings may be supplied with multi-phase alternating current (AC) voltage, thereby creating a rotating magnetic field over the space within the stator inner diameter (ID). In certain embodiments, the stator ID may be sealed from the ambient environment by a corrosion-resistant material and/or an erosion-resistant material of cylindrical shape (e.g., a "can"). In certain embodiments, the stator may be constructed from materials resistant to the ambient environment, or from a stack of lamination packs individually sealed from the ambient environment by isolating material (e.g., plastic). In certain embodiments, magnetic lamination packs may alternate with non-magnetic packs located adjacent to non-torque producing components of the pump (e.g., diffusers) to reduce power loss in the magnetic core of the stator.

In certain embodiments, stationary diffusers may be installed inside the stator ID. The diffusers can be non-magnetic. The diffusers may be fixed at desired positions within the stator. For example, in certain embodiments, the diffusers may be fixed tangentially by, for example, engagement of locking keys with corresponding key grooves located along the stator ID. In certain embodiments, the stack of diffusers may be compressed from the ends of the stack. Furthermore, certain embodiments may lock the diffusers along a stationary shaft via keys or other locking mechanisms. In certain embodiments, each diffuser may have a two-piece construction in which one part has vanes made of magnetic material and the other part, adjacent to the torque-producing impeller, is made of a non-magnetic material (e.g., ceramic or other erosion-resistant material and/or corrosion-resistant material).

Each impeller installed inside the stator ID may be constructed of magnetic or non-magnetic material. Torque generating components or subassemblies such as permanent magnets, squirrel cage rotors, switched reluctance or synchronous reluctance rotors, or other torque generating components may be fixed on the impeller or formed as integral parts of the impeller. For example, permanent magnets or other torque generating components may be fixed in the front seal area (front skirt) or in the balance ring area of each impeller. The torque generating components are positioned to interact with the rotating magnetic field of the stator and to generate torque for driving the impellers. Rotating impellers and stationary diffusors are able to transform rotational kinetic energy into the hydrodynamic energy of the fluid flow.

In some embodiments of the disclosure, the entire impeller or the vanes of the impeller may be made of a magnetic material. By way of example, the entire impeller or portions of the impeller may be constructed from magnetic steel or other suitable magnetic material. In certain embodiments, the impeller may include one or more magnetic components integrated into a body of the impeller. As such, as used herein, the term magnetic impeller is intended to mean either an impeller that is at least partially comprised of a magnetic material, or an impeller that includes one or more magnetic components integrated into the impeller. The magnetic impeller is thus able to interact electromagnetically with a rotating magnetic field of the stator such that the impeller functions simultaneously as the impeller of centrifugal pump 22 and the rotor of the motor 24.

Each impeller may have its own axial and radial support in the form of a bearing made of wear resistant material, e.g., a ceramic or carbide material. The plurality of impellers may be assembled collectively or in separate packs. Additionally, the entire group of impellers or packs of the impellers may be assembled in a floater configuration or in compression. In some applications, the impellers may be rotated about or with a corresponding central shaft. At least some of these configurations may allow for increases in rotating torque within pump stages to prevent the pump from getting stuck due to abrasives.

Embodiments of the disclosure advantageously allow for the elimination of one or more traditional ESP components, such as the motor protector, intake, separate pump and motor sections, shafts, couplings, and/or the motor lead extension. It should be noted, however, a scaling mechanism, e.g. tube, may be used with various traditional induction motors, permanent magnet motors, or other traditional ESP motors to provide a sealed environment which protects the stator.

Embodiments of the disclosure also may allow for the overall system efficiency to remain at, or be higher than, the level of conventional ESP system efficiency due to the use of high efficiency electrical machine design with high-efficiency hydraulic pump design without compromising cither electromagnetic or hydraulic design. Shaft-less design configurations may allow for pump stages with the head of, and higher efficiency than, a conventional centrifugal pump stage due to an increased working area. Pump 22 and motor 24 integration into a single section may reduce the number of parts and shorten the total length of the ESP 12. A reduction in the number of sections also may minimize installation time at the wellsite and reduce the probability of failure caused by human error, thus increasing reliability. Elimination of torque transmission components such as shafts and couplings may allow flexible connections between integrated pumping sections 16 which, in turn, can facilitate use of the electric submersible pumping system 12 in wells having high dogleg severity.

Figure 2:
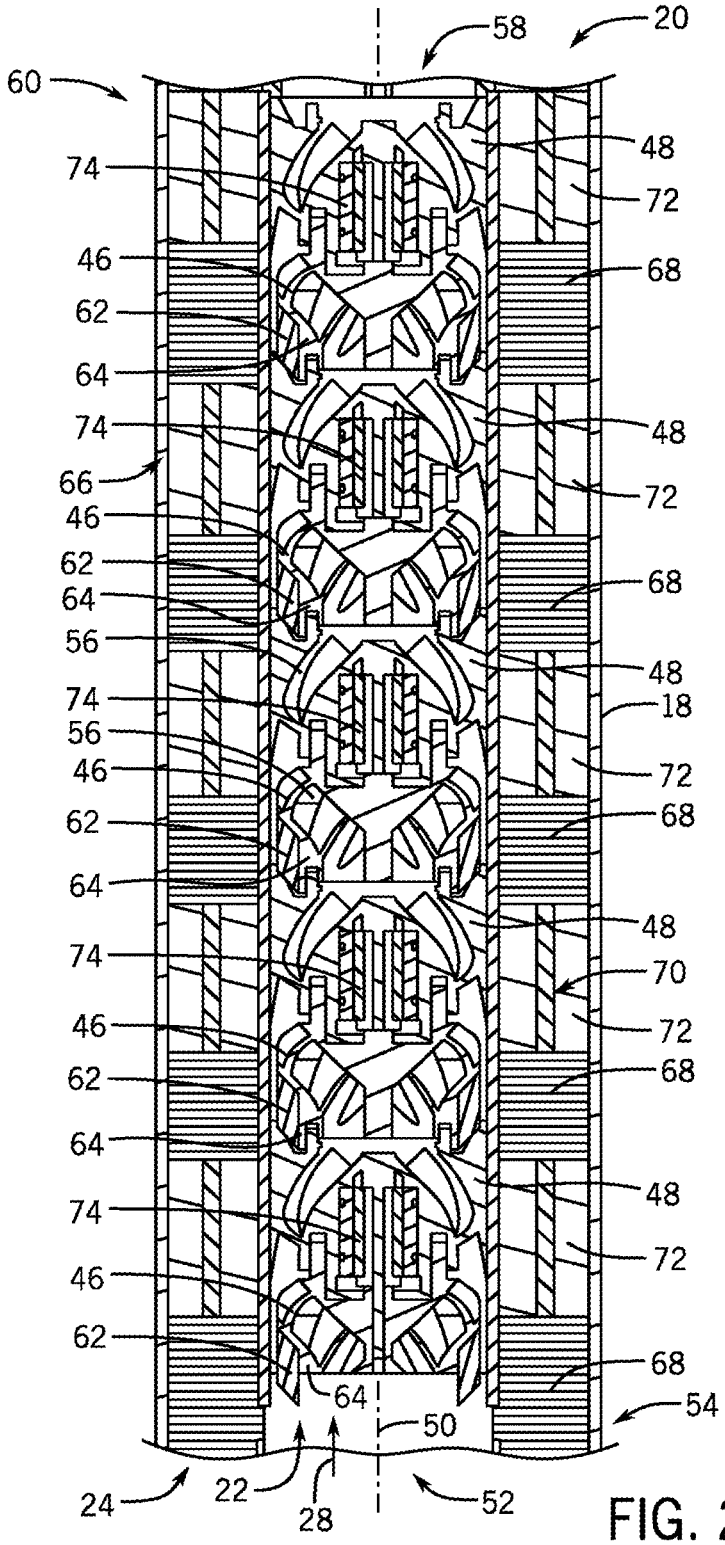
FIG. 2 is a cross-sectional view of an example of an integrated pump and motor stack of the electric submersible pumping system, in accordance with embodiments of the present disclosure.

FIG. 2 is a cross-sectional view of an example of the integrated pump and motor stack 20 of the electric submersible pumping system 12, in accordance with embodiments of the present disclosure. As illustrated in FIG. 2, the integrated pump and motor stack 20 may be disposed within an outer housing 18 (see, e.g., FIG. 1). As described in greater detail herein, the integrated pump and motor stack 20 includes the pump 22, which may be in the form of a centrifugal pump having at least one impeller 46 and at least one diffuser 48. In such embodiments, the at least one impeller 46 may include various styles of impeller vanes for moving fluid upon impeller rotation. However, the pump 22 and the associated at least one impeller 46 may be constructed in various other types of configurations. In the embodiment illustrated in FIG. 2, the pump 22 comprises a plurality of impellers 46 positioned axially along a longitudinal axis 50 of the electric submersible pumping system 12 and in cooperation with corresponding diffusers 48, which are also positioned axially along the longitudinal axis 50 of the electric submersible pumping system 12. Specifically, as illustrated in FIG. 2, the impellers 46 and the diffusers 48 are positioned in an alternating manner along the longitudinal axis 50 of the electric submersible pumping system 12. As described in greater detail herein, in certain embodiments, the impellers 46 may be magnetic impellers (e.g., impellers that are at least partially comprised of a magnetic material, or impellers that include one or more magnetic components integrated into the impellers). The diffusers 48 may be non-magnetic diffusers.

Figure 52:
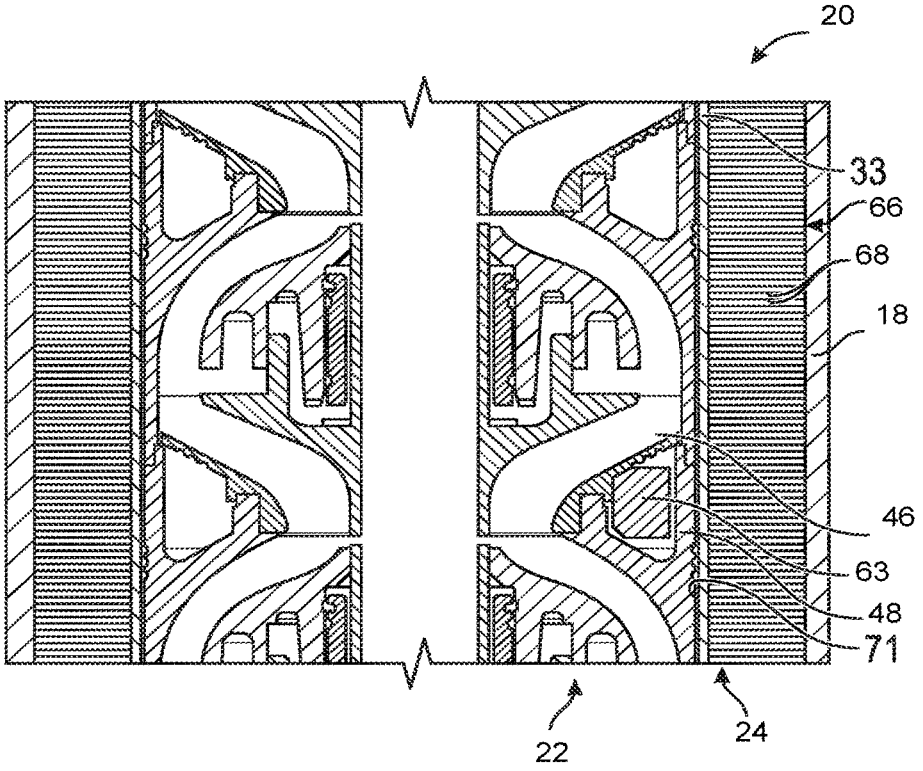
FIG. 52 is a cross-sectional illustration of an example of a portion of an integrated pump and motor of the ESP system in which a tube is positioned along the stator to protect and seal the stator, according to an embodiment of the disclosure.
Figure 53:
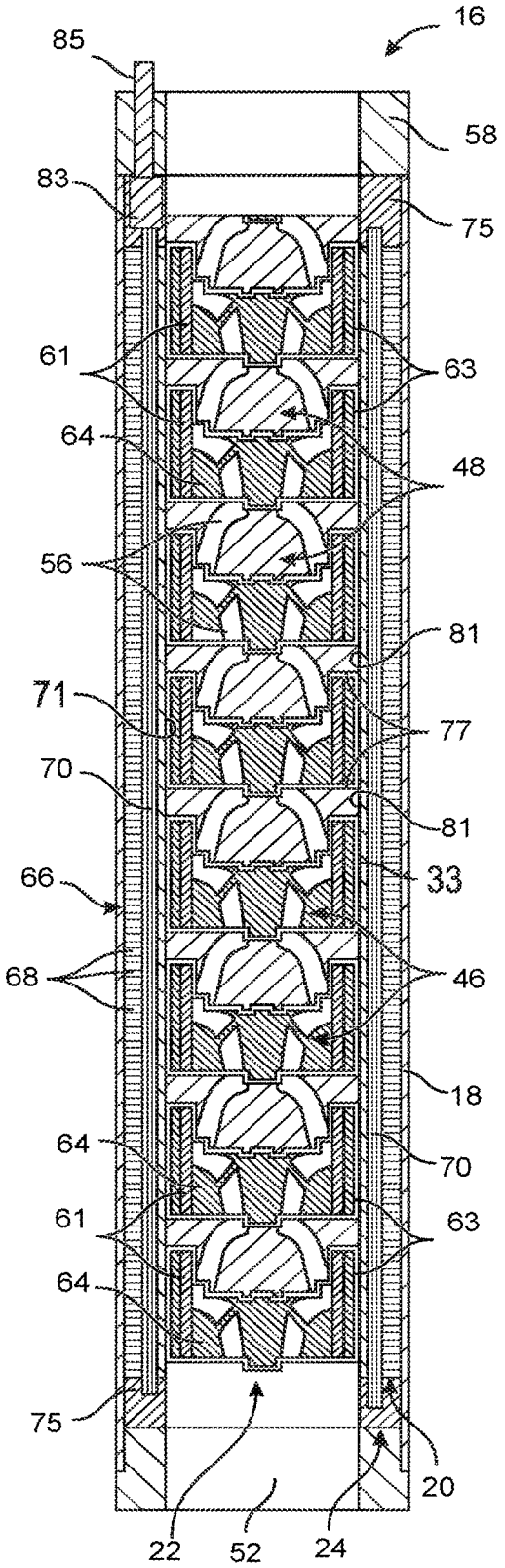
FIG. 53 is a cross-sectional illustration of another example of an integrated pump and motor of the ESP system having a protective tube, according to an embodiment of the disclosure.

FIGS. 52 and 53 illustrate an example embodiment of electric submersible pumping system in which the pump 22 includes a plurality of impellers 46 positioned in cooperation with corresponding diffusers 48 to create pump stages, which are surrounded by tube 33.

During operation, a first impeller 46 of the plurality of impellers 46 receives fluid 28 (e.g., well fluid) through a fluid intake 52 at a downhole axial end 54 of the integrated pump and motor stack 20 (which receives the fluid 28 from the fluid intake 42 of the electric submersible pumping system 12), and directs the fluid 28 generally axially uphole to the next sequential diffuser 48 which, in turn, directs the fluid 28 generally axially uphole to the next sequential impeller 46, and so on. As such, the fluid 28 flows along a flow path 56 through sequential impellers 46 and diffusers 48 until being discharged through a discharge head 58 at an uphole axial end 60 of the integrated pump and motor stack 20. In embodiments including tube 33, the fluid flows within tube 33 along flow path 56. In certain embodiments, the flow path 56 may be in the form of a fluid conduit for transporting the fluid 28 from a first (e.g., downhole) axial side to a second (e.g., uphole) axial side of each impeller 46, and from a first (e.g., downhole) axial side to a second (e.g., uphole) axial side of each diffuser 48 sequentially.

In the embodiment illustrated in FIG. 2, each impeller 46 includes a magnet 62 (e.g., a permanent magnet), which may be disposed at various positions within the respective impeller 46 or along an exterior of the respective impeller 46. For example, in certain embodiments, each magnet 62 may be annular in shape (e.g., have the form of a ring or hollow cylinder) disposed about a body 64 of the respective impeller 46. Functionally, each magnet 62 may be considered part of the motor 24 of the integrated pump and motor stack 20. The magnets 62 of the impellers 46 are configured to cause the impellers 46 to rotate so as to pump the fluid 28 from the fluid intake 52 of the integrated pump and motor stack 20 and out through the discharge head 58 (e.g., fluid discharge) of the integrated pump and motor stack 20.

In the embodiments illustrated in FIGS. 52 and 53, each impeller 46 can include a magnetic component 61 which may be disposed at various positions within the impeller 46 or along the exterior of impeller 46. By way of example, each magnetic component 61 may be annular in shape and have the form of a ring or cylinder disposed about a body 64 of the impeller 46. As illustrated, each impeller 46 also may comprise a magnet 63, e.g. a permanent magnet, positioned at an external location with respect to the impeller body 64. The magnet 63 can be configured as a rotor magnet mounted along each or at least some of the impellers 46. The rotor magnet 63 may have a variety of ring configurations or other configurations selected to accommodate a given integrated pump and motor construction. By way of further example, each magnet 63 may be annular in shape and in the form of a ring or cylinder positioned around the corresponding magnetic component 61, as illustrated in the embodiment of FIG. 53.

Functionally, the magnetic component 61 and magnet 63 may be considered part of the motor 24. Because the magnetic components 61 and magnets 63 of impellers 46 are fixed to the impeller bodies 64, motor 24 is able to rotate the impellers 46 so as to pump fluid from intake 52 and out through discharge head 58. It should be noted the magnetic component 61 and magnet 63 may be combined with the corresponding impeller body 64 on an individual impeller 46 or on groups of impellers 46 selected from the overall group of impellers 46.

In certain embodiments, the motor 24 includes a stator 66 disposed along an interior of the outer housing 18. The stator 66 can be annular in form. In certain embodiments, the stator 66 may be constructed with a magnetic core and/or with materials having desired magnetic or electric anisotropy. In certain embodiments, the stator 66 is constructed with a plurality of stacked stator laminations 68. In certain embodiments, a magnet wire 70 (or magnet wires or magnet wire coils) may extend through the stator 66 in a generally lengthwise direction. For example, in certain embodiments, magnet wire passages (e.g., slots) may be formed longitudinally through the stator 66 (e.g., through the stack of stator laminations 68), and the magnet wire 70 may be fed through the magnet wire passages to form a stator coil. In addition, in certain embodiments, longitudinal or axial ends of the magnet wire 70 may be contained by coil end encapsulations 75 located at axial ends of the respective magnet wire 70 and/or at each axial end 54, 60 of the integrated pump and motor stack 20 (as shown in, for example, FIG. 53).

In the embodiments of FIGS. 52 and 53, the tube 33 is disposed along an interior of the stator 66 and serves to provide a sealing mechanism which protects the stator 66 against entry of well fluids which could otherwise cause damage to the stator 66. In this example, the tube 33 defines a central passage 71, e.g. a bore, located within tube 33 and thus within stator 66. The tube 33 can be disposed along an interior of the plurality of laminations 68 to similarly define passage 71 extending longitudinally through the stator 66. The tube 33 may be sealed with respect to the stator laminations 68 to prevent contact between the stator laminations 68 and a fluid, e.g., well fluid, moving along the passage 71.

In some embodiments, the ends of tube 33 may be connected and sealed to the coil end encapsulations 75 to enclose the stator in a sealed environment between tube 33 and outer housing 18. By way of example the ends of tube 33 may be sealed via O-rings, welded, or otherwise sealably attached to encapsulations 75 or other suitable structures to form the sealed environment for protecting stator 66.

The diffusers 48, which can be non-magnetic, may be held in stationary positions with respect to stator 66. For example, as described in greater detail herein, in certain embodiments, each diffuser 48 may be locked to the surrounding stator 66, for example, via a key or other protuberance 77 of each respective diffuser 48 engaging a corresponding recess 81 located along an inside diameter of the stator 66. Consequently, the diffusers 48 may be prevented from rotating during rotation of the impellers 46 while operating the integrated pump and motor stack 20.

To cause operation of the motor 24 and pumping of the fluid 28 via the pump 22, electricity is supplied to the magnet wire 70 via an electric cable 85 coupled with the magnet wire 70, for example, via a cable connector (for example, cable connector 83 as shown in, for example, FIG. 53). For example, the electric cable 85 may be the same as or part of the overall power cable 38 illustrated in FIG. 1. The rotating magnetic field created by electricity flowing along the winding created by the magnet wire 70 extends to the inside diameter of the stator 66, and interacts with the magnetic impellers 46 (e.g., with the magnets 62, magnetic components 61, and/or magnets 63 of the respective impellers 46). For example, the magnets 62 of the impellers 46 may be oriented to provide appropriately positioned polarity along the outer surface of the impellers 46. In this manner, the stator 66 and the magnets 62, magnetic components 61, and/or magnets 63 function as an electric motor 24, and cause rotation of the impellers 46. As such, the structure of the impellers 46 enables the impellers 46 to function as a rotor of the motor 24 while also facilitating pumping of the fluid 28 along the pump 22. In certain embodiments, the magnetic gap between the stator 66 and the magnets 62 may be relatively constant and continuous. In addition, in certain embodiments, the impellers 46 may rotate independently with respect to each other. In addition, as also illustrated in FIG. 2, in certain embodiments, a stator winding spacer 72 may be used to space the stack of stator laminations 68 and the magnet wire 70 apart within the housing 18.

As also illustrated in FIG. 2, in certain embodiments, each impeller/diffuser stage (e.g., set of adjacent impeller 46 and diffuser 48) may be associated with a respective radial and/or thrust bearing 74. As described in greater detail herein, the specific configurations of radial and/or thrust bearings 74 may vary based on individual embodiments. For example, in the embodiment illustrated in FIG. 2, the radial and/or thrust bearing 74 may be disposed within an interior bore of each respective diffuser 48. However, in other embodiments, the individual components of the radial and/or thrust bearing 74 may be positioned elsewhere with respect to the respective impeller 46 and diffuser 48.

Figure 3:
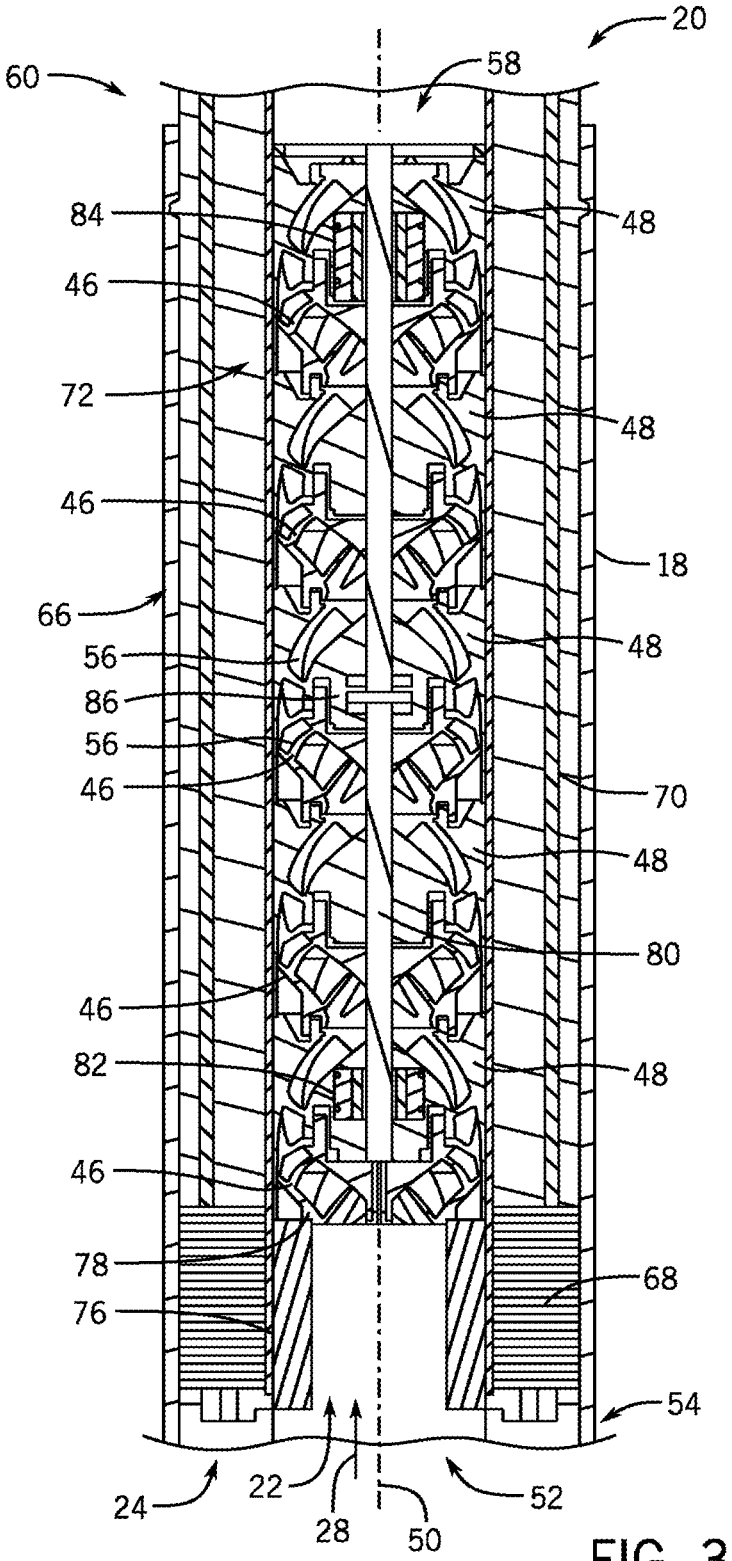
FIG. 3 is a cross-sectional view of another example of an integrated pump and motor stack of the electric submersible pumping system, in accordance with embodiments of the present disclosure.

It is noted that the embodiment illustrated in FIG. 2 does not include a shaft to connect the adjacent impellers 46 and diffusers 48. However, other embodiments may include such a shaft. For example, FIG. 3 is a cross-sectional view of another example of the integrated pump and motor stack 20 of the electric submersible pumping system 12, in accordance with embodiments of the present disclosure. Contrary to the embodiment illustrated in FIG. 2, the embodiment illustrated in FIG. 3 includes a plurality of impeller/diffuser stages that are driven by a single large magnet 76 (e.g., as opposed to the individual stage magnets 62 illustrated in FIG. 2) that is physically attached to a skirt 78 of the first impeller 46 at the downhole axial end 54 of the integrated pump and motor stack 20. Accordingly, the illustrated embodiment also includes a single set of stacked stator laminations 68 (e.g., as opposed to the plurality of stacked stator laminations 68 illustrated in FIG. 2), which generally aligns with the single large magnet 76 along the longitudinal axis 50. As also illustrated in FIG. 3, a shaft 80 physically couples the impellers 46 of the integrated pump and motor stack 20.

Figure 54:
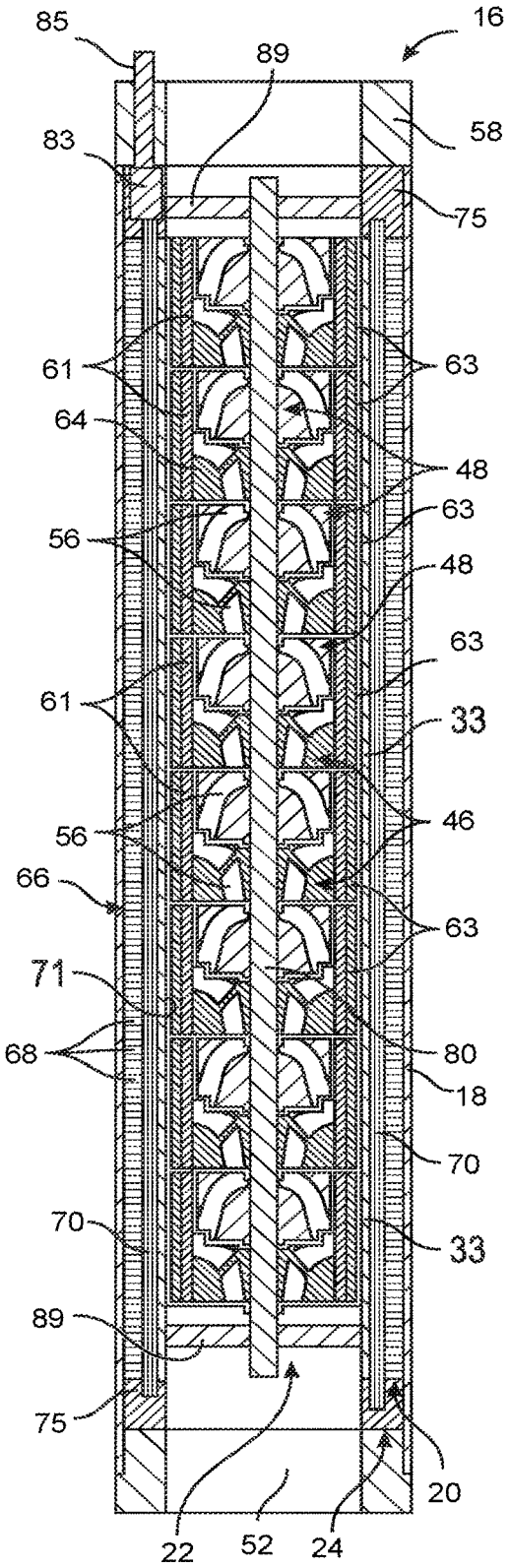
FIG. 54 is a cross-sectional illustration of another example of an integrated pump and motor of the ESP system having a protective tube, according to an embodiment of the disclosure.

Referring generally to FIG. 54, another embodiment of pumping section 16 is illustrated including a stationary shaft 80 extending generally along a central axis of the pumping section 16. The shaft 80 is fixed in a stationary position within housing 18 via shaft fixators 89 coupled between, for example, the shaft 80 and housing 18 (or between the shaft 80 and stator 66). In this example, the stationary, non-magnetic diffusers 48 are locked to stationary shaft 80. However, the impellers 46 may freely rotate about the shaft 80. In some embodiments, the impellers 46 may rotate about shaft 80 independently with respect to each other or in desired groups.

In such embodiments, stator 66 may again be protected by tube 33. The stator 66 can include a winding of magnet wire 70 which is supplied with electricity via electric cable 85. The resulting magnetic field is used to rotate impellers 46 which cause the inflow of fluid through intake 52 and the discharge of fluid through discharge head 58. The flowing fluid, e.g. well fluid, passes through the plurality of non-magnetic diffusers 48 and magnetic impellers 46 before being discharged through discharge head 58.

As illustrated in FIG. 3, in certain embodiments, instead of each impeller/diffuser stage having its own radial and/or thrust bearing 74, the integrated pump and motor stack 20 may include a first journal bearing 82 disposed within an interior bore of the first (i.e., most downhole) diffuser 48 of the integrated pump and motor stack 20, a second journal bearing 84 disposed within an interior bore of the last (e.g., most uphole) diffuser 48 of the integrated pump and motor stack 20, and a single thrust bearing 86 positioned near an axial center of the integrated pump and motor stack 20. In the embodiment illustrated in FIG. 3, the single thrust bearing 86 is an up/down-thrust bearing.

Figure 4:
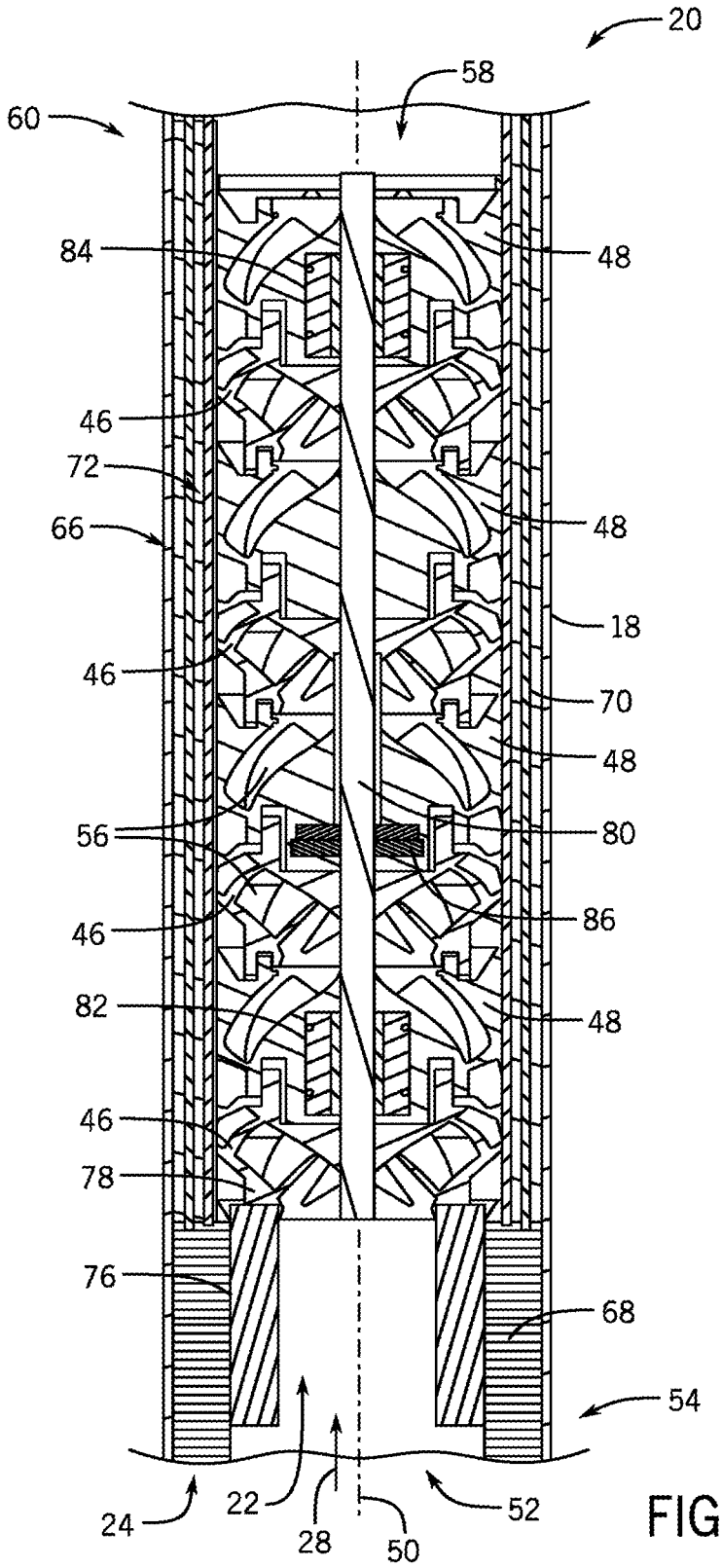
FIG. 4 is a cross-sectional view of another example of an integrated pump and motor stack of the electric submersible pumping system, in accordance with embodiments of the present disclosure.

In certain embodiments, an outer diameter of the diffusers 48 may be increased such that the diffuser stack may be used as a stator spacer, for example, with three-phase cables passing radially outside of the diffuser stack. In addition, in certain embodiments, the outer diameter of the diffusers 48 may be further increased such that the diffuser stack allows for even greater hydraulic space through which the fluid 28 may flow. For example, FIG. 4 is a cross-sectional view of another example of the integrated pump and motor stack 20 of the electric submersible pumping system 12 in accordance with embodiments of the present disclosure. The embodiment illustrated in FIG. 4 is substantially similar to the embodiment illustrated in FIG. 3, however, the outer diameters of the diffusers 48 are increased. It is noted that the embodiment illustrated in FIG. 4 also includes a single thrust bearing 86 that is a bottom thrust bearing.

Figure 5:
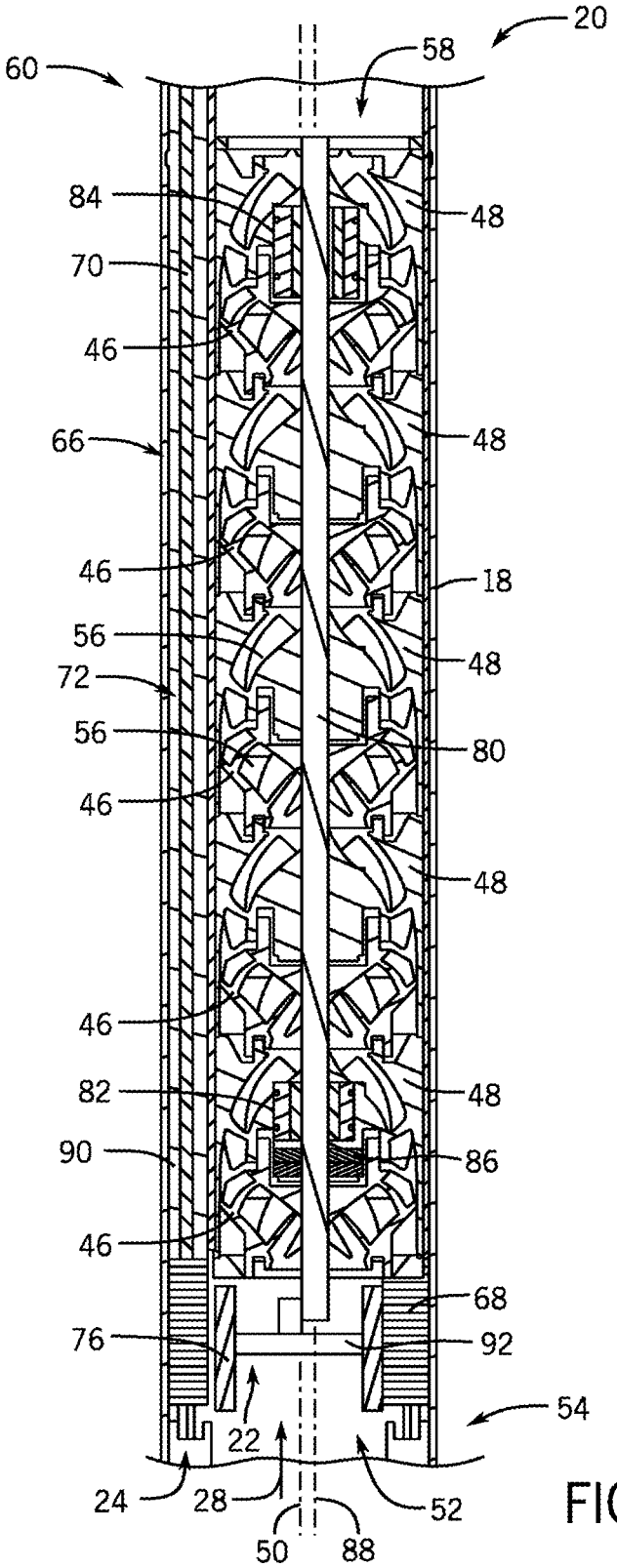
FIG. 5 is a cross-sectional view of another example of an integrated pump and motor stack of the electric submersible pumping system, in accordance with embodiments of the present disclosure.

FIG. 5 is a cross-sectional view of another example of the integrated pump and motor stack 20 of the electric submersible pumping system 12, in accordance with embodiments of the present disclosure. In the embodiment illustrated in FIG. 5, the outer diameters of the diffusers 48 may be even further increased by offsetting a longitudinal axis 88 of the integrated pump and motor stack 20 with the longitudinal axis 50 of the housing 18 (e.g., as opposed to other embodiments where the integrated pump and motor stack 20 and housing 18 share a common longitudinal axis 50). As illustrated in FIG. 5, in this embodiment, the three-phase cable and the magnet wire 70 pass through just one side of an annular space 90 within the housing 18. As illustrated, in certain embodiments, to compensate for the offset of the longitudinal axes 50, 88, an offset and/or step-up gear mechanism 92 is used to transfer torque from the longitudinal axis 50 between the single large magnet 76 to the shaft 80. In certain embodiments, the single large magnet 76 may be mounted to a separate impeller 46, allowing flow of the fluid 28 with the step-up gear mechanism 92 at its hub. It is noted that the embodiment illustrated in FIG. 5 also includes a single thrust bearing 86 positioned adjacent the first (e.g., most downhole) impeller 46 of the integrated pump and motor stack 20.

Figure 6:
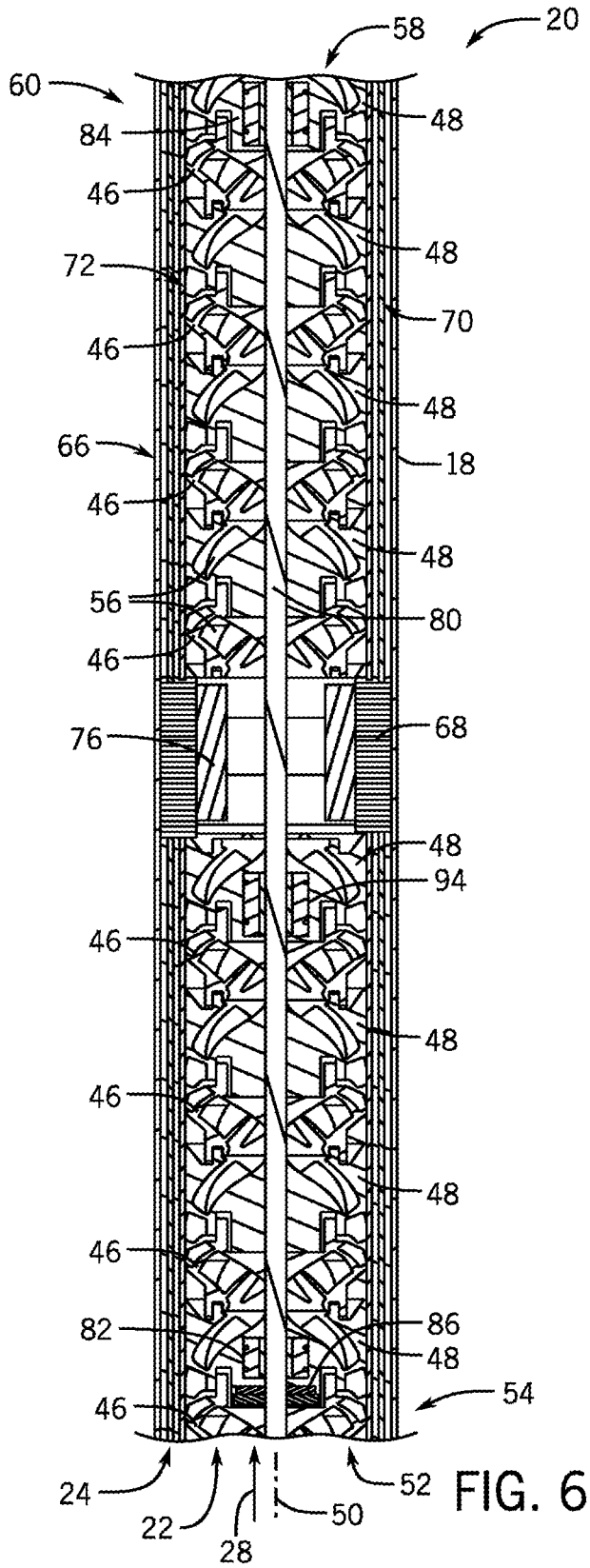
FIG. 6 is a cross-sectional view of another example of an integrated pump and motor stack of the electric submersible pumping system, in accordance with embodiments of the present disclosure.

FIG. 6 is a cross-sectional view of another example of the integrated pump and motor stack 20 of the electric submersible pumping system 12, in accordance with embodiments of the present disclosure. In the embodiment illustrated in FIG. 6, the single large magnet 76 is positioned near an axial center of the integrated pump and motor stack 20 along the longitudinal axis 50. In other words, as illustrated in FIG. 6, the integrated pump and motor stack 20 includes the same amount of impeller/diffuser stages below (i.e., downhole from) the single large magnet 76 as above (i.e., uphole from) the single large magnet 76. As such, the single set of stacked stator laminations 68 is positioned near the axial center of the integrated pump and motor stack 20 along the longitudinal axis 50 to generally align with the single large magnet 76. It is noted that the embodiment illustrated in FIG. 6 also includes an additional journal bearing 94 disposed within an interior bore of the diffuser 48 that is just below (i.e., downhole from) the single large magnet 76.

Figure 7:
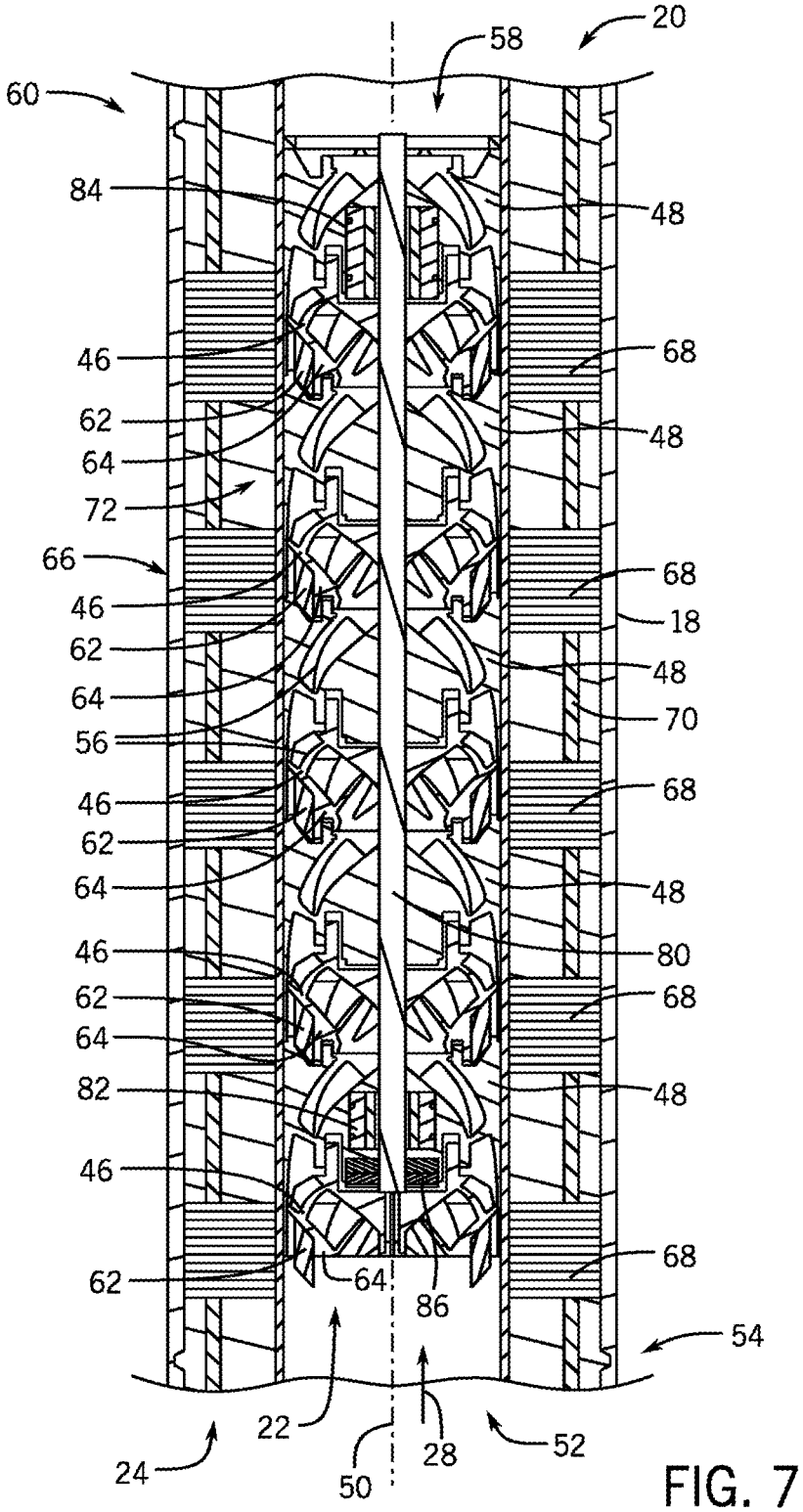
FIG. 7 is a cross-sectional view of another example of an integrated pump and motor stack of the electric submersible pumping system, in accordance with embodiments of the present disclosure.

FIG. 7 is a cross-sectional view of another example of the integrated pump and motor stack 20 of the electric submersible pumping system 12, in accordance with embodiments of the present disclosure. In the embodiment illustrated in FIG. 7, similar to the embodiment illustrated in FIG. 2, each impeller 46 of the integrated pump and motor stack 20 includes a magnet 62 (e.g., a permanent magnet), as opposed to the single large magnet 76 illustrated in FIGS. 3-6. However, the embodiment illustrated in FIG. 7 also includes a shaft 80 that physically couples the impellers 46 of the integrated pump and motor stack 20. It is noted that the bearing placement of the embodiment illustrated in FIG. 7 is substantially similar to the bearing placement illustrated in FIG. 5.

Figure 8:
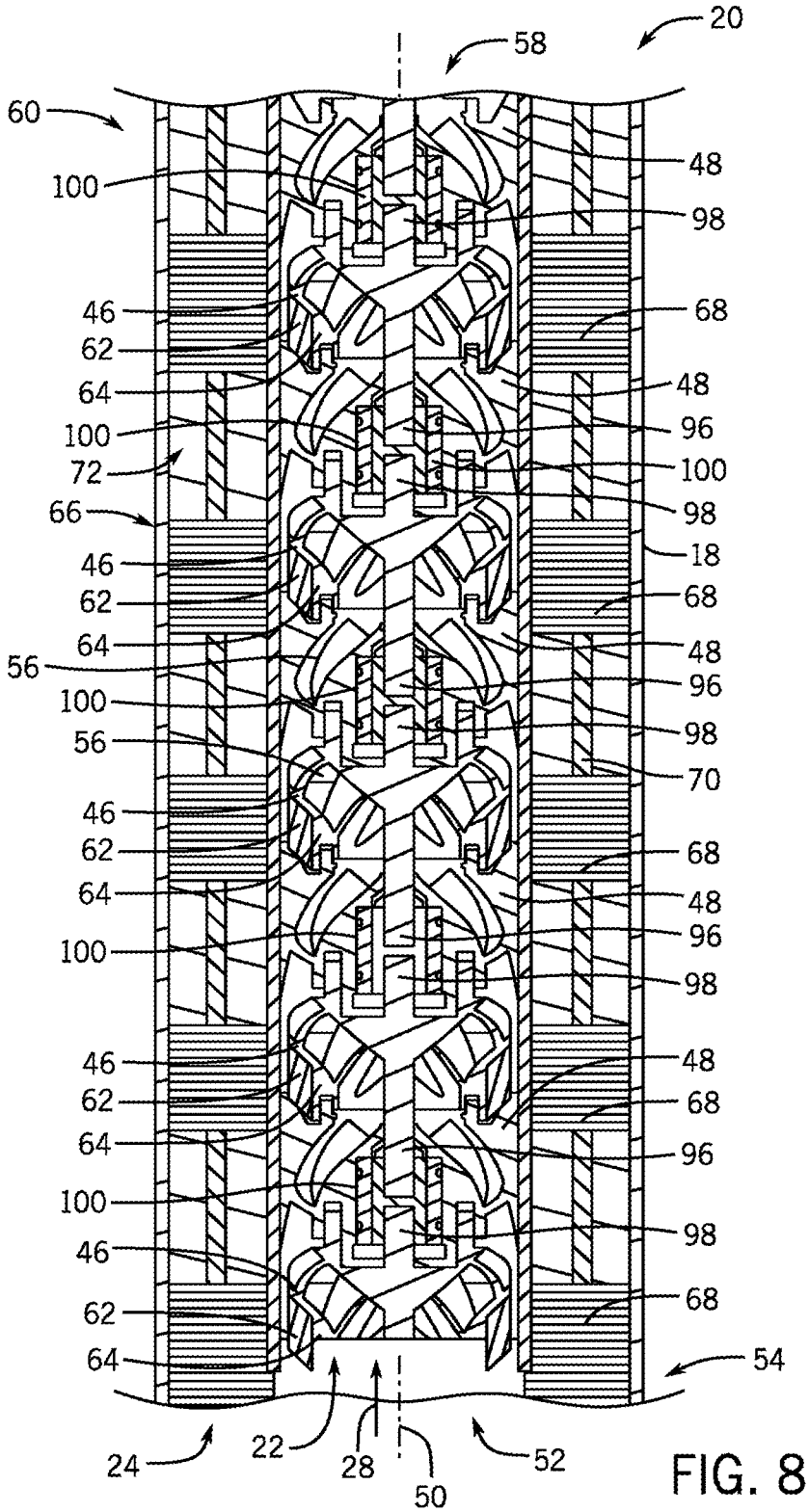
FIG. 8 is a cross-sectional view of another example of an integrated pump and motor stack of the electric submersible pumping system, in accordance with embodiments of the present disclosure.

FIG. 8 is a cross-sectional view of another example of the integrated pump and motor stack 20 of the electric submersible pumping system 12, in accordance with embodiments of the present disclosure. The embodiment illustrated in FIG. 8 is substantially similar to the embodiment illustrated in FIG. 2, which does not have a shaft 80. However, the embodiment illustrated in FIG. 8 includes a plurality of stemmed impellers 46, which may be used to center the respective impeller 46 from both front and rear ends. In particular, as illustrated in FIG. 8, all but the bottom (i.e., most downhole) impeller 46 of the integrated pump and motor stack 20 includes a first stem 96 that extends axially downward (i.e., downhole) from the respective impeller 46, and a second stem 98 that extends axial upward (i.e., uphole) from the respective impeller 46. In other words, both axial sides of these impellers 46 include stems 96, 98 that extend axially from the respective impeller 46. As also illustrated in FIG. 8, the stems 96, 98 of the impellers 46 are supported by journal bearings 100. More specifically, as illustrated in FIG. 8, a second stem 98 of an impeller 46 and a first stem 96 of an adjacent, axially uphole impeller 46 are supported by a respective journal bearing 100.

Figure 9:
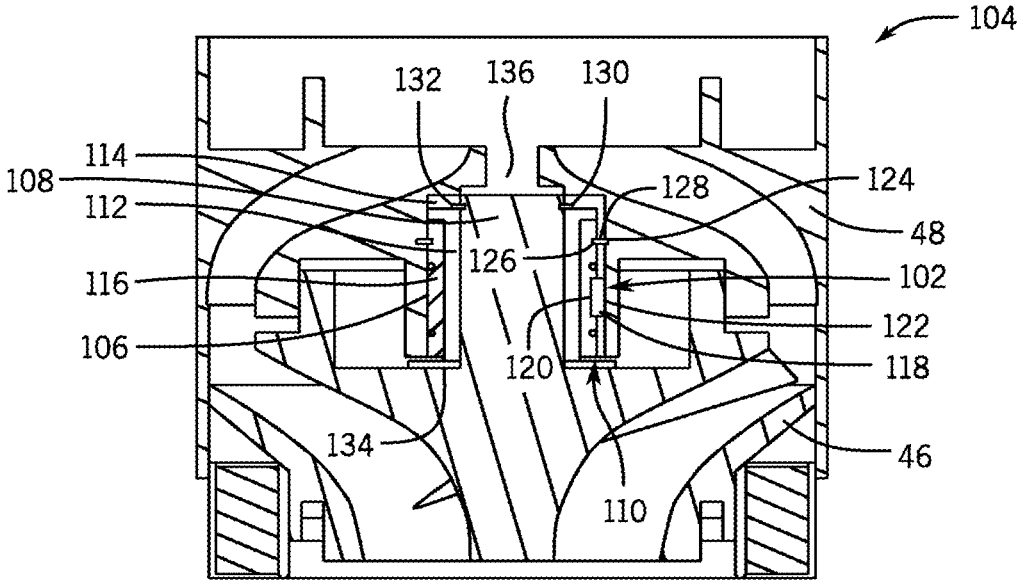
FIG. 9 is a cross-sectional view of an example of a radial/thrust bearing disposed between an adjacent impeller and diffuser of the integrated pump and motor stack of the electric submersible pumping system, in accordance with embodiments of the present disclosure.

The bearings used to support the impellers 46, the diffusers 48, and in certain embodiments, shafts 80 may vary between embodiments. For example, the bearings 74, 82, 84, 86, 94, 100 illustrated with respect to FIGS. 2-8 may be, or be used alternatively to, any of the other bearings described herein, in certain embodiments. FIG. 9 is a cross-sectional view of an example of a radial/thrust bearing 102 disposed between an adjacent impeller 46 and diffuser 48 of the integrated pump and motor stack 20 of the electric submersible pumping system 12, in accordance with embodiments of the present disclosure. As described herein, each pair of impeller 46 and axially-adjacent diffuser 48 above (e.g., more uphole from) the respective impeller 46 (e.g., as illustrated in FIG. 9) may be referred to as an impeller/diffuser stage 104 of the integrated pump and motor stack 20. All of the embodiments of the radial/thrust bearing 102 described herein are configured to support both radial loads as well as axial loads. As described in greater detail herein, in certain embodiments, each impeller/diffuser stage 104 includes a radial/thrust bearing 102 disposed between the respective impeller 46 and diffuser 48. However, in other embodiments, radial/thrust bearings 102 may be disposed between every other impeller/diffuser stage 104, at opposite axial ends 54, 60 of the integrated pump and motor stack 20, or at other locations in various configurations.

As illustrated in FIG. 9, in certain embodiments, the radial/thrust bearing 102 is configured to fit within an interior bore 106 of the diffuser 48, and to fit radially around a generally cylindrical hub 108 of the impeller 46 that extends axially upward (e.g., uphole) into the interior bore 106 of the diffuser 48. As such, the radial/thrust bearing 102 fits within an annular space 110 defined between the interior bore 106 of the diffuser 48 and the hub 108 of the adjacent impeller 46. In the embodiment illustrated in FIG. 9, the radial/thrust bearing 102 includes a radial bearing sleeve 112 and a thrust runner 114. As illustrated in FIG. 9, in certain embodiments, the radial bearing sleeve 112 and the thrust runner 114 may be constructed as a single piece, with the radial bearing sleeve 112 comprising the generally annular portion illustrated in FIG. 9, and the thrust runner 114 being the generally flange-like protrusion that extends radially outward from an upper (e.g., more uphole) axial end of the radial bearing sleeve 112. However, in other embodiments, the radial bearing sleeve 112 and the thrust runner 114 may be separate pieces configured to axial abut each other. Indeed, all embodiments of the radial bearing sleeve 112 and the thrust runner 114 described herein may either by constructed as a single piece or separated into separate pieces configured to axially abut each other. During assembly, the thrust runner 114 is inserted into the interior bore 106 of the diffuser 48 first, followed by pressing a generally annular-shaped bushing 116 into the interior bore 106 between the diffuser 48 and the radial bearing sleeve 112, thus locking the thrust runner 114 inside the interior bore 106 of the diffuser 48.

As also illustrated in FIG. 9, in certain embodiments, a key 118 may be used on an outer diameter of the bushing 116 to lock the bushing 116 in place within the interior bore 106 of the diffuser 48, thereby preventing rotation of the bushing 116 within the interior bore 106 of the diffuser 48. More specifically, as illustrated in FIG. 9, the key 118 may be configured to fit within a first mating recess 120 extending into the bushing 116 and second mating recess 122 into the interior bore 106 of the diffuser 48, which are generally axially aligned to receive the key 118.

As also illustrated in FIG. 9, in certain embodiments, a retainer ring 124 may be used to prevent the bushing 116 from moving axially within the interior bore 106 of the diffuser 48, and to transfer the axial load from the thrust runner 114 to the diffuser 48. More specifically, as illustrated in FIG. 9, the retainer ring 124 may be in the shape of a relatively thin annular ring that is configured to fit within an inward radially extending slot 126 within the bushing 116 and an outward radially extending slot 128 into the interior bore 106 of the diffuser 48, which are generally axially aligned to receive the retainer ring 124.

As also illustrated in FIG. 9, in certain embodiments, a snap ring 130 may be used to lock the thrust runner 114 in place within the interior bore 106 of the diffuser 48 and axially against the impeller 46. More specifically, as illustrated in FIG. 9, the snap ring 130 may be in the shape of a relatively thin annular ring that is configured to fit within an inward radially extending slot 132 within the hub 108 of the impeller 46, and to axially abut an upper (e.g., uphole) axial end of the thrust runner 114 to lock the thrust runner 114 in place within the interior bore 106 of the diffuser 48 and axially against the impeller 46. As also illustrated in FIG. 9, in certain embodiments, a separate up-thrust washer 134 may be used to carry the up-thrust load. It should also be noted that, in certain embodiments, the interior bore 106 of the diffuser 48 may be open at an upper (e.g., uphole) axial end 136 of the interior bore 106 such that the snap ring 130 may be accessible during assembly. However, in other embodiments (see, e.g., FIG. 10, among other embodiments), the interior bore 106 of the diffuser 48 may be closed at the upper (e.g., uphole) axial end 136 of the interior bore 106.

Figure 10:
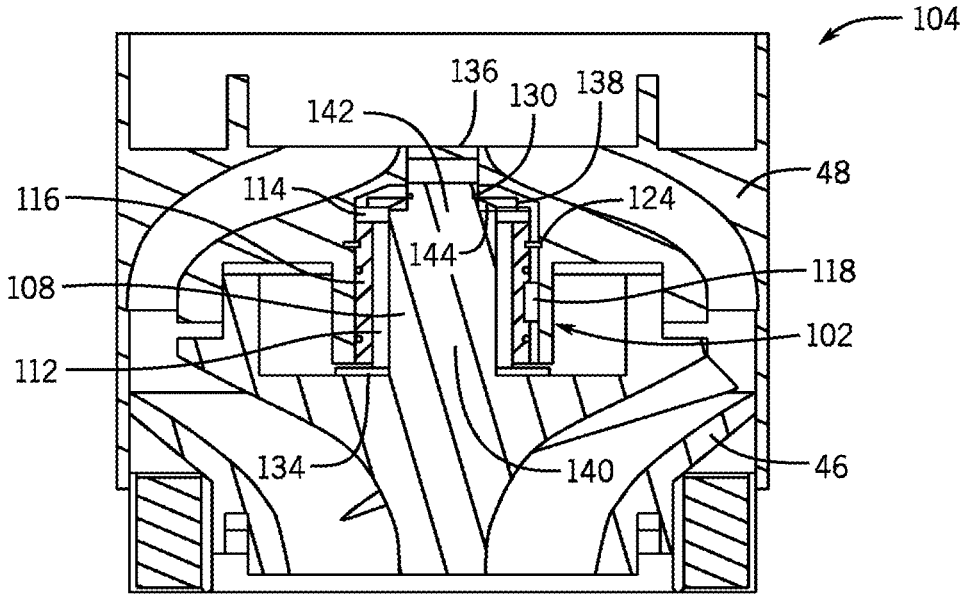
FIG. 10 is a cross-sectional view of another example of a radial/thrust bearing disposed between an adjacent impeller and diffuser of the integrated pump and motor stack of the electric submersible pumping system, in accordance with embodiments of the present disclosure.

FIG. 10 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 10 is substantially similar to the embodiment illustrated in FIG. 9. However, the embodiment illustrated in FIG. 10 includes a separate metal piece 138 that is used to lock the thrust runner 114 in the axial direction. More specifically, as illustrated in FIG. 10, the hub 108 of the impeller 46 includes a first cylindrical portion 140 that extends axially upward (e.g., uphole from) the impeller 46, and a second cylindrical portion 142 that extends axially upward (e.g., uphole from) the first cylindrical portion 140, where the second cylindrical portion 142 includes an outer diameter that is smaller than an outer diameter of the first cylindrical portion 140. As also illustrated in FIG. 10, the metal piece 138 may be in the shape of an annular ring having an inner chamfered edge 144 that guides the snap ring 130 on the impeller 46, and helps to lock the snap ring 130 in place. It should be noted that the embodiment illustrated in FIG. 10 includes a radial bearing sleeve 112 that is separate from the thrust runner 114. The assembly sequence for the embodiment illustrated in FIG. 10 includes the metal piece 138 and the thrust runner 114 being inserted into the interior bore 106 of the diffuser 48 prior to pressing the bushing 116 into the interior bore 106 between the diffuser 48 and the radial bearing sleeve 112. As with the embodiment illustrated in FIG. 9, the key 118 and the retainer ring 124 are also used to prevent axial motion and rotation with respect to the impeller 46 and the diffuser 48.

Figure 11:
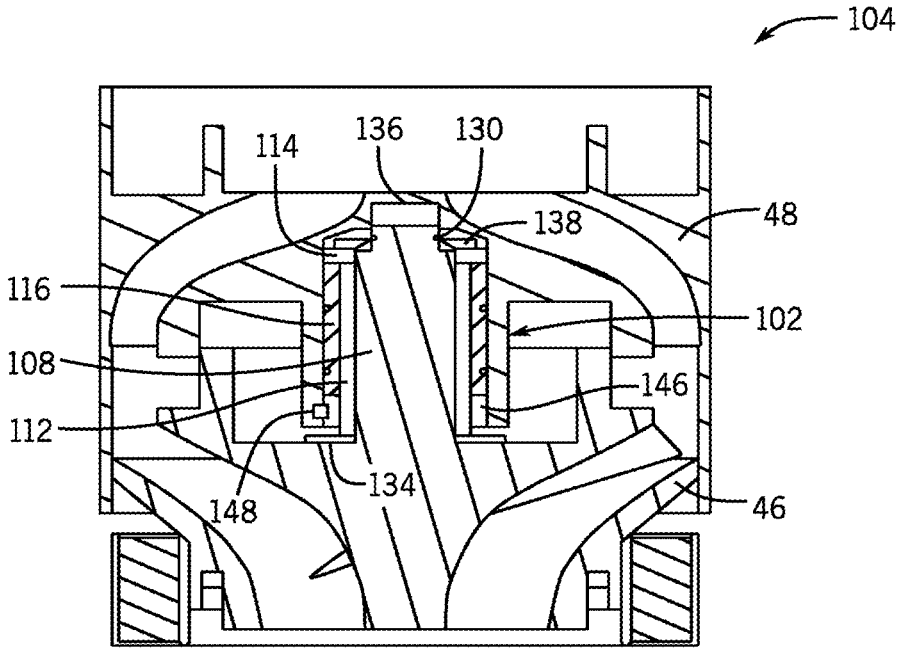
FIG. 11 is a cross-sectional view of another example of a radial/thrust bearing disposed between an adjacent impeller and diffuser of the integrated pump and motor stack of the electric submersible pumping system, in accordance with embodiments of the present disclosure.

FIG. 11 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 11 is substantially similar to the embodiment illustrated in FIG. 10. However, instead of using a key 118 and a retainer ring 124 (such as in FIGS. 9 and 10), the embodiment illustrated in FIG. 11 includes an up-thrust ring 146 configured to prevent rotation of the diffuser 48 relative to the radial/thrust bearing 102, and to transfer the axial load from the bushing 116 to the diffuser 48. More specifically, as illustrated in FIG. 11, the up-thrust ring 146 is a generally annular-shaped ring configured to fit radially between the interior bore 106 of the diffuser 48 and the radial bearing sleeve 112, for example, axially between the bushing 116 and the up-thrust washer 134. As also illustrated in FIG. 11, in certain embodiments, a retaining (e.g., snap) ring 148 may be used to axially lock the up-thrust ring 146 to the interior bore 106 of the diffuser 48.

Figure 12:
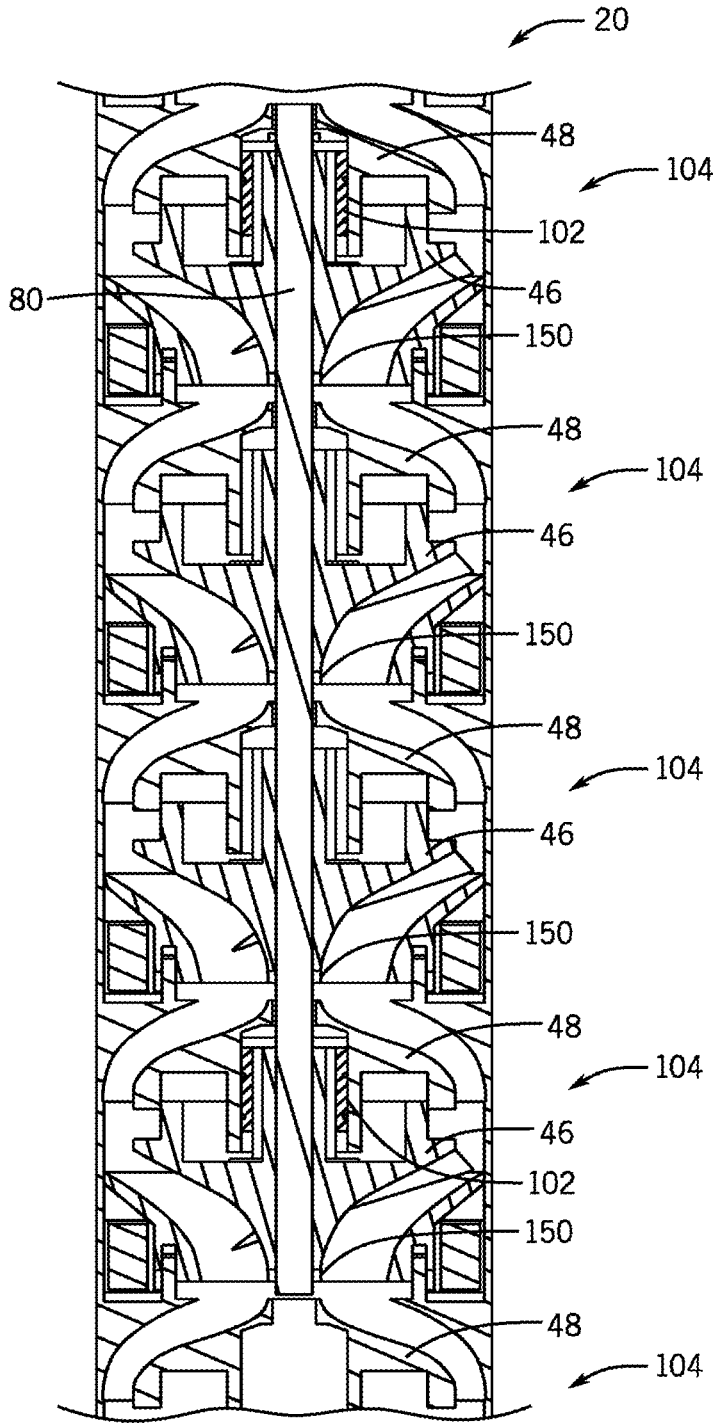
FIG. 12 is a cross-sectional view of the integrated pump and motor stack of the electric submersible pumping system, which has a shaft and two of the radial/thrust bearings of FIG. 11 at top (e.g., most uphole) and bottom (e.g., most downhole) impeller/diffuser stages, in accordance with embodiments of the present disclosure.

As described herein, in certain embodiments, the radial/thrust bearing 102 illustrated in FIG. 11 may be used in each impeller/diffuser stage 104 of the integrated pump and motor stack 20 of the electric submersible pumping system 12. However, in other embodiments, the radial/thrust bearing 102 of FIG. 11 may used in embodiments that use a shaft 80. For example, FIG. 12 is a cross-sectional view of the integrated pump and motor stack 20 of the electric submersible pumping system 12, which has a shaft 80 and two of the radial/thrust bearings 102 of FIG. 11 at top (e.g., most uphole) and bottom (e.g., most downhole) impeller/diffuser stages 104, in accordance with embodiments of the present disclosure. More specifically, as illustrated in FIG. 12, the integrated pump and motor stack 20 includes a first radial/thrust bearing 102 in a lower (e.g., most downhole) impeller/diffuser stage 104 of the integrated pump and motor stack 20, and a second radial/thrust bearing 102 in an upper (e.g., most uphole) impeller/diffuser stage 104 of the integrated pump and motor stack 20. Each of the embodiments described herein may generally include any number of impeller/diffuser stages 104 having radial/thrust bearings 102. However, in general, the integrated pump and motor stack 20 of the electric submersible pumping system 12 includes at least two radial/thrust bearings 102 (e.g., at least one radial/thrust bearing 102 near the top of the integrated pump and motor stack 20, and at least one radial/thrust bearing 102 near the bottom of the integrated pump and motor stack 20).

As illustrated in FIG. 12, in certain embodiments, the hubs 108 of the impellers 46 are hollow, and allow the shaft 80 to physically couple all of the impellers 46 of the integrated pump and motor stack 20, and transfer the down-thrust from all of the impellers 46 to the impeller 46 of the upper (e.g., most uphole) impeller/diffuser stage 104 of the integrated pump and motor stack 20, which then transfers the load to the diffuser 48 of the upper (e.g., most uphole) impeller/diffuser stage 104 of the integrated pump and motor stack 20 through the radial/thrust bearing 102 in the upper (e.g., most uphole) impeller/diffuser stage 104 of the integrated pump and motor stack 20. As also illustrated in FIG. 12, the impellers 46 are physically coupled to the shaft 80 via a snap ring 150 (or pin mechanism) to transmit the axial loads.

Figure 13:
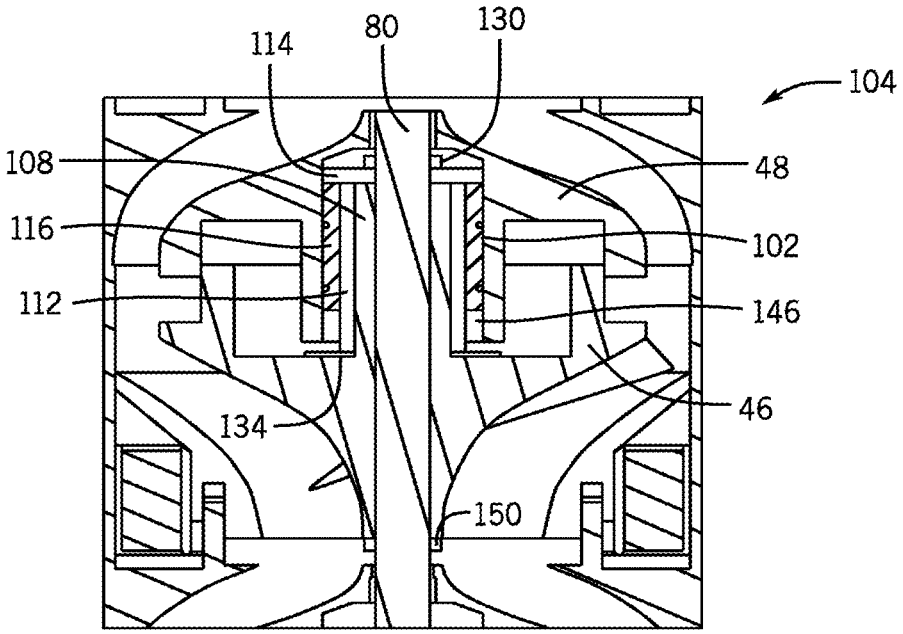
FIG. 13 is a cross-sectional view of another example of a radial/thrust bearing disposed between an adjacent impeller and diffuser of the integrated pump and motor stack of the electric submersible pumping system, in accordance with embodiments of the present disclosure.

FIG. 13 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 13 is substantially similar to the embodiment illustrated in FIG. 11. However, instead of using a separate metal piece 138, the embodiment illustrated in FIG. 13 includes only the snap ring 130, which axially abuts the thrust runner 114 to help hold the thrust runner 114 against the shaft 80. As also illustrated in FIG. 13, the snap ring 150 is used to transmit load from the impeller 46 to the shaft 80. In certain embodiments, the snap ring 150 is mounted on the shaft 80 after the impeller 46 has been assembled.

Figure 14:
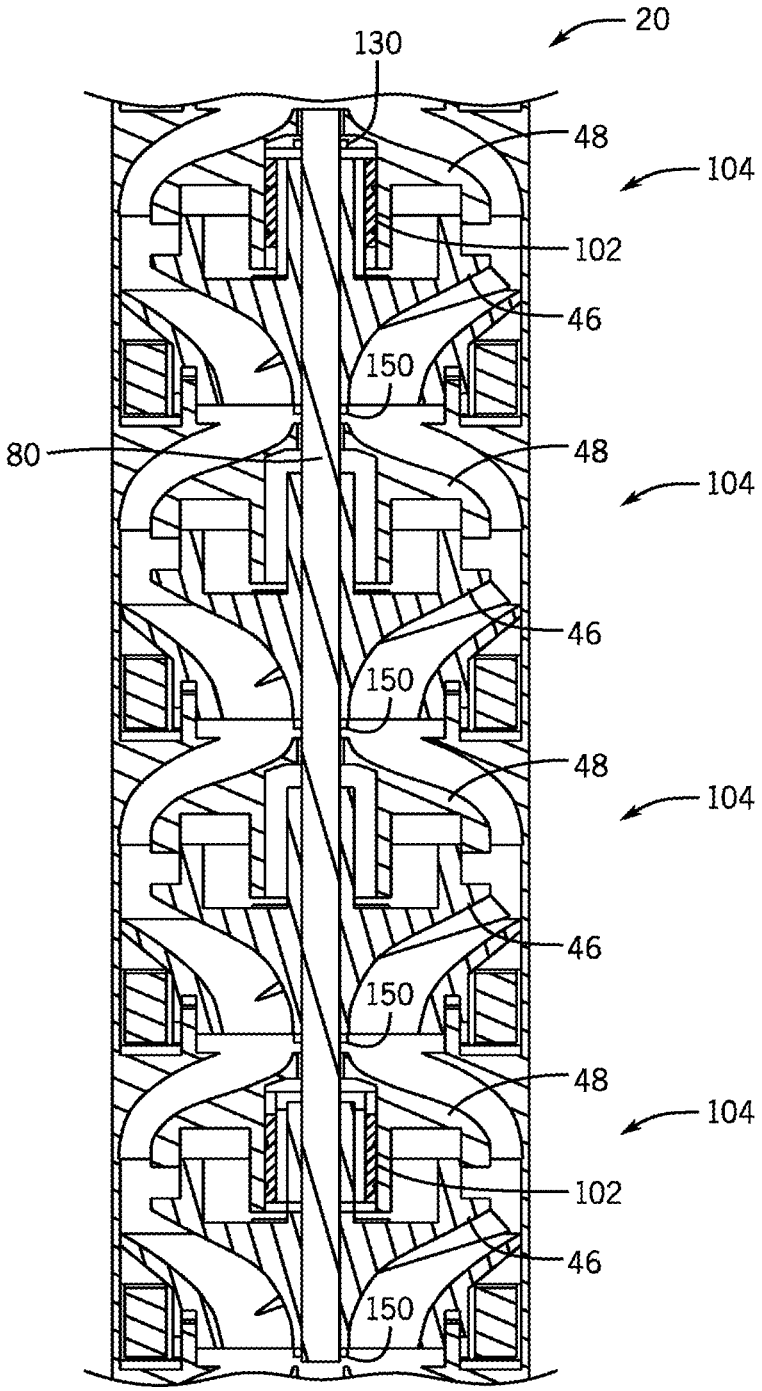
FIG. 14 is a cross-sectional view of the integrated pump and motor stack of the electric submersible pumping system, which has a shaft and two of the radial/thrust bearings of FIG. 13 at top (e.g., most uphole) and bottom (e.g., most downhole) impeller/diffuser stages, in accordance with embodiments of the present disclosure.

FIG. 14 is a cross-sectional view of the integrated pump and motor stack 20 of the electric submersible pumping system 12, which has a shaft 80 and two of the radial/thrust bearings 102 of FIG. 13 at top (e.g., most uphole) and bottom (e.g., most downhole) impeller/diffuser stages 104, in accordance with embodiments of the present disclosure. More specifically, similar to the embodiment illustrated in FIG. 12, the integrated pump and motor stack 20 illustrated in FIG. 14 includes a first radial/thrust bearing 102 in a lower (e.g., most downhole) impeller/diffuser stage 104 of the integrated pump and motor stack 20, and a second radial/thrust bearing 102 in an upper (e.g., most uphole) impeller/diffuser stage 104 of the integrated pump and motor stack 20. Also similar to the embodiment illustrated in FIG. 12, the hubs 108 of the impellers 46 illustrated in FIG. 14 are hollow, and allow the shaft 80 to physically couple all of the impellers 46 of the integrated pump and motor stack 20, and transfer the down-thrust from all of the impellers 46 to the thrust runner 114 in the upper (e.g., most uphole) impeller/diffuser stage 104 of the integrated pump and motor stack 20, which then transfers the load to the diffuser 48 of the upper (e.g., most uphole) impeller/diffuser stage 104 of the integrated pump and motor stack 20 through the radial/thrust bearing 102 in the upper (e.g., most uphole) impeller/diffuser stage 104 of the integrated pump and motor stack 20. It is noted that, as illustrated in FIG. 14, in certain embodiments, the orientation of the first and second radial/thrust bearings 102 may be reversed.

Figure 15:
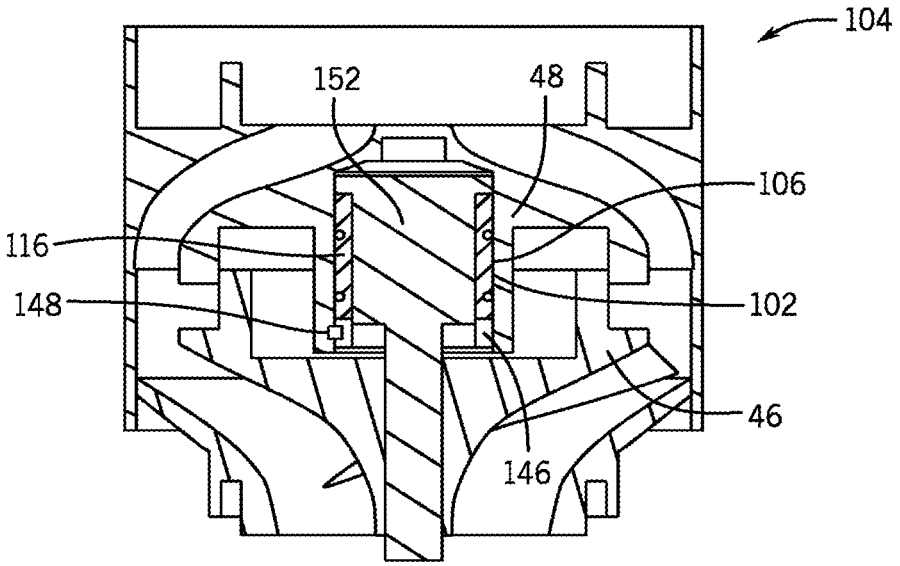
FIG. 15 is a cross-sectional view of another example of a radial/thrust bearing disposed between an adjacent impeller and diffuser of the integrated pump and motor stack of the electric submersible pumping system, in accordance with embodiments of the present disclosure.

FIG. 15 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 15 is substantially similar to the embodiment illustrated in FIG. 13. However, the embodiment illustrated in FIG. 15 includes a single (e.g., tungsten carbide, in certain embodiments) integrated component 152, which generally combines the features of the radial bearing sleeve 112, the thrust runner 114, and the shaft 80 (as well as the snap ring 130), and to which the impellers 46 of the integrated pump and motor stack 20 are mounted.

For the embodiment illustrated in FIG. 15, the assembly sequence may include inserting the integrated component 152 into the interior bore 106 of the diffuser 48, pushing the bushing 116 into the interior bore 106 of the diffuser 48 (e.g., radially between the diffuser 48 and the integrated component 152), press-fitting the up-thrust ring 146 into the interior bore 106 of the diffuser 48 and locking it in place (e.g., with the retaining (e.g., snap) ring 148 or dowel pins), mounting the impeller 46 on the shaft portion of the integrated component 152, and then using the snap rings 150 to lock the impeller 46 to the shaft portion of the integrated component 152 in order to transmit torque and thrust loads.

Figure 16:
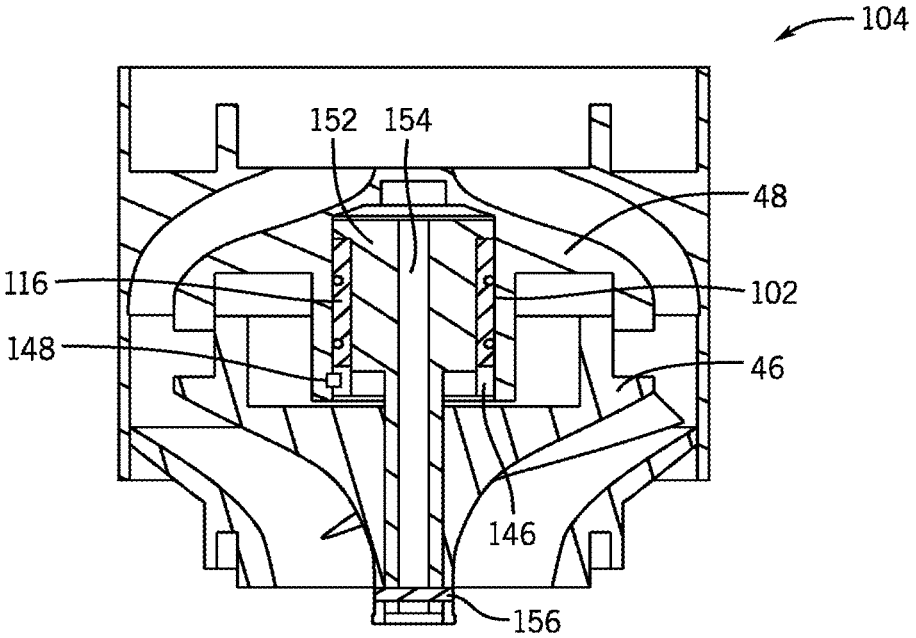
FIG. 16 is a cross-sectional view of another example of a radial/thrust bearing disposed between an adjacent impeller and diffuser of the integrated pump and motor stack of the electric submersible pumping system, in accordance with embodiments of the present disclosure.

FIG. 16 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 16 is substantially similar to the embodiment illustrated in FIG. 15. However, the integrated component 152 illustrated in FIG. 16 includes a hollow interior passage 154 that facilitates fluid flow through the integrated component 152. As also illustrated in FIG. 16, in certain embodiments, a pin 156 (e.g., instead of a snap ring 150) may be used to lock the impeller 46 to the integrated component 152.

Figure 17:
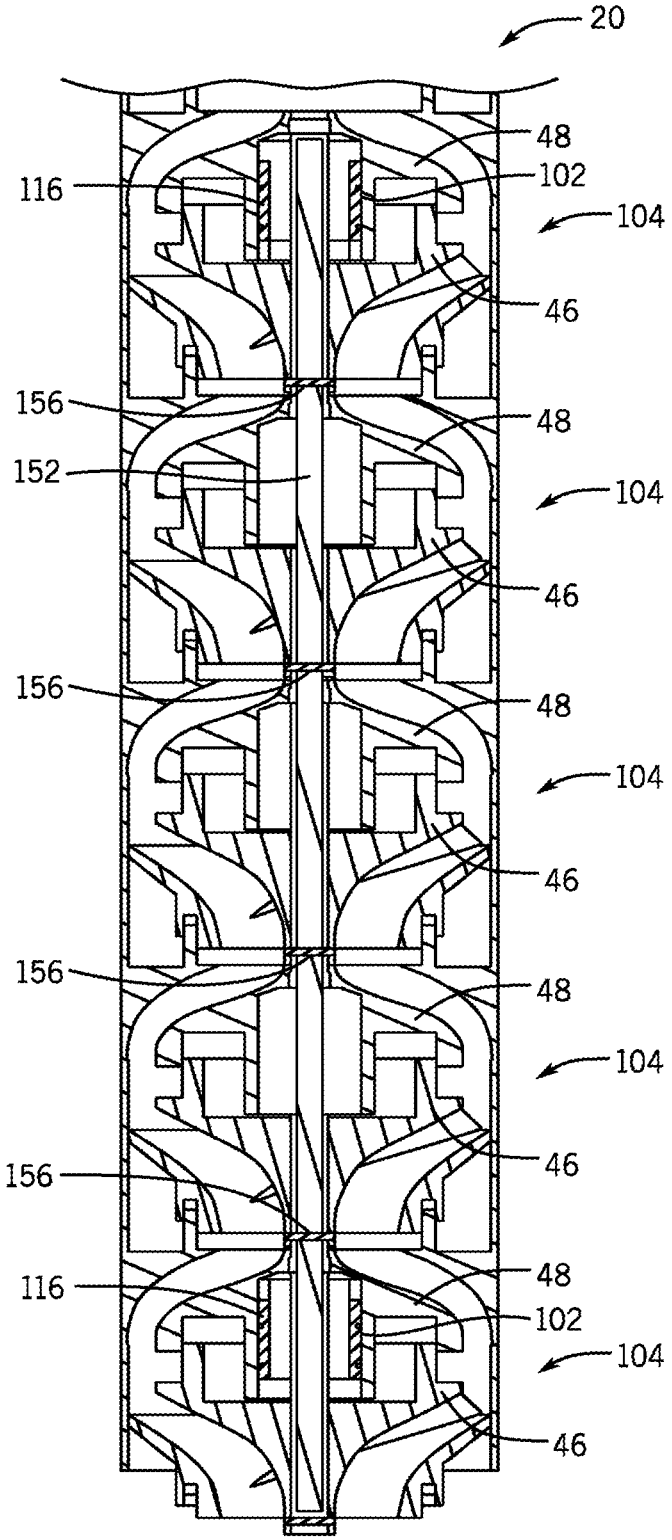
FIG. 17 is a cross-sectional view of the integrated pump and motor stack of the electric submersible pumping system, which uses the integrated component and bearing components of FIG. 16, in accordance with embodiments of the present disclosure.

FIG. 17 is a cross-sectional view of the integrated pump and motor stack 20 of the electric submersible pumping system 12, which uses the integrated component 152 and bearing components of FIG. 16 at top (e.g., most uphole) and bottom (e.g., most downhole) impeller/diffuser stages 104, in accordance with embodiments of the present disclosure. As illustrated, the shaft portion of the integrated component 152 passes through the hubs 108 of the impellers 46. The axial loads are transferred from the impellers 46 to the shaft portion of the integrated component 152 through the pins 156. In certain embodiments, the axial load may be carried by on the bottom (e.g., most downhole) impeller/diffuser stage 104. In certain embodiments, this may be achieved by having two different integrated components 152, one with a thrust runner shoulder, and another with just a radial bearing sleeve.

Figure 18:
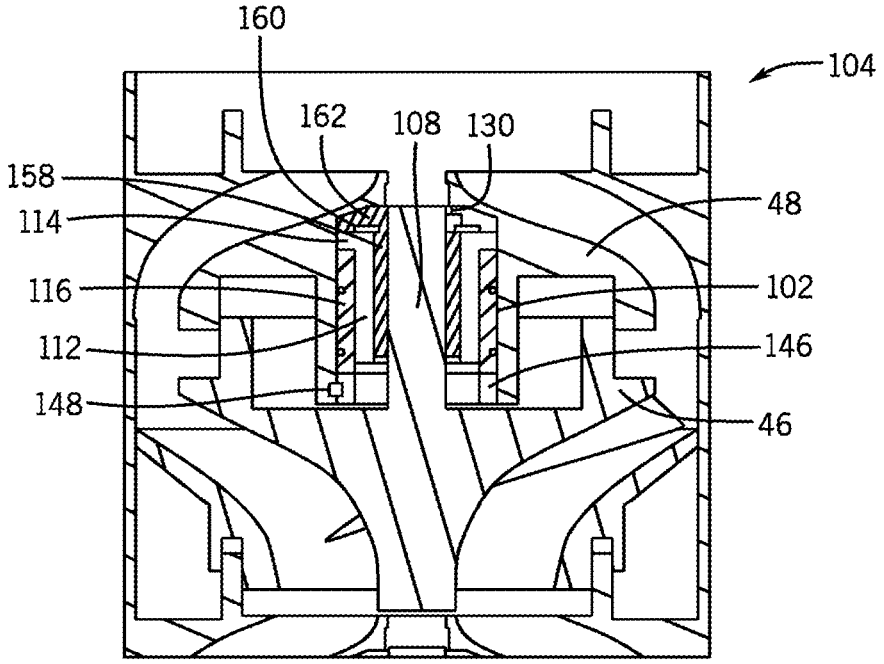
FIG. 18 is a cross-sectional view of another example of a radial/thrust bearing disposed between an adjacent impeller and diffuser of the integrated pump and motor stack of the electric submersible pumping system, in accordance with embodiments of the present disclosure.

FIG. 18 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 18 is substantially similar to the embodiment illustrated in FIG. 11. However, instead of using the metal piece 138, the embodiment illustrated in FIG. 18 includes a steel shaft 158 that physically interacts with the radial bearing sleeve 112 and the thrust runner 114. More specifically, the steel shaft 158 is generally annular shaped and is configured to fit radially within the radial bearing sleeve 112 and thrust runner 114, and to axially abut the snap ring 130. As illustrated in FIG. 18, in certain embodiments, another snap ring 160 may be used to prevent axial movement of the radial bearing sleeve 112 and the thrust runner 114. More specifically, as illustrated in FIG. 18, the snap ring 160 may be in the shape of a relatively thin annular ring that is configured to fit within an inward radially extending slot 162 within the steel shaft 158.

For the embodiment illustrated in FIG. 18, the assembly sequence may include mounting the thrust runner 114 and the radial bearing sleeve 112 onto the steel shaft 158, placing the snap ring 160 at the upper (e.g., most uphole) axial end of the steel shaft 158, inserting these components into the interior bore 106 of the diffuser 48, pushing the bushing 116 into the interior bore 106 of the diffuser 48 (e.g., radially between the diffuser 48 and the radial bearing sleeve 112), press-fitting the up-thrust ring 146 into the interior bore 106 of the diffuser 48 and locking it in place (e.g., with the retaining (e.g., snap) ring 148 or dowel pins), and mounting the impeller 46 into place and locking the steel shaft 158 by, for example, inserting the snap ring 130.

Figure 19:
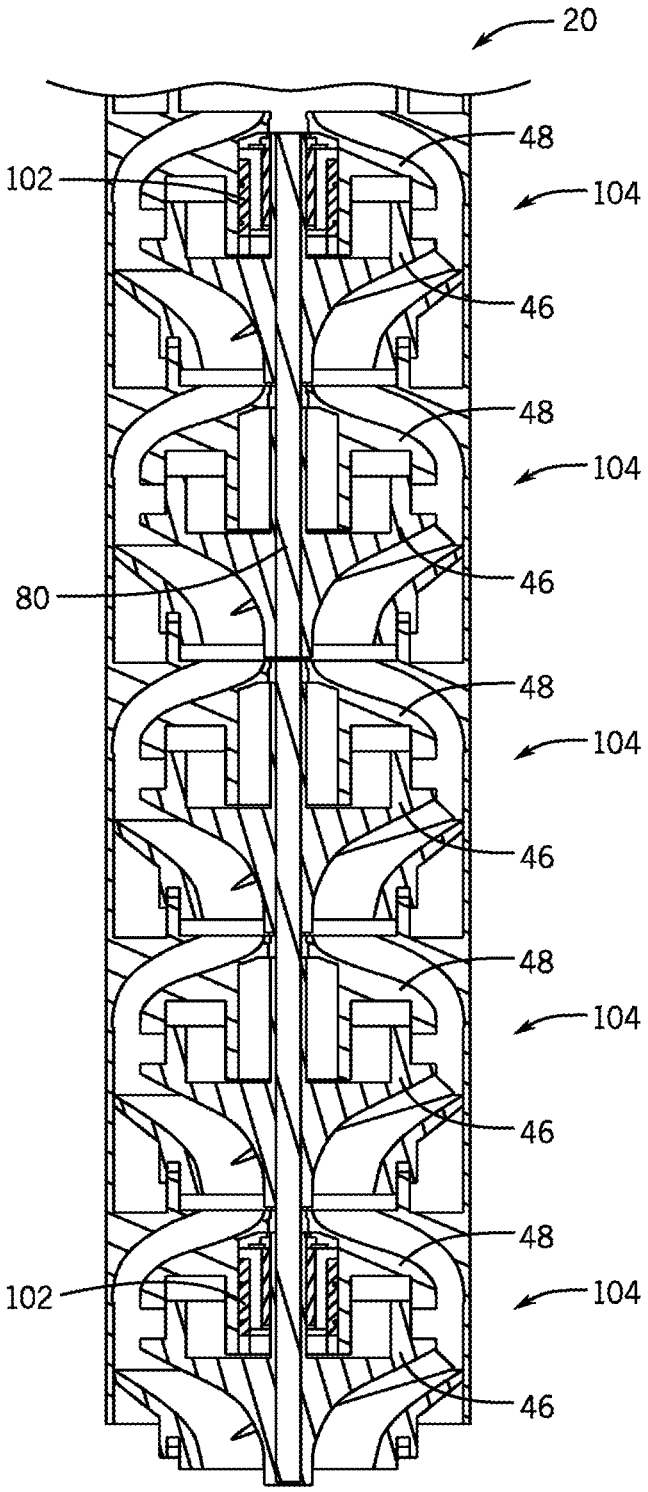
FIG. 19 is a cross-sectional view of the integrated pump and motor stack of the electric submersible pumping system, which uses radial/thrust bearings similar to those illustrated in FIG. 18 at top (e.g., most uphole) and bottom (e.g., most downhole) impeller/diffuser stages, in accordance with embodiments of the present disclosure.

FIG. 19 is a cross-sectional view of the integrated pump and motor stack 20 of the electric submersible pumping system 12, which uses radial/thrust bearings 102 similar to those illustrated in FIG. 18 at top (e.g., most uphole) and bottom (e.g., most downhole) impeller/diffuser stages 104, in accordance with embodiments of the present disclosure. As illustrated, the lower (e.g., most downhole) impeller/diffuser stage 104 and the upper (e.g., most uphole) impeller/diffuser stage 104 include the features illustrated in FIG. 18, and the shaft 80 physically connects the impellers 46 of these impeller/diffuser stages 104.

Figure 20:
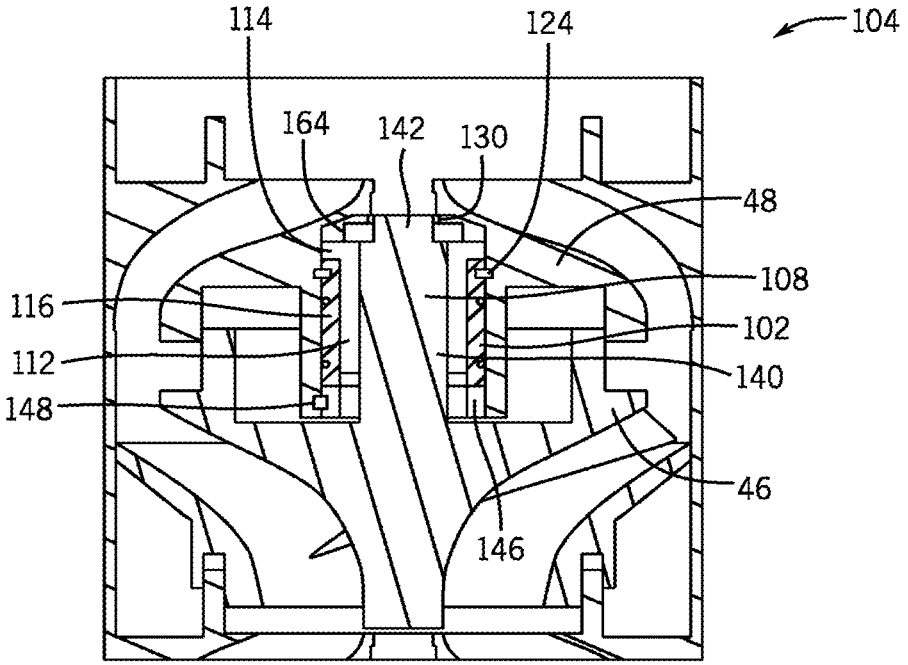
FIG. 20 is a cross-sectional view of another example of a radial/thrust bearing disposed between an adjacent impeller and diffuser of the integrated pump and motor stack of the electric submersible pumping system, in accordance with embodiments of the present disclosure.

FIG. 20 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 20 is somewhat similar to the embodiment illustrated in FIG. 18. However, instead of using a steel shaft 158 that fits radially within the radial bearing sleeve 112 and the thrust runner 114, the embodiment illustrated in FIG. 20 includes a short steel spacer 164, which is generally annular in shape, and is mounted on the impeller 46 (e.g., radially about a second cylindrical portion 142 of the hub 108 of the impeller 46 axially adjacent a transition from the second cylindrical portion 142 to a first cylindrical portion 140 of the hub 108, wherein the hub 108 is substantially similar to the hub 108 illustrated in FIGS. 10 and 11) to transfer the axial load from the impeller 46 to the thrust runner 114. Specifically, as illustrated in FIG. 20, the short steel spacer 164 includes an outer diameter that is at least slightly larger than an inner diameter of the thrust runner 114. As illustrated in FIG. 20, the short steel spacer 164 is held in place axially using the snap ring 130 on the hub 108 of the impeller 46. In addition, in certain embodiments, the short steel spacer 164 may include one or more keys configured to engage with the hub 108 of the impeller 46 to prevent rotation of the short steel spacer 164 relative to the impeller 46. In addition, in the embodiment illustrated in FIG. 20, the bushing 116 is prevented from moving axially with respect to the diffuser 48 by a retainer ring 124, as described herein.

For the embodiment illustrated in FIG. 20, the assembly sequence may include inserting the short steel spacer 164 into the interior bore 106 of the diffuser 48, inserting the thrust runner 114 and the radial bearing sleeve 112 into the interior bore 106 of the diffuser 48, pushing the bushing 116 into the interior bore 106 of the diffuser 48 (e.g., radially between the diffuser 48 and the radial bearing sleeve 112, with the retainer ring 124 restricting the axial movement past a certain point), press-fitting the up-thrust ring 146 into the interior bore 106 of the diffuser 48 and locking it in place (e.g., with the retaining (e.g., snap) ring 148 or dowel pins), and mounting the impeller 46 into place to lock the short steel spacer 164 axially.

Figure 21:
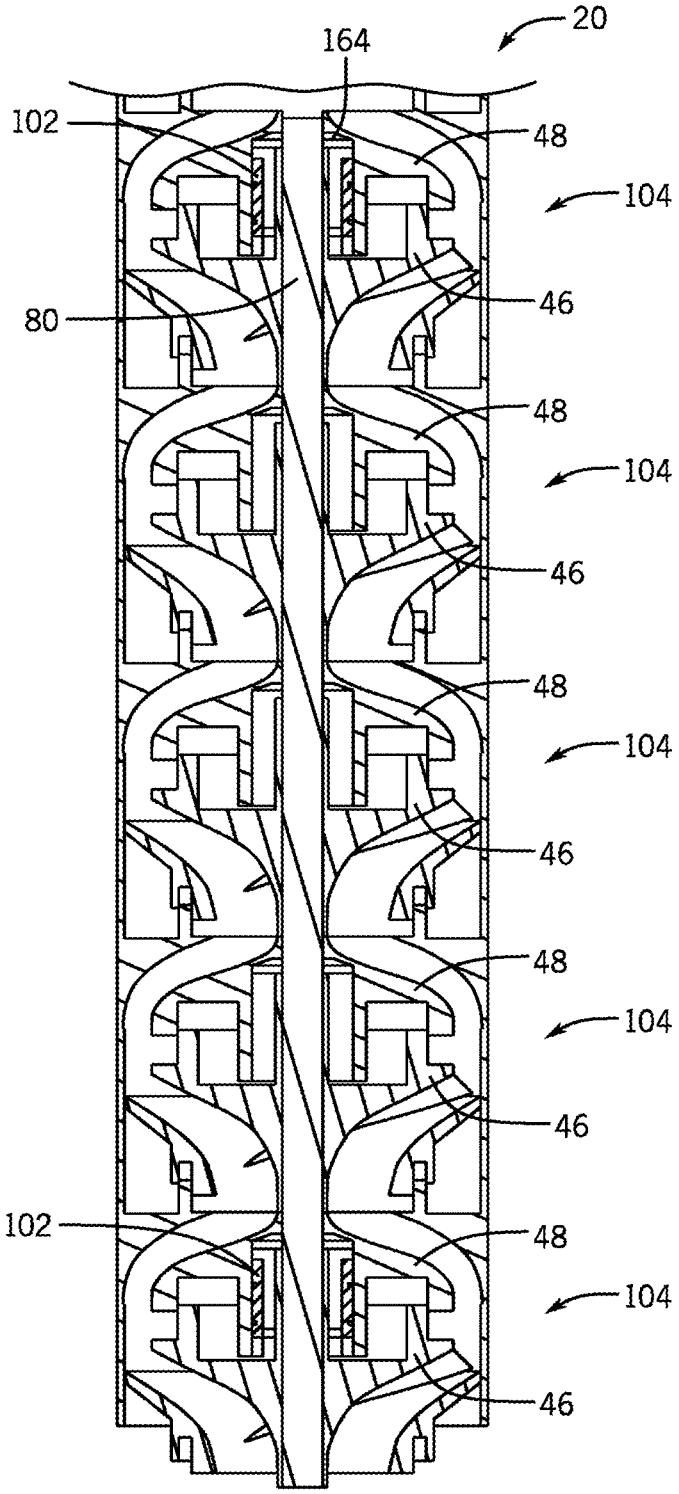
FIG. 21 is a cross-sectional view of the integrated pump and motor stack of the electric submersible pumping system, which uses radial/thrust bearings similar to those illustrated in FIG. 20 at top (e.g., most uphole) and bottom (e.g., most downhole) impeller/diffuser stages, in accordance with embodiments of the present disclosure.

FIG. 21 is a cross-sectional view of the integrated pump and motor stack 20 of the electric submersible pumping system 12, which uses radial/thrust bearings 102 similar to those illustrated in FIG. 20 at top (e.g., most uphole) and bottom (e.g., most downhole) impeller/diffuser stages 104, in accordance with embodiments of the present disclosure. As illustrated, the lower (e.g., most downhole) impeller/diffuser stage 104 and the upper (e.g., most uphole) impeller/diffuser stage 104 include the features illustrated in FIG. 20, and the shaft 80 physically connects the impellers 46 of these impeller/diffuser stages 104. In certain embodiments, the lower (e.g., most downhole) radial/thrust bearing 102 may be omitted, with only the upper (e.g., most uphole) thrust runner 114 used to carry the load at the top of the integrated pump and motor stack 20.

Figure 22:
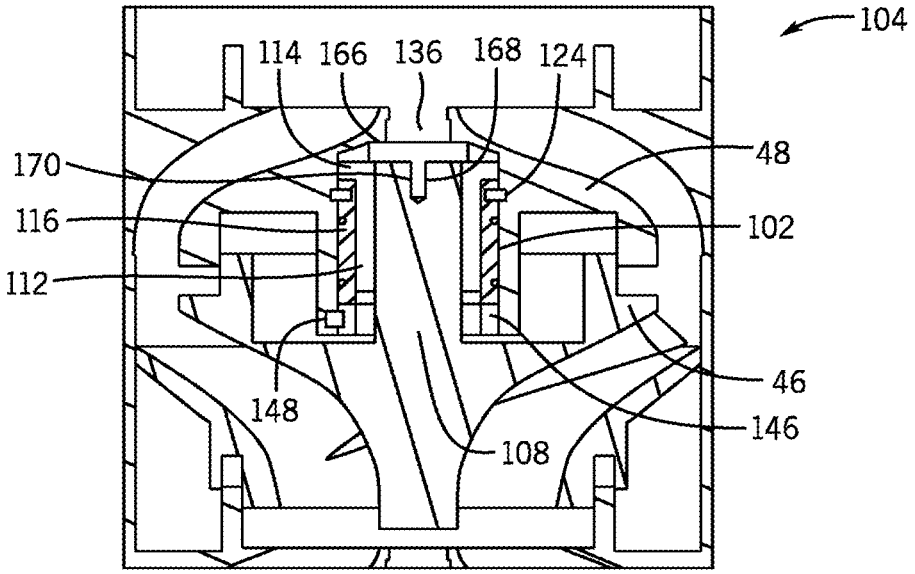
FIG. 22 is a cross-sectional view of another example of a radial/thrust bearing disposed between an adjacent impeller and diffuser of the integrated pump and motor stack of the electric submersible pumping system, in accordance with embodiments of the present disclosure.

FIG. 22 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 22 is somewhat similar to the embodiment illustrated in FIG. 20. However, instead of using a short steel spacer 164 and a snap ring 130 that are disposed radially about a second cylindrical portion 142 of the hub 108 of the impeller 46, the embodiment illustrated in FIG. 22 includes a steel spacer 166 that includes an integral screw 168 that is configured to engage with internal threading 170 within the hub 108 of the impeller 46. Similar to the short steel spacer 164 illustrated in FIG. 20, the steel spacer 166 illustrated in FIG. 22 is also configured to transfer the axial load from the impeller 46 to the thrust runner 114. Specifically, as illustrated in FIG. 22, the steel spacer 166 includes an outer diameter that is at least slightly larger than an inner diameter of the thrust runner 114. In certain embodiments, the steel spacer 166 includes a hex socket on an upper (e.g., most uphole) axial end of the steel spacer 166, which can be used to tighten the integral screw 168 into the hub 108 of the impeller 46 using a tool that passes through an open upper (e.g., uphole) axial end 136 of the interior bore 106 of the diffuser 48.

Figure 23:
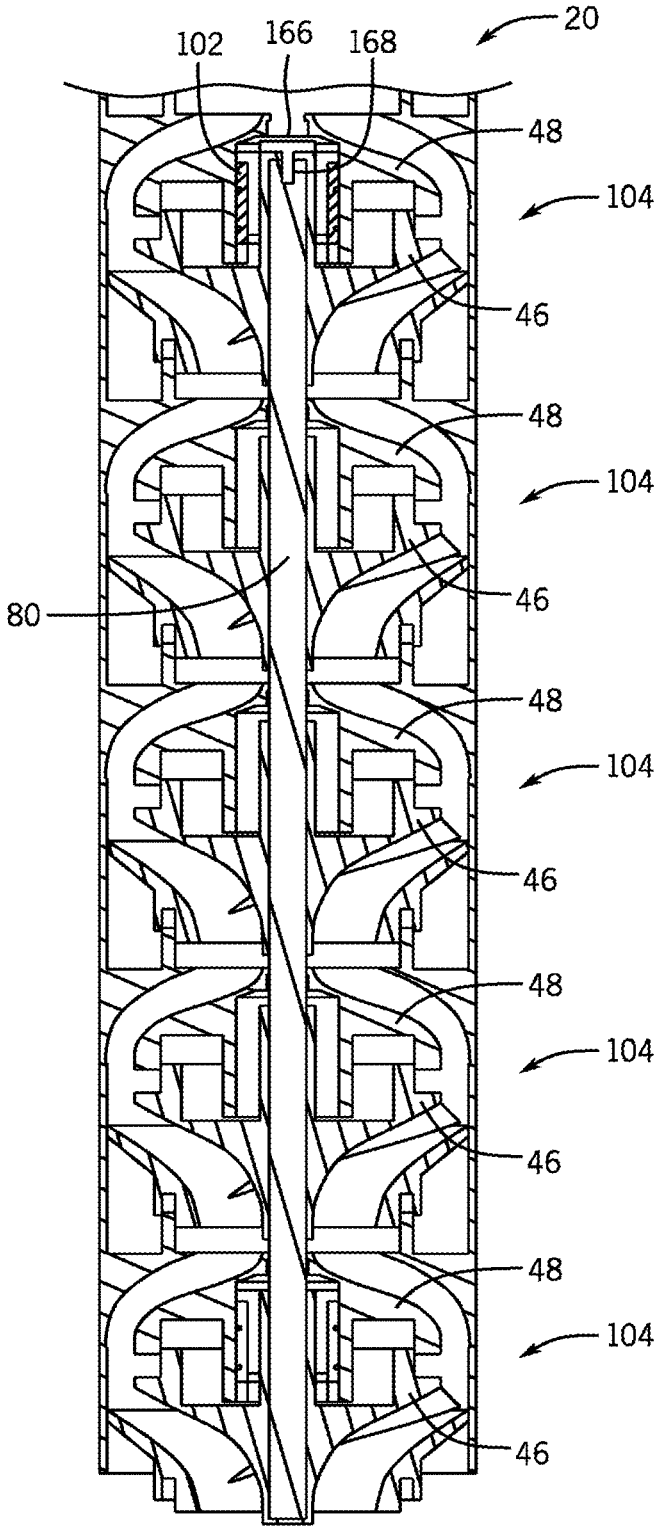
FIG. 23 is a cross-sectional view of the integrated pump and motor stack of the electric submersible pumping system, which uses radial/thrust bearings similar to those illustrated in FIG. 22 at top (e.g., most uphole) and bottom (e.g., most downhole) impeller/diffuser stages, in accordance with embodiments of the present disclosure.

FIG. 23 is a cross-sectional view of the integrated pump and motor stack 20 of the electric submersible pumping system 12, which uses radial/thrust bearings 102 similar to those illustrated in FIG. 22 at top (e.g., most uphole) and bottom (e.g., most downhole) impeller/diffuser stages 104, in accordance with embodiments of the present disclosure. As illustrated, the upper (e.g., most uphole) impeller/diffuser stage 104 includes the steel spacer 166 having integral screw 168 illustrated in FIG. 22, and the integral screw 168 of the steel spacer 166 mates with internal threading at an upper (e.g., uphole) axial end of the shaft 80, rather than the internal threading 170 of the hub 108 of the impeller 46 of the upper (e.g., most uphole) impeller/diffuser stage 104. In the illustrated embodiment, the down-thrust will be carried by the upper (e.g., most uphole) impeller/diffuser stage 104, and the shaft 80 will transmit the load from the lower impeller/diffuser stages 104 to the upper (e.g., most uphole) impeller/diffuser stage 104 (e.g., by its respective radial/thrust bearing 102).

Many of the embodiments presented herein include both the radial bearing components of the radial/thrust bearing 102 as well as the thrust bearing components of the radial/thrust bearing 102 disposed between the impeller 46 and the diffuser 48 of the respective impeller/diffuser stage 104. However, in other embodiments, the radial bearing components of the radial/thrust bearing 102 may be disposed in other places of the respective impeller/diffuser stage 104 from the thrust bearing components of the radial/thrust bearing 102. In other words, the radial bearing components of the radial/thrust bearing 102 may be physical separated from the thrust bearing components of the radial/thrust bearing 102.

Figure 24:
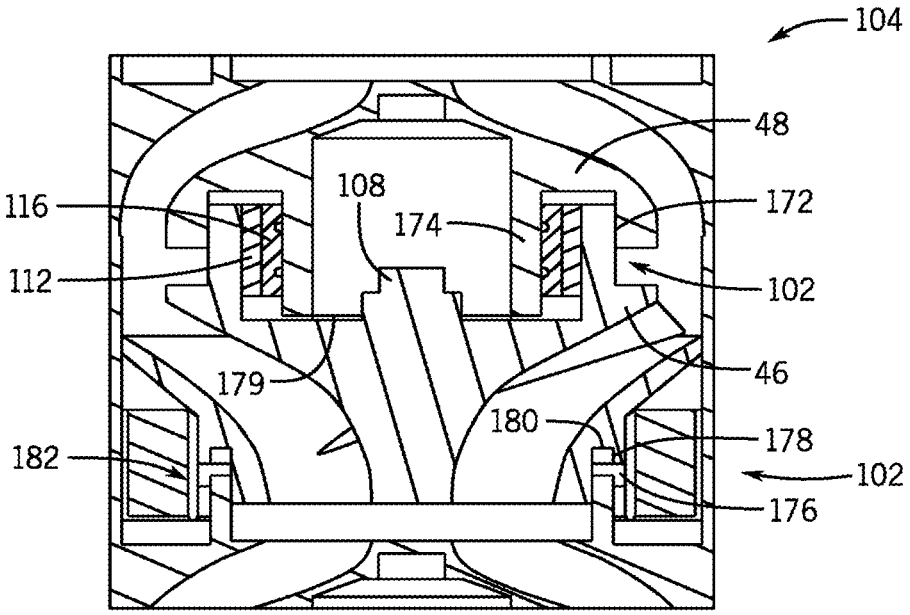
FIG. 24 is a cross-sectional view of an example of a radial/thrust bearing of the integrated pump and motor stack of the electric submersible pumping system, which has radial bearing components physically separated from thrust bearing components, in accordance with embodiments of the present disclosure.

For example, FIG. 24 is a cross-sectional view of an example of a radial/thrust bearing 102 of the integrated pump and motor stack 20 of the electric submersible pumping system 12, which has radial bearing components physically separated from thrust bearing components, in accordance with embodiments of the present disclosure. In the embodiment illustrated in FIG. 24, an inner stationary bushing 116 is radially disposed between an interior bore 172 of the impeller 46 and a hub 174 of the diffuser 48, and is prevented from rotating using an up-thrust ring (not shown) or using a key on an inner diameter of the bushing 116. In addition, in certain embodiments, an outer rotating sleeve that is keyed to the interior bore 172 of the impeller 46 may be axially retained using a snap-ring (not shown). In the embodiment illustrated in FIG. 24, down-thrust is carried by down-thrust pad 176 (stationary on the diffuser 48) and down-thrust pad 178 (rotating with the impeller 46) (e.g., both tungsten carbide pads) placed adjacent both a (stationary) diffuser 48 and a (rotating) impeller 46 of an immediately downhole impeller/diffuser stage 104. In certain embodiments, keys are used on an inner diameter of the down-thrust pads 176, 178 to prevent relative rotation between the down-thrust pads 176, 178 and the adjacent impeller/diffuser stages 104, respectively. In the embodiment illustrated in FIG. 24, up-thrust is carried by an up-thrust (e.g., phenolic) pad 179 disposed in a hub 108 of the impeller 46.

Figure 25:
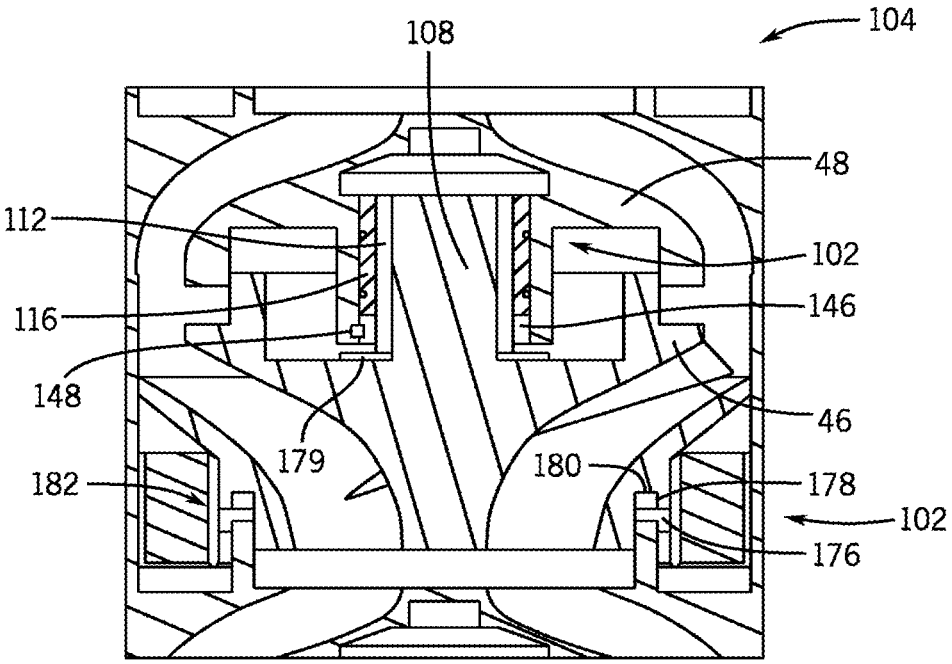
FIG. 25 is a cross-sectional view of another example of a radial/thrust bearing of the integrated pump and motor stack of the electric submersible pumping system, which has radial bearing components physically separated from thrust bearing components, in accordance with embodiments of the present disclosure.

FIG. 25 is a cross-sectional view of another example of a radial/thrust bearing 102 of the integrated pump and motor stack 20 of the electric submersible pumping system 12, which has radial bearing components physically separated from thrust bearing components, in accordance with embodiments of the present disclosure. The embodiment illustrated in FIG. 25 has thrust bearing components (e.g., the down-thrust pads 176, 178 and the up-thrust pad 179) that are substantially similar to those illustrated in FIG. 24. However, in the embodiment illustrated in FIG. 25, the radial bearing components include a radial bearing sleeve 112 and bushing 116 that are substantially similar to conventional radial bearing components.

Figure 26:
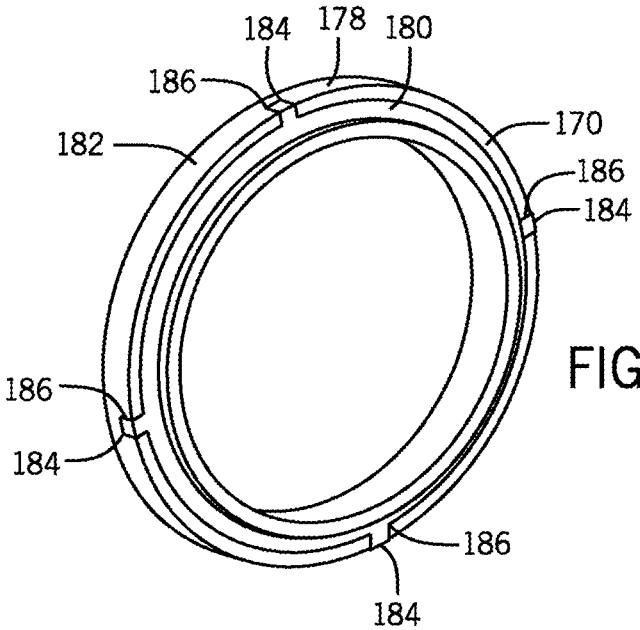
FIGS. 26 and 27 are perspective views of examples of front seal portions of the impeller and the diffuser illustrated in FIGS. 24 and 25, in accordance with embodiments of the present disclosure.
Figure 27:
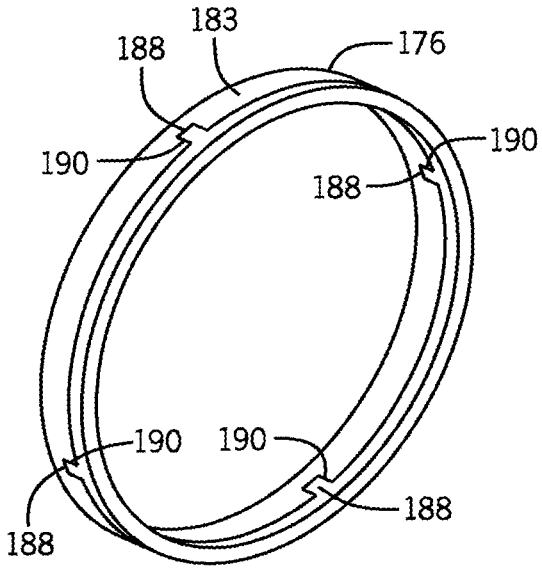
Figure 28:
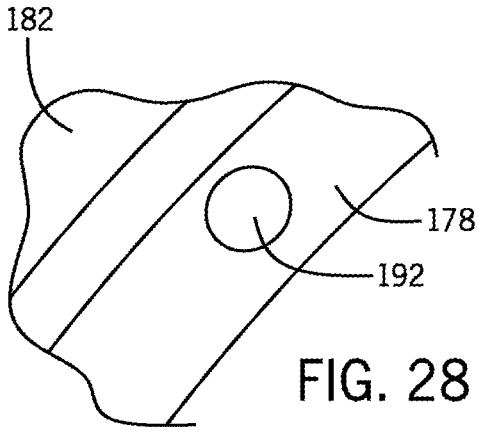
FIG. 28 is a partial perspective view of an example of the front seal portion of the impeller having a dowel pin that holds the up-thrust pad in place relative to the front seal portion, in accordance with embodiments of the present disclosure.

FIGS. 26 and 27 are perspective views of examples of the front seal portion 182 of the impeller 46 and the diffuser 48 illustrated in FIGS. 24 and 25, in accordance with embodiments of the present disclosure. In particular, FIG. 26 illustrates a front seal portion 182 of the impeller 46 that includes the circular groove 180 within which a circular down-thrust pad 178 may be disposed. In this embodiment, the down-thrust pad 178 includes a plurality of lugs 184 that extend radially outward from the down-thrust pad 178, and are configured to fit within mating grooves 186 that extend radially outward through the front seal portion 182 of the impeller 46 from the circular groove 180. In contrast, FIG. 27 illustrates a front seal portion 183 of the diffuser 48 that is configured to mate with a down-thrust pad 176 that includes a plurality of lugs 188 that extend axially from the down-thrust pad 176, and are configured to fit within mating slots 190 that extend axially into the front seal portion 183 of the diffuser 48. Alternately, in certain embodiments, dowel pins 192 may be used to prevent the down-thrust pads 176, 178 from rotating relative to the diffuser 48 and the impeller 46. For example, FIG. 28 is a partial perspective view of an example of the front seal portion 182 of the diffuser 48 having a dowel pin 192 that holds the down-thrust pad 178 in place relative to the front seal portion 182, in accordance with embodiments of the present disclosure. It should be noted that the embodiments of the front seal portions 182, 183 holding the down-thrust pads 178, 176 in place may also be similarly used to hold the up-thrust ring 146 in place relative to the impeller 46, in certain embodiments.

Figure 29:
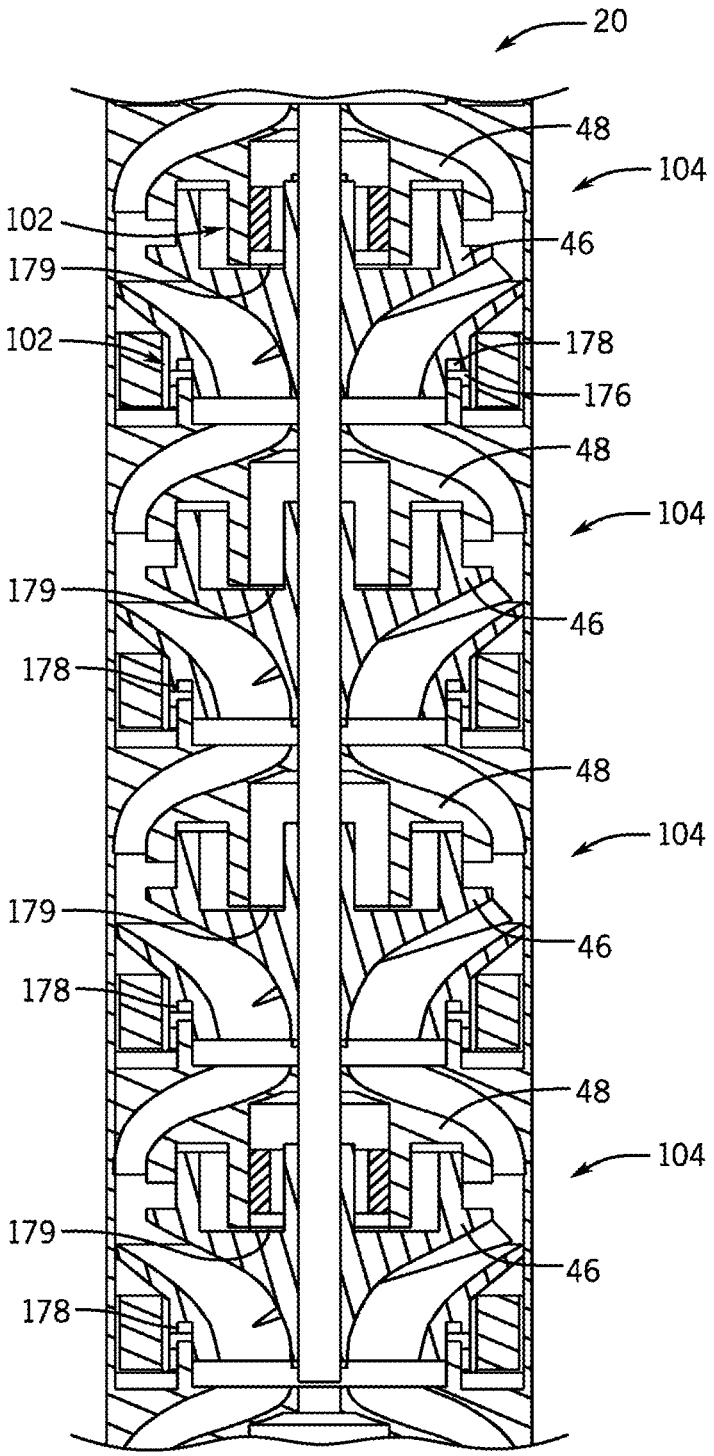
FIG. 29 is a cross-sectional view of the integrated pump and motor stack of the electric submersible pumping system, which uses radial/thrust bearings similar to those illustrated in FIGS. 24-28 at top (e.g., most uphole) and bottom (e.g., most downhole) impeller/diffuser stages, in accordance with embodiments of the present disclosure.

FIG. 29 is a cross-sectional view of the integrated pump and motor stack 20 of the electric submersible pumping system 12, which uses radial/thrust bearings 102 similar to those illustrated in FIGS. 24-28 at top (e.g., most uphole) and bottom (e.g., most downhole) impeller/diffuser stages 104, in accordance with embodiments of the present disclosure. As illustrated, the upper (e.g., most uphole) impeller/diffuser stage 104 includes the down-thrust pads 176, 178, and the down-thrust of all of the impeller/diffuser stages 104 is carried by down-thrust pad 176. Conversely, the up-thrust is carried individually by each impeller/diffuser stage 104 using its respective up-thrust pad 179.

Figure 30:
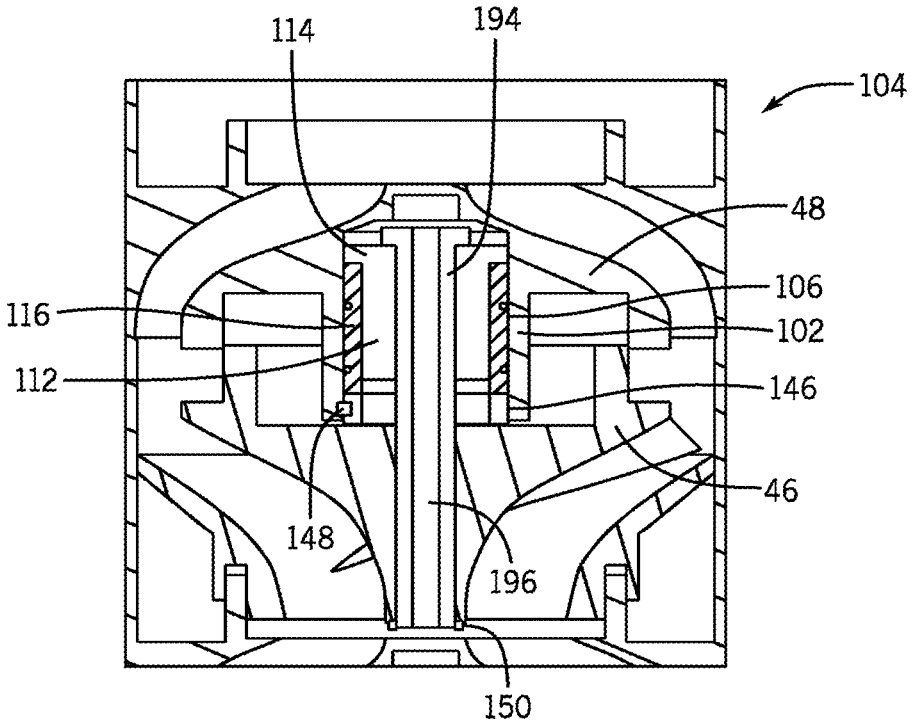
FIG. 30 is a cross-sectional view of another example of a radial/thrust bearing disposed between an adjacent impeller and diffuser of the integrated pump and motor stack of the electric submersible pumping system, in accordance with embodiments of the present disclosure.

FIG. 30 is a cross-sectional view of another example of a radial/thrust bearing 102 disposed between an adjacent impeller 46 and diffuser 48 of the integrated pump and motor stack 20 of the electric submersible pumping system 12, in accordance with embodiments of the present disclosure. The embodiment illustrated in FIG. 30 is substantially similar to the embodiment illustrated in FIG. 16. However, instead of using an integrated component 152 that has an interior passage 154 and that partially functions as a radial bearing sleeve 112 and a thrust runner 114, the embodiment illustrated in FIG. 30 includes a steel shaft 194 having an interior passage 196 that facilitates fluid flow through the steel shaft 194, wherein the steel shaft 194 is configured to support a separate radial bearing sleeve 112, and to transfer torque and thrust load from impeller 46 using a separate thrust runner 114. As such, this embodiment utilizes the steel shaft 194 to mount the radial bearing sleeve 112, thrust runner 114, and impeller 46.

For the embodiment illustrated in FIG. 30, the assembly sequence may include inserting the steel shaft 194, the radial bearing sleeve 112, and the thrust runner 114 into the interior bore 106 of the diffuser 48, pushing the bushing 116 into the interior bore 106 of the diffuser 48, press-fitting the up-thrust ring 146 into the interior bore 106 of the diffuser 48 and locking it in place (e.g., with the retaining (e.g., snap) ring 148 or dowel pins), and mounting the impeller 46 onto the steel shaft 194, and locking the steel shaft 194 in place axially, for example, using a snap ring 150 of key.

Figure 31:
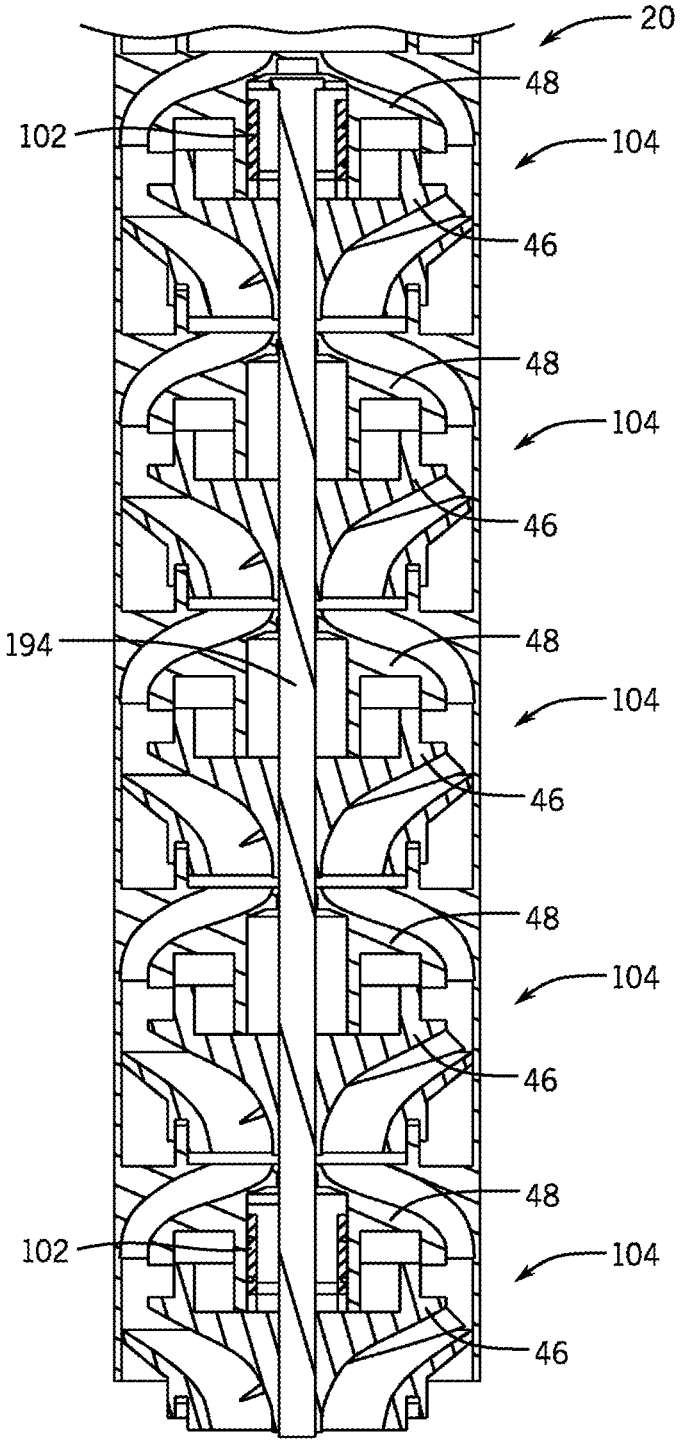
FIG. 31 is a cross-sectional view of the integrated pump and motor stack of the electric submersible pumping system, which uses the integrated component and bearing components of FIG. 30 at top (e.g., most uphole) and bottom (e.g., most downhole) impeller/diffuser stages, in accordance with embodiments of the present disclosure.

FIG. 31 is a cross-sectional view of the integrated pump and motor stack 20 of the electric submersible pumping system 12, which uses the steel shaft 194 and bearing components of FIG. 30 at top (e.g., most uphole) and bottom (e.g., most downhole) impeller/diffuser stages 104, in accordance with embodiments of the present disclosure. As illustrated, in certain embodiments, snap rings 150 may be used on the steel shaft 194 to, for example, secure the thrust runner 114 at the bottom (e.g., most downhole) impeller/diffuser stage 104. As also illustrated, in certain embodiments, the radial bearing sleeve 112 may be located on the top (e.g., most uphole) and bottom (e.g., most downhole) impeller/diffuser stages 104. In certain embodiments, the thrust runner 114 may only be mounted on the bottom (e.g., most downhole) impeller/diffuser stage 104 so that the axial load of all of the impeller/diffuser stages 104 is carried by the bottom (e.g., most downhole) impeller/diffuser stage 104.

Figure 32:
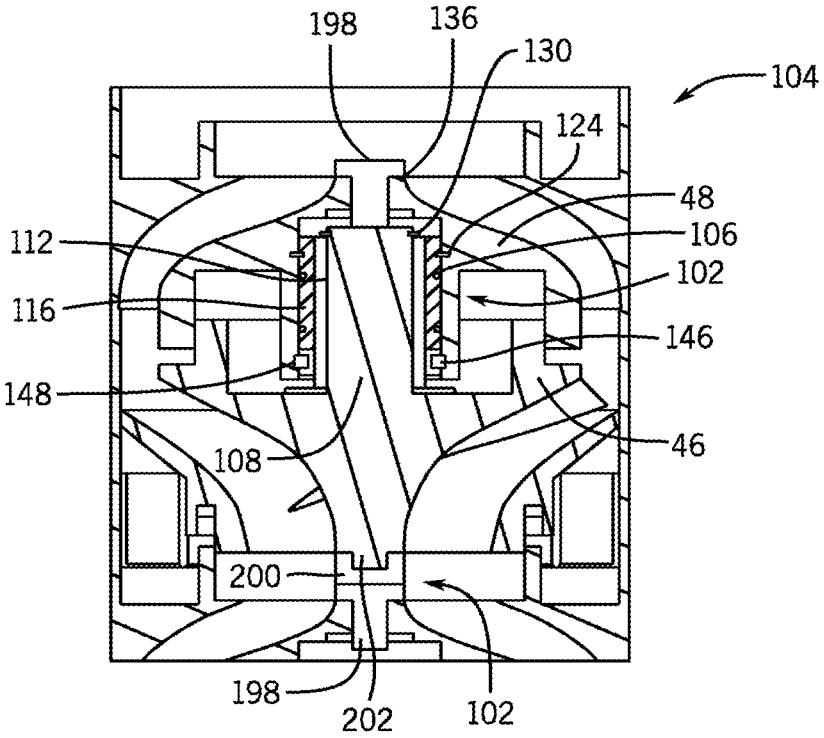
FIG. 32 is a cross-sectional view of another example of a radial/thrust bearing of the integrated pump and motor stack of the electric submersible pumping system, which has radial bearing components physically separated from thrust bearing components, in accordance with embodiments of the present disclosure.

FIG. 32 is a cross-sectional view of another example of a radial/thrust bearing 102 of the integrated pump and motor stack 20 of the electric submersible pumping system 12, which has radial bearing components physically separated from thrust bearing components, in accordance with embodiments of the present disclosure. In the embodiment illustrated in FIG. 32, the radial bearing components (e.g., the radial bearing sleeve 112, bushing 116, retainer ring 124, snap ring 130, up-thrust ring 146, retaining (e.g., snap) ring 148, and so forth) are substantially similar to other embodiments described herein (e.g., disposed between the impeller 46 and mating diffuser 48 of an impeller/diffuser stage 104). However, the thrust bearing components are disposed axially between adjacent impellers 46 and diffusers 48. Specifically, as illustrated in FIG. 32, a generally t-shaped annular thrust bushing 198 is mounted within an open upper (e.g., uphole) axial end 136 of the interior bore 106 of the diffuser 48, and a generally u-shaped thrust runner 200 is mounted onto the impeller 46, for example, radially about a short stem 202 at a downhole axial end of the impeller 46. The thrust bushing 198 and thrust runner 200 are configured to carry the down-thrust load. In certain embodiments, rotation of the thrust bushing 198 is prevented using an up-thrust ring, which is held axially in place with a snap ring, as described with respect to other embodiments presented herein. In addition, in certain embodiments, up-thrust loads are carried using a washer.

Figure 33:
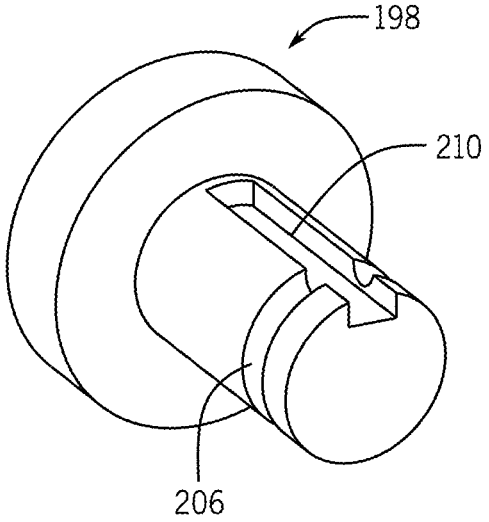
FIGS. 33, 34, and 35 are partial perspective cutaway views of a thrust bushing, an open upper (e.g., uphole) axial end of an interior bore of the diffuser, and the thrust bushing installed within the upper (e.g., uphole) axial end of the interior bore of the diffuser, respectively, in accordance with embodiments of the present disclosure.
Figure 34:
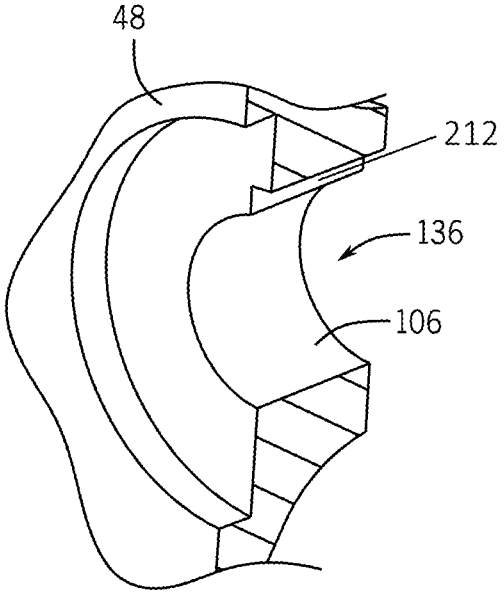
Figure 35:
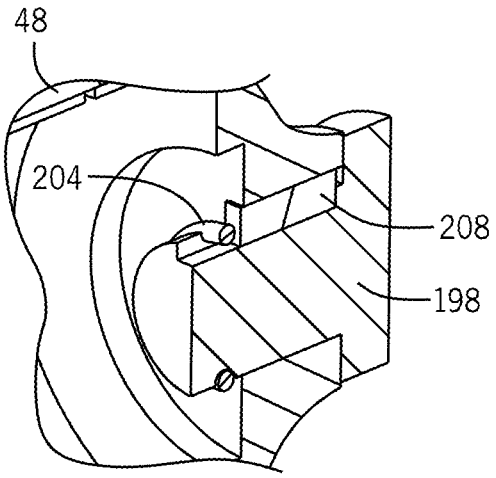

In general, during installation, the thrust bushing 198 is pushed into the interior bore 106 of the diffuser 48, and locked axially in place with a snap ring 204 from the other side. FIGS. 33, 34, and 35 are partial perspective cutaway views of the thrust bushing 198, an open upper (e.g., uphole) axial end 136 of the interior bore 106 of the diffuser 48, and the thrust bushing 198 installed within the upper (e.g., uphole) axial end 136 of the interior bore 106 of the diffuser 48, respectively, in accordance with embodiments of the present disclosure. As illustrated, in certain embodiments, the snap ring 204 fits within a circular groove 206 that extends circumferentially around the thrust bushing 198. In addition, in certain embodiments, a key 208 may fit within a groove 210 that extends axially along the outer surface of the thrust bushing 198, as well as within a similar groove 212 that extends axially along the upper (e.g., uphole) axial end 136 of the interior bore 106 of the diffuser 48, to prevent rotation of the thrust bushing 198 with respect to the diffuser 48.

Figure 36:
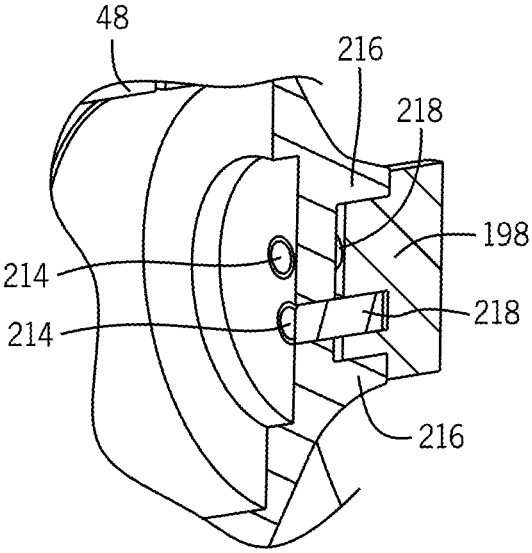
FIG. 36 is a partial perspective cutaway view of the thrust bushing installed adjacent a closed upper (e.g., uphole) axial end of the interior bore of the diffuser, in accordance with embodiments of the present disclosure.

In other embodiments, rotation of the thrust bushing 198 may be prevented using a plurality of (e.g., Inconel) pins 214 configured to be axially inserted into holes 216 through a closed upper (e.g., uphole) axial end 136 of the interior bore 106 of the diffuser 48, as well as mating holes 218 that extend axially into the thrust bushing 198. FIG. 36 is a partial perspective cutaway view of the thrust bushing 198 installed adjacent a closed upper (e.g., uphole) axial end 136 of the interior bore 106 of the diffuser 48, in accordance with embodiments of the present disclosure. In general, during installation, the pins 214 are pressed into the diffuser holes 216 first, then the thrust bushing 198 is assembled on top of the pins 214.

Figure 37:
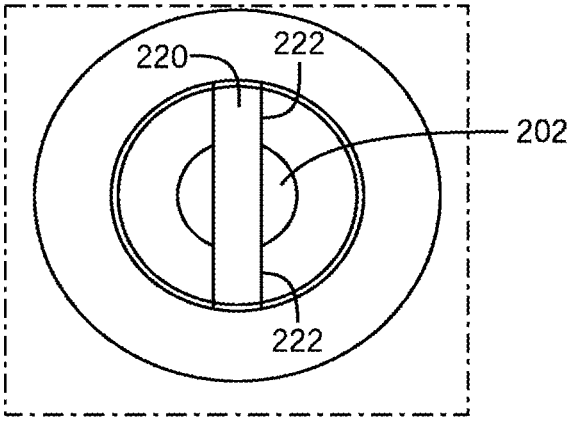
FIGS. 37, 38, and 39 are an axial end view, a side view, and a perspective view, respectively, of the thrust runner installed on a downhole axial end of the impeller, respectively, in accordance with embodiments of the present disclosure.
Figure 38:
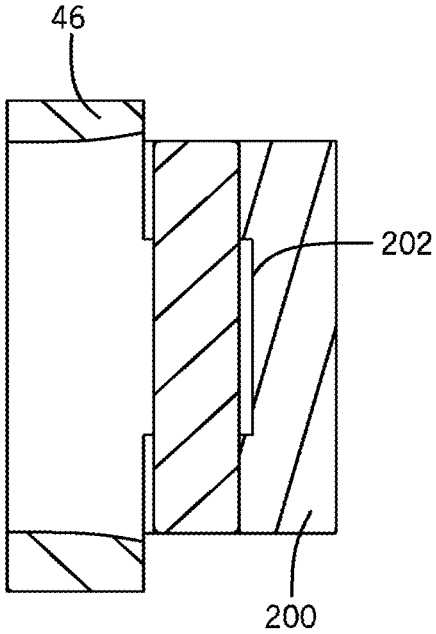
Figure 39:
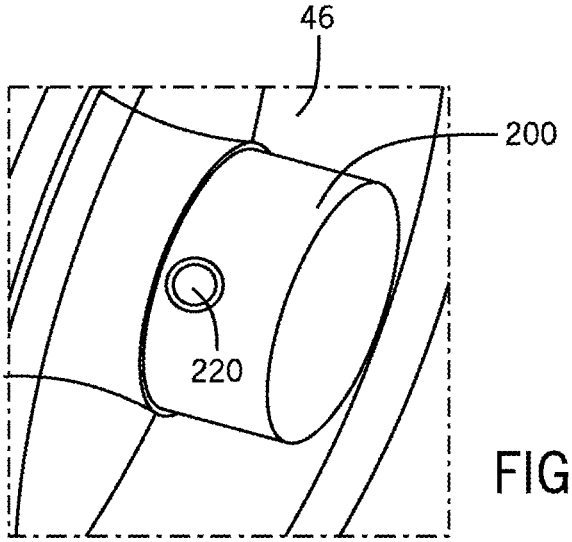

FIGS. 37, 38, and 39 are an axial end view, a side view, and a perspective view, respectively, of the thrust runner 200 installed on a downhole axial end of the impeller 46, respectively, in accordance with embodiments of the present disclosure. As illustrated, in certain embodiments, a pin 220 may be radially inserted into holes 222 that radially extend through opposite walls of the thrust runner 200, as well as through a mating hole that radially extends through the short stem 202 at the downhole axial end of the impeller 46.

Figure 40:
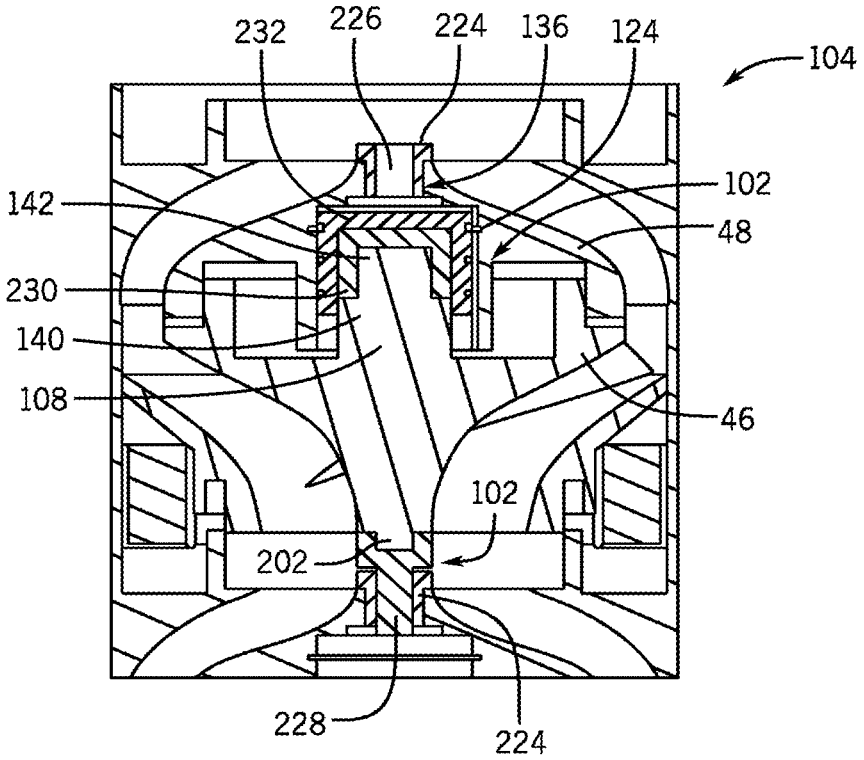
FIG. 40 is a cross-sectional view of another example of a radial/thrust bearing of the integrated pump and motor stack of the electric submersible pumping system, which includes a plurality of radial/thrust components, in accordance with embodiments of the present disclosure.

FIG. 40 is a cross-sectional view of another example of a radial/thrust bearing 102 of the integrated pump and motor stack 20 of the electric submersible pumping system 12, which includes a plurality of radial/thrust components, in accordance with embodiments of the present disclosure. Specifically, the radial/thrust bearing 102 illustrated in FIG. 40 includes a radial/down-thrust bushing 224, which is annular in shape and is substantially similar to the thrust bushing 198 with the exception that the radial/down-thrust bushing 224 includes a hollow interior passage 226, which facilitates interaction with other components through an open upper (e.g., uphole) axial end 136 of the interior bore 106 of the diffuser 48. In addition, as illustrated in FIG. 40, the radial/thrust bearing 102 includes a y-shaped radial/down-thrust sleeve 228 configured to at least partially fit radially within a radial/down-thrust bushing 224 of an immediately downhole impeller/diffuser stage 104, and to surround the short stem 202 of the impeller 46. In addition, as illustrated in FIG. 40, the radial/thrust bearing 102 includes a u-shaped radial/up-thrust sleeve 230, which surrounds a second cylindrical portion 142 of the hub 108 of the impeller 46, and a u-shaped radial/up-thrust bushing 232 that surrounds the u-shaped radial/up-thrust sleeve 230.

As such, in the embodiment illustrated in FIG. 40, the impeller 46 is supported radially at both axial ends. The larger diameter radial/down-thrust bushing 224 at the top (e.g., most uphole) axial end of the impeller 46 carries a large portion of the radial load and the up-thrust load. The smaller diameter radial/down-thrust sleeve 228 at the bottom (e.g., most downhole) axial end of the impeller 46 carries the down-thrust load as well as a small portion of the radial load. This support at both axial ends of the impeller provides, among other things, relatively more stability. In general, the components of the radial/thrust bearing 102 of FIG. 40 may be assembled together similarly to those illustrated in FIG. 32. In certain embodiments, the radial/down-thrust sleeve 228 may be configured to engage with an adjacent radial/up-thrust bushing 232 as well as the radial/down-thrust bushing 224, thereby increasing the axial load capacity.

Figure 41:
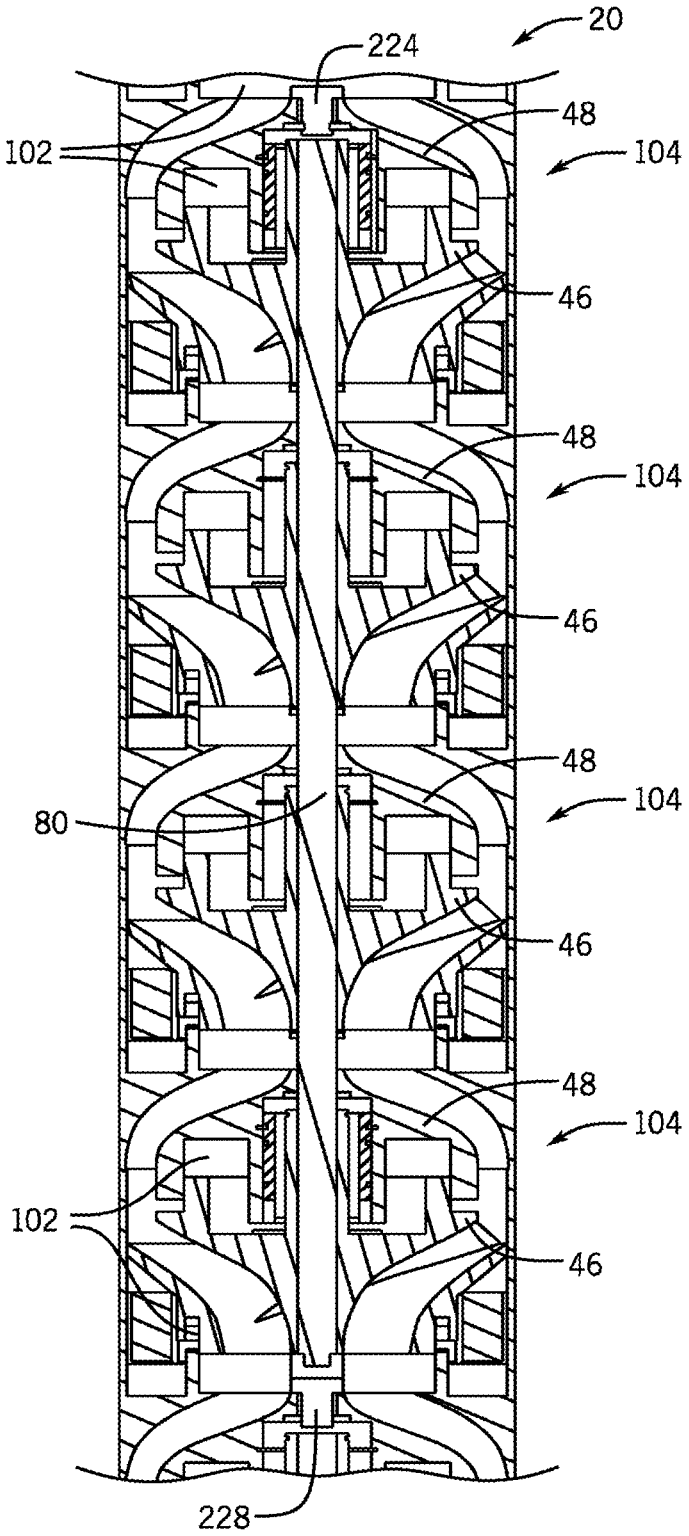
FIG. 41 is a cross-sectional view of the integrated pump and motor stack of the electric submersible pumping system, which uses radial/thrust bearings similar to those illustrated in FIG. 40 at top (e.g., most uphole) and bottom (e.g., most downhole) impeller/diffuser stages, in accordance with embodiments of the present disclosure.

FIG. 41 is a cross-sectional view of the integrated pump and motor stack 20 of the electric submersible pumping system 12, which uses radial/thrust bearings 102 similar to those illustrated in FIG. 40 at top (e.g., most uphole) and bottom (e.g., most downhole) impeller/diffuser stages 104, in accordance with embodiments of the present disclosure. It should be noted that the embodiment illustrated in FIG. 32 may also be configured similarly to the embodiment of FIG. 40, which is illustrated in FIG. 41. In both instances, the down-thrust is carried by the bottom (e.g., most downhole) impeller/diffuser stage 104, whereas the up-thrust is carried by each of the impeller/diffuser stages 104. In certain embodiments, a ceramic runner may be mounted on the shaft 80 at the top (e.g., most uphole) impeller 46 to engage with the bottom of the radial/down-thrust bushing 224 so that the up-thrust is also carried by the ceramic-bearing pair.

Figure 42:
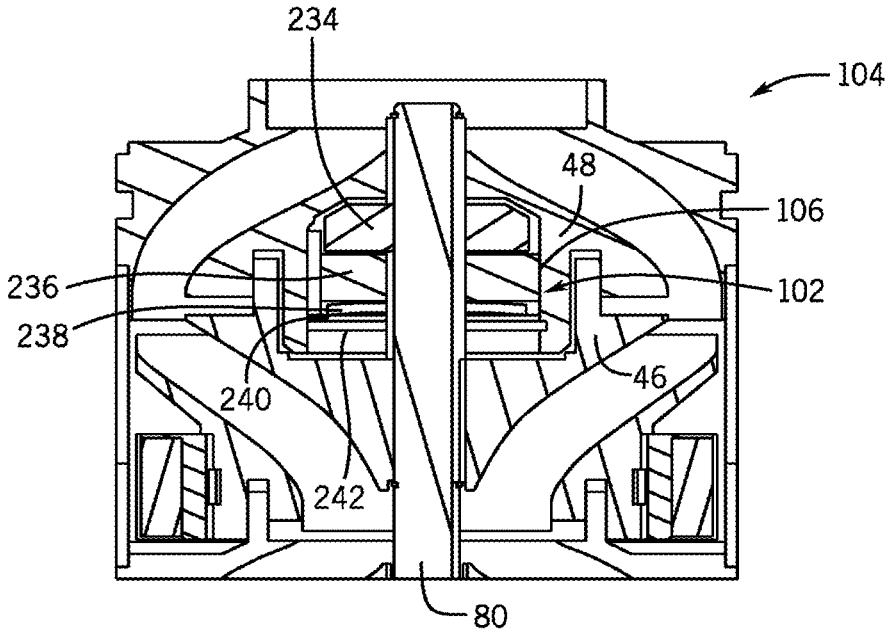
FIG. 42 is a cross-sectional view of another example of a radial/thrust bearing of the integrated pump and motor stack of the electric submersible pumping system, which includes a plurality of radial/thrust components, in accordance with embodiments of the present disclosure.

FIG. 42 is a cross-sectional view of another example of a radial/thrust bearing 102 of the integrated pump and motor stack 20 of the electric submersible pumping system 12, which includes a plurality of radial/thrust components, in accordance with embodiments of the present disclosure. Specifically, the radial/thrust bearing 102 illustrated in FIG. 42 includes an annular shaped down-thrust runner 234 configured to axially abut an annular shaped down-thrust bushing 236 (e.g., thrust pad) radially between the interior bore 106 of the diffuser 48 and a shaft 80. In addition, in certain embodiments, a spring washer 238 may be disposed on an axial side of the down-thrust bushing 236 opposite the down-thrust runner 234 to preload (e.g., bias) the down-thrust bushing 236 against the down-thrust runner 234. In addition, in certain embodiments, a metal washer 240 may be disposed axially adjacent the spring washer 238 to transfer the load from the spring washer 238 to a snap ring 242. In this embodiment, the impeller/diffuser stages 104 are supported in the radial direction at either axial end of the integrated pump and motor stack 20 using ceramic bearings (not shown) as described in greater detail herein, whereas the axial load is carried by a separate thrust bearing (e.g., near a middle impeller/diffuser stage 104, in certain embodiments).

Figure 43:
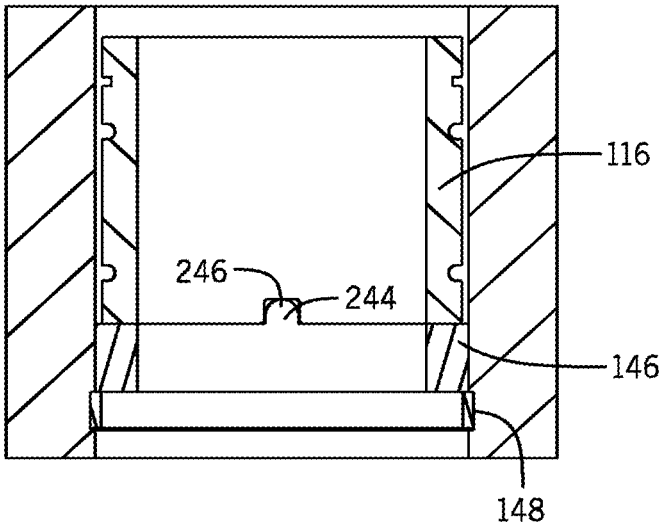
FIG. 43 is a cross-sectional view of an up-thrust ring and associated retaining (e.g., snap) ring, in accordance with embodiments of the present disclosure.

Many of the embodiments described herein prevent bushing rotation using an up-thrust ring assembly (e.g., such as the up-thrust ring 146 and associated retaining (e.g., snap) ring 148). In general, an up-thrust ring 146 is configured to transmit an axial load from a bushing (e.g., bushing 116) to a diffuser 48, for example, using a retaining (e.g., snap) ring 148. FIG. 43 is a cross-sectional view of an up-thrust ring 146 and associated retaining (e.g., snap) ring 148, in accordance with embodiments of the present disclosure. In the illustrated embodiment, the up-thrust ring 146 includes at least one lug 244 that extends axially from the up-thrust ring 146 and is configured to fit within at least one mating groove 246 that extends axially into the bushing 116. In certain embodiments, the up-thrust ring 146 may be press fit inside the interior bore 106 of the diffuser 48, and the retaining (e.g., snap) ring 148 may then be used to lock the up-thrust ring 146 axially and to transmit the force to the diffuser 48.

Many of the embodiments described herein include the thrust bearing components and the radial bearing components of a radial/thrust bearing 102 being disposed within a common impeller/diffuser stage 104. However, in other embodiments, thrust bearing components and radial bearing components for an integrated pump and motor stack 20 of the electric submersible pumping system 12 may be disposed within separate impeller/diffuser stages 104. For example, FIG. 44 is a cross-sectional view of an example of a separate thrust bearing 248 of the integrated pump and motor stack 20 of the electric submersible pumping system 12, and FIG. 45 is a cross-sectional view of an example of a separate radial bearing 250 (e.g., journal bearing) of the integrated pump and motor stack 20 of the electric submersible pumping system 12, in accordance with embodiments of the present disclosure.

Figure 44:
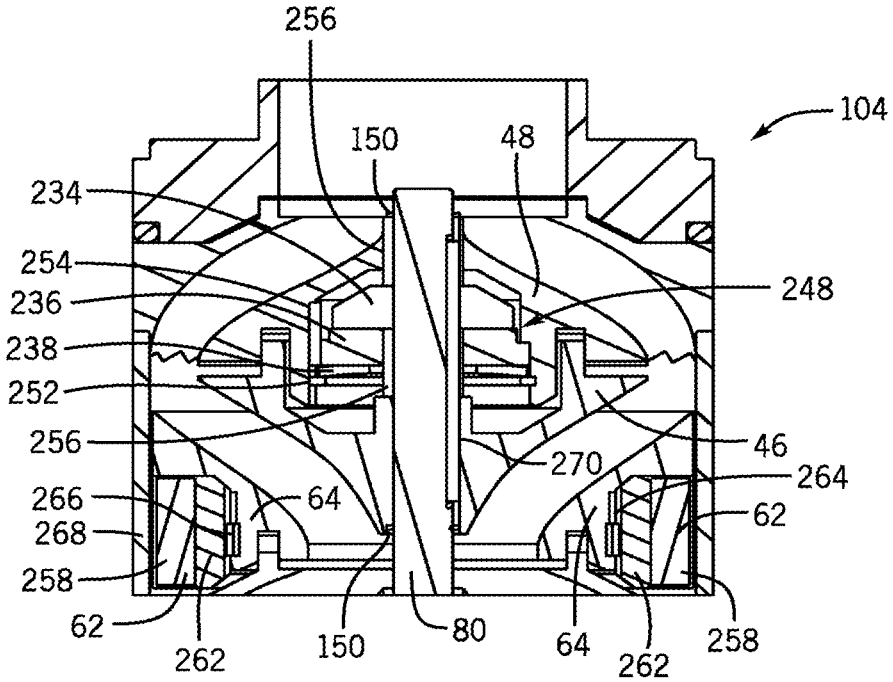
FIG. 44 is a cross-sectional view of an example of a separate thrust bearing of the integrated pump and motor stack of the electric submersible pumping system, in accordance with embodiments of the present disclosure.

The embodiment of the thrust bearing 248 illustrated in FIG. 44 is substantially similar to the embodiment illustrated in FIG. 42. Specifically, as illustrated, in certain embodiments, the thrust bearing 248 includes an annular shaped down-thrust runner 234 configured to axially abut an annular shaped down-thrust bushing 236 (e.g., thrust pad) radially between the interior bore 106 of the diffuser 48 and a shaft 80. In addition, in certain embodiments, a spring washer 238 may be disposed on an axial side of the down-thrust bushing 236 opposite the down-thrust runner 234 to preload (e.g., bias) the down-thrust bushing 236 axially against the down-thrust runner 234. In addition, in certain embodiments, a retaining ring 252 may be used to hold the down-thrust runner 234, the down-thrust bushing 236, and the spring washer 238 axially in place between the diffuser 48 and the impeller 46 of the impeller/diffuser stage 104. In addition, in certain embodiments, an anti-rotation key 254 may be radially disposed between the interior bore 106 of the diffuser 48 and the down-thrust bushing 236 to prevent rotation of the down-thrust bushing 236 relative to the diffuser 48. In addition, in certain embodiments, a shaft spacer 256 may be configured to space the diffuser 48 from the shaft 80.

Figure 45:
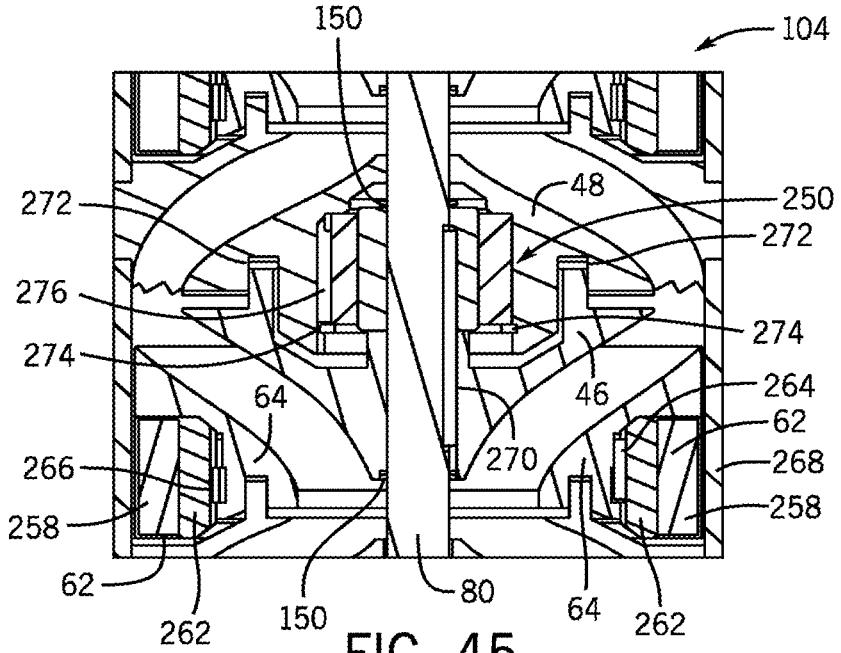
FIG. 45 is a cross-sectional view of an example of a separate radial bearing of the integrated pump and motor stack of the electric submersible pumping system, in accordance with embodiments of the present disclosure.

In addition, as illustrated in FIGS. 44 and 45, in certain embodiments, each impeller 46 may have an associated magnetic rotor 258 disposed radially about the body 64 of the impeller 46 near a downhole axial end of the impeller 46. In certain embodiments, the magnetic rotor 258 includes an annular yoke 262 configured to abut the body 64 of the impeller 46, and an annular permanent magnet 62 disposed radially about the annular yoke 262. In certain embodiments, at least one key 264 (e.g., anti-rotation mechanism) may be radially disposed between the annular yoke 262 and the body 64 of the impeller 46 to prevent rotation of the annular yoke 262 relative to the body 64 of the impeller 46. In addition, in certain embodiments, at least one retaining ring 266 may be disposed within at least one internal groove to prevent axial movement of the annular yoke 262 relative to the body 64 of the impeller 46. In addition, in certain embodiments, a diffuser spacer 268 may be configured to space the various diffusers 48 between the impeller/diffuser stages 104. In addition, in certain embodiments, each impeller/diffuser stage 104 may include a shaft key 270 disposed between the shaft 80 and the impeller 46 to lock rotation relative to the shaft 80 and the impeller 46. In addition, in certain embodiments, each impeller/diffuser stage 104 may include at least one shaft retainer (e.g., snap) ring 150 to hold the impeller 46 axially in place with respect to the shaft 80 (e.g., directly couple the impeller 46 to the shaft 80).

As illustrated in FIG. 45, in certain embodiments, the radial bearing 250 is configured to be disposed radially between the interior bore 106 of the diffuser 48 and the shaft 80. In addition, in certain embodiments, an up-thrust washer 272 may be configured to axially fit between the impeller 46 and the diffuser 48. In addition, in certain embodiments, a retaining ring 274 may be used to hold the radial bearing 250 axially in place between the diffuser 48 and the impeller 46 of the impeller/diffuser stage 104. In addition, in certain embodiments, an anti-rotation key 276 (e.g., anti-rotation mechanism) may be radially disposed between the interior bore 106 of the diffuser 48 and the radial bearing 250 to prevent rotation of the radial bearing 250 relative to the diffuser 48.

Figure 46:
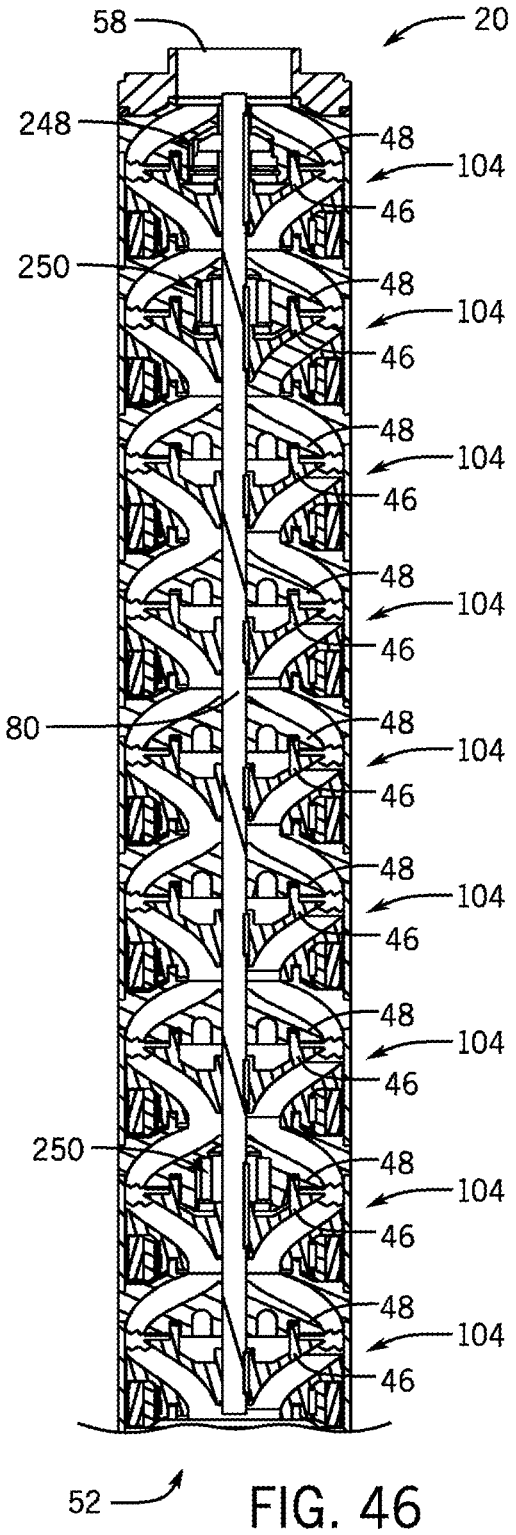
FIG. 46 is a cross-sectional view of the integrated pump and motor stack of the electric submersible pumping system, which uses a thrust bearing as illustrated in FIG. 44 and two radial bearings as illustrated in FIG. 45, in accordance with embodiments of the present disclosure.

As illustrated in FIGS. 44 and 45, both the thrust bearing 248 and the radial bearing 250 are disposed in their own (e.g., different) impeller/diffuser stages 104. For example, FIG. 46 is a cross-sectional view of the integrated pump and motor stack 20 of the electric submersible pumping system 12, which uses a thrust bearing 248 as illustrated in FIG. 44 and two radial bearings 250 as illustrated in FIG. 45, in accordance with embodiments of the present disclosure. Specifically, as illustrated in FIG. 46, in certain embodiments, the thrust bearing 248 may be disposed in an uppermost (e.g., most uphole) impeller/diffuser stage 104 (e.g., the impeller/diffuser stage 104 that is closest to the discharge head 58), whereas a first radial bearing 250 may be disposed in a second uppermost (e.g., second most uphole) impeller/diffuser stage 104 (e.g., the impeller/diffuser stage 104 that is second closest to the discharge head 58) and a second radial bearing 250 may be disposed in a second lowermost (e.g., second most downhole) impeller/diffuser stage 104 (e.g., the impeller/diffuser stage 104 that is second closest to the fluid intake 52). It will be appreciated that for embodiments of the integrated pump and motor stack 20 having only a single impeller/diffuser stage 104, the terms uppermost (e.g., most uphole) and lowermost (e.g., most downhole) may refer to the single impeller/diffuser stage 104.

Figure 47:
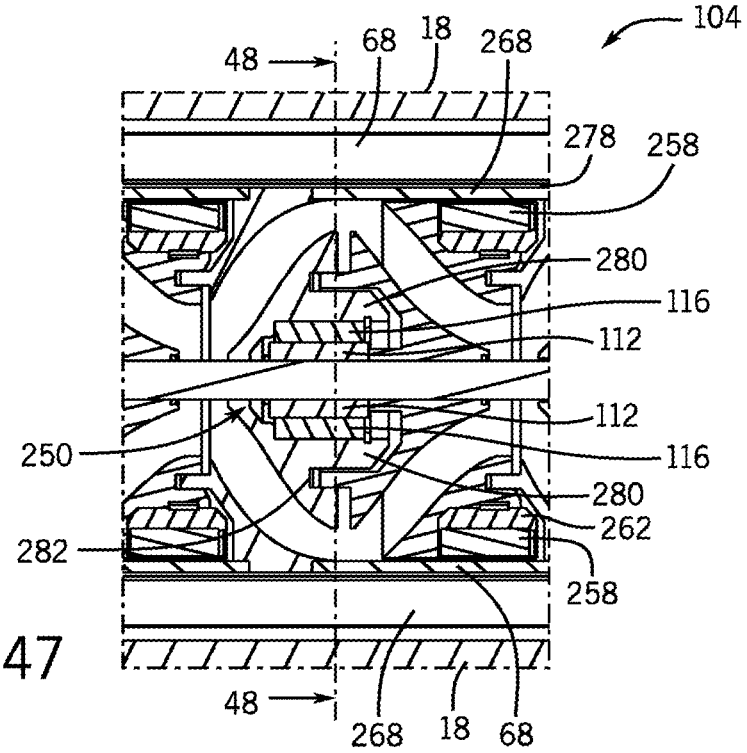
FIG. 47 is another cross-sectional view of the separate radial bearing of FIG. 45, in accordance with embodiments of the present disclosure.
Figure 48:
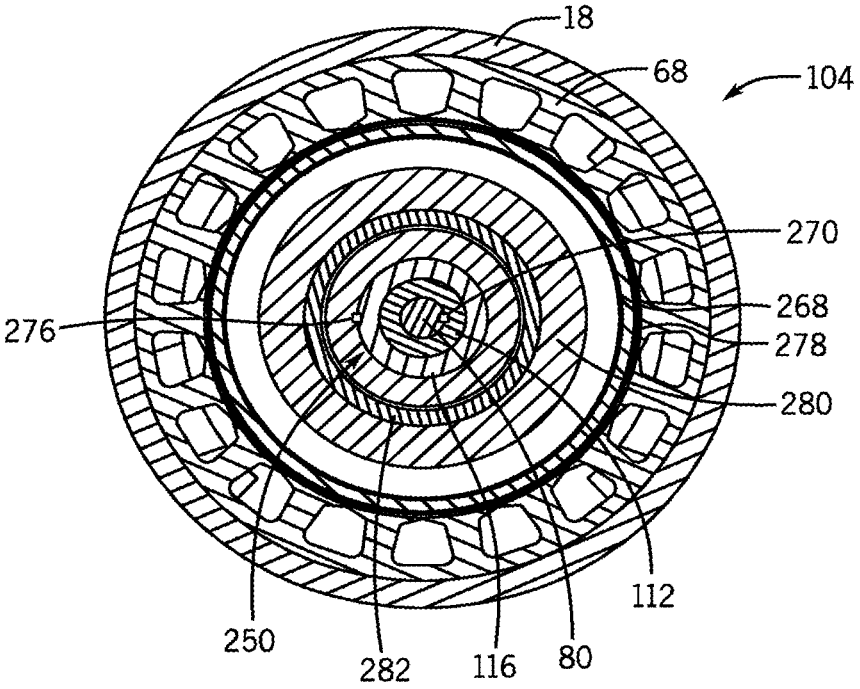
FIG. 48 is a cross-sectional view of the impeller/diffuser stage illustrated in FIG. 47, as taken along line 48-48, in accordance with embodiments of the present disclosure.

FIG. 47 is another cross-sectional view of the separate radial bearing 250 of FIG. 45, in accordance with embodiments of the present disclosure. In addition, FIG. 48 is a cross-sectional view of the impeller/diffuser stage 104 illustrated in FIG. 47, as taken along line 48-48, in accordance with embodiments of the present disclosure. As illustrated, in certain embodiments, the radial bearing 250 includes a radial bearing sleeve 112 that directly abuts and radially surrounds the shaft 80, and which is keyed to the shaft 80 via a shaft key 270 (e.g., anti-rotation mechanism) to lock rotation relative to the shaft 80 and the radial bearing sleeve 112. In addition, in certain embodiments, the radial bearing 250 includes a bushing 116 that directly abuts and radially surrounds the radial bearing sleeve 112. In addition, in certain embodiments, an anti-rotation key 276 may prevent rotation of the radial bearing 250 relative to the diffuser 48.

As also illustrated, a can 278 radially surrounds the impeller/diffuser stage 104 and separates the stator laminations 68 from the impeller/diffuser stage 104. In addition, in certain embodiments, a diffuser hub 280 (e.g., that includes the interior bore 106 described herein) radially surrounds the radial bearing 250. In addition, in certain embodiments, a balance ring 282 may be disposed between the diffuser 48 and the impeller 46 of the impeller/diffuser stage 104.

Figure 49:
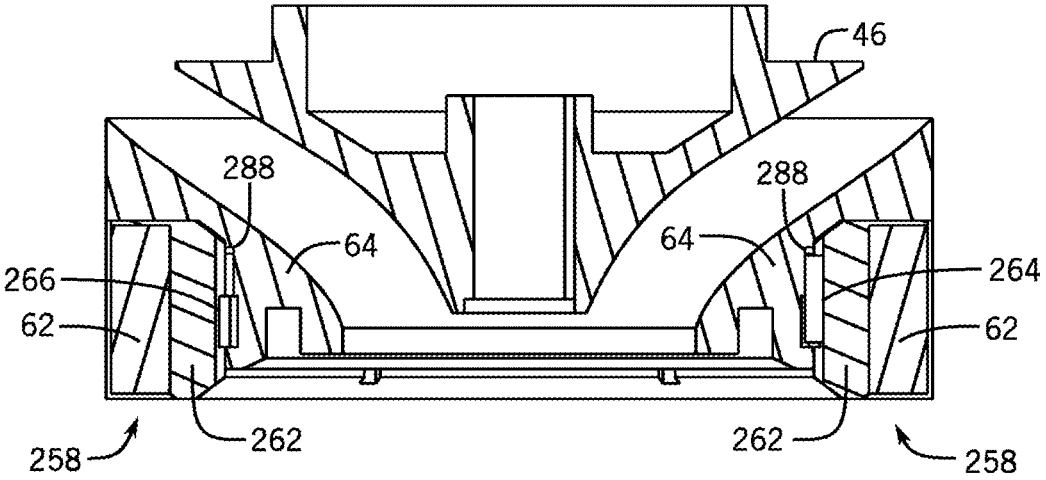
FIG. 49 is a cross-sectional view of the impeller of FIGS. 44, 45, and 47, in accordance with embodiments of the present disclosure.
Figure 50:
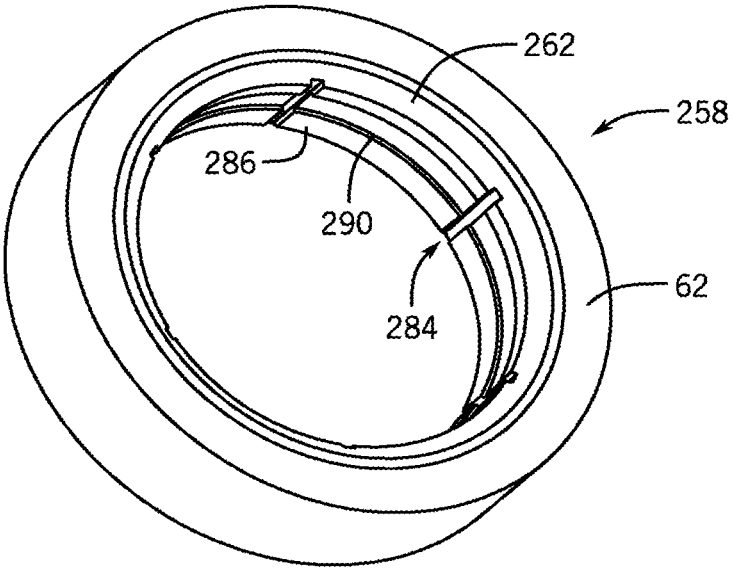
FIG. 50 is a perspective view of a magnetic rotor associated with the impeller of FIGS. 44, 45, and 47, in accordance with embodiments of the present disclosure.

FIG. 49 is a cross-sectional view of the impeller 46 of FIGS. 44, 45, and 47, in accordance with embodiments of the present disclosure. In addition, FIG. 50 is a perspective view of the magnetic rotor 258 associated with the impeller 46 of FIGS. 44, 45, and 47, in accordance with embodiments of the present disclosure. As described in greater detail herein, the magnetic rotor 258 includes an annular yoke 262 configured to abut the body 64 of the impeller 46, and an annular permanent magnet 62 disposed radially about the annular yoke 262. In certain embodiments, at least one key 264 (e.g., anti-rotation mechanism) may be radially disposed between the annular yoke 262 and the body 64 of the impeller 46 to prevent rotation of the annular yoke 262 relative to the body 64 of the impeller 46. Specifically, in certain embodiments, the annular yoke 262 may include at least one groove 284 that extends axially along an inner surface 286 of the annular yoke 262, wherein the at least one key 264 is configured to fit within the at least one groove 284, as well as within at least one similar groove 288 that extends axially along an outer surface of the body 64 of the impeller 46, to prevent rotation of the magnetic rotor 258 with respect to the diffuser impeller 46. In addition, in certain embodiments, at least one retaining ring 266 may fit within at least one internal groove 290 that extends around an inner diameter of the inner surface 286 of the annular yoke 262, as well as a similar internal groove that extends around an outer diameter of the outer surface of the body 64 of the impeller 46, to prevent axial movement of the annular yoke 262 relative to the body 64 of the impeller 46.

Figure 55:
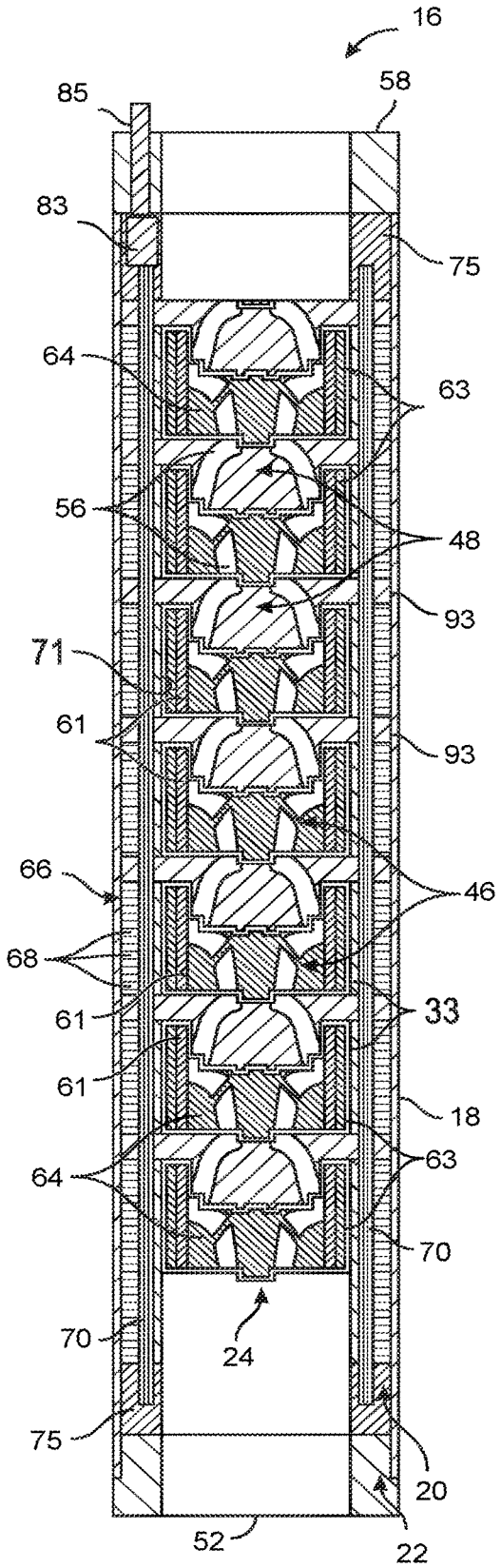
FIG. 55 is a cross-sectional illustration of another example of an integrated pump and motor of the ESP system having a protective tube, according to an embodiment of the disclosure.

Referring generally to FIG. 55, another embodiment of pumping section 16 is illustrated. In this example, the non-magnetic diffusers 48 include flanges 93 which extend to an inside surface of outer housing 18. The flanges 93 extend through tube 33 and stator 66, thus interrupting the continuity of the stator laminations 68. In this type of embodiment, the tube 33 may be formed in sections sealed between flanges 93. The magnet wire 70 extends through both the stator laminations 68 and the flanges 93 to provide a suitable winding for enabling rotation of impellers 46 when electric power is supplied via electric cable 85 and a rotating magnetic field is established via stator 66. In this embodiment, the diffusers 48 and the stator laminations 68 may be compressed together to provide higher down-thrust capability of the stages. It should be noted stages, as used herein, means adjacent pairings of impeller 46 and diffuser 48. Depending on the pumping capacity desired, different numbers of stages (pairs of impellers 46 and diffusers 48) may be assembled to form the integrated pump and motor 20. The embodiment illustrated in FIG. 55 also may help reduce core loss which otherwise may result from unused stator laminations where there is no corresponding rotor magnet zone.

Figure 56:
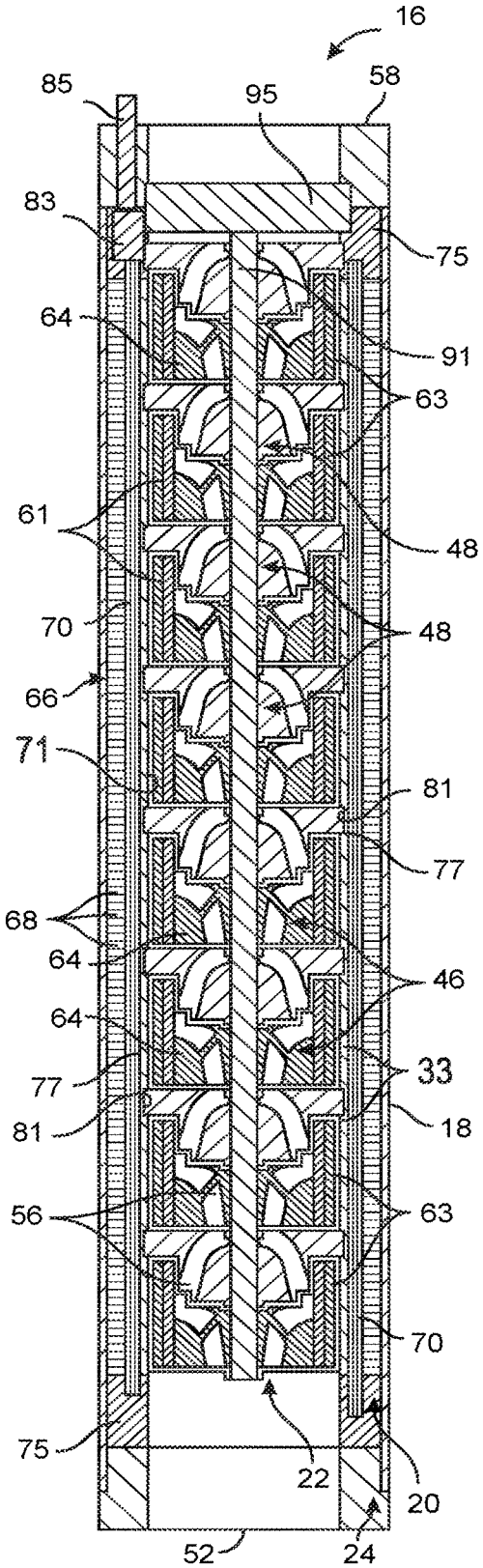
FIG. 56 is a cross-sectional illustration of another example of an integrated pump and motor of the ESP system having a protective tube, according to an embodiment of the disclosure.

Referring generally to FIG. 56, another embodiment of pumping section 16 is illustrated. In this example, the non-magnetic diffusers 48 are again locked in a stationary position with respect to stator 66 by, for example, protuberances 77 and corresponding recesses 81. However, a shaft 91, e.g. a rotatable shaft, is disposed through magnetic impellers 46 and non-magnetic diffusers 48. The shaft 91 may be supported by at least one shaft thrust bearing 95. For example, the shaft 91 may be supported on both ends by corresponding thrust bearings 95. In this embodiment, the magnetic impellers 46 may be rotationally constrained on shaft 91 by, for example, keys and a corresponding keyway or other suitable locking mechanisms. By locking the magnetic impellers 46 on shaft 91, the total load torque transmission is shared by each impeller/stage during torque generation, e.g. during operation of motor 24. Thus, if a stage/impeller becomes stuck the accumulation of stage torque on the shaft 91 may aid in freeing the stuck stage/impeller.

Figure 57:
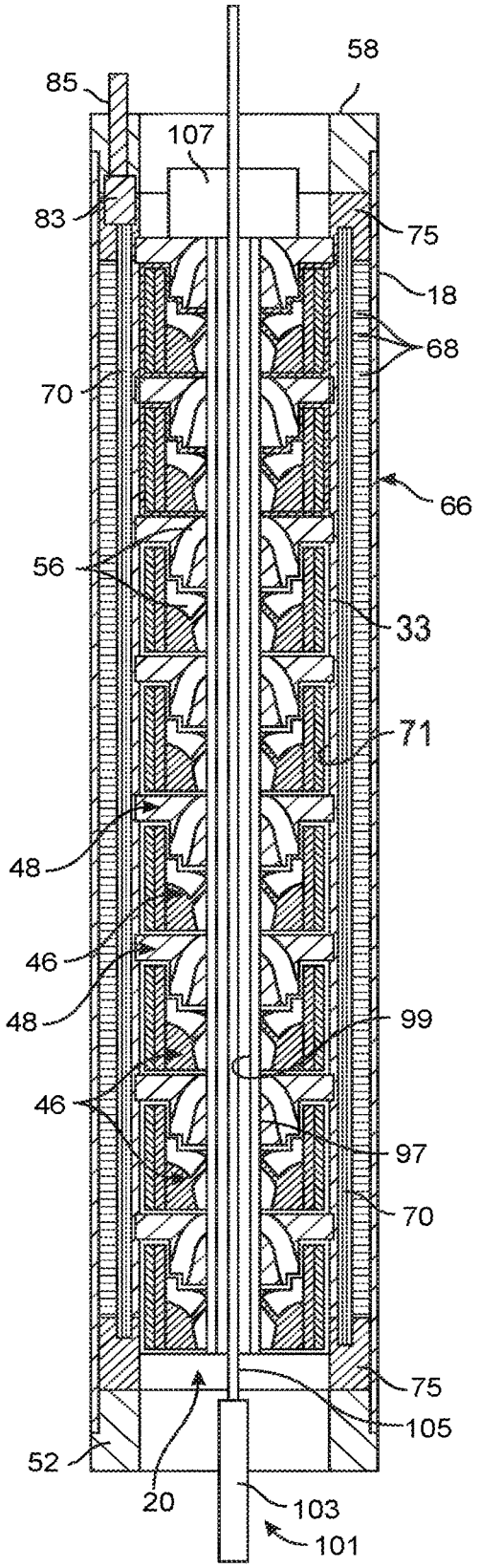
FIG. 57 is a cross-sectional illustration of another example of an integrated pump and motor of the ESP system having a protective tube, according to an embodiment of the disclosure.

Referring generally to FIG. 57, another embodiment of pumping section 16 is illustrated. In this example, a hollow shaft 97 is disposed through magnetic impellers 46 and non-magnetic diffusers 48. The hollow shaft 97 comprises an internal passage 99 sized for receiving a tool 101 therethrough. By way of example, the tool 101 may be in the form of a wireline logging tool 103 coupled with a logging tool cable 105 and passed through hollow shaft 97 via passage 99. The tool 101 may be deployed through the hollow shaft 97 to, for example, a position below the electric submersible pumping system 12.

The hollow shaft 97 may be used with a variety of embodiments. For example, the shaft 80 or the shaft 91, described above, may be constructed as hollow shaft 97. In some embodiments, a valve 107 may be mounted at the top of pumping section 16 or at another suitable location. The valve 107 may be in the form of a check valve or other suitable valve which is closed to block passage 99 when the pumping system is activated. However, the valve 107 may be moved to an open position to allow tool 101 to be passed through the hollow shaft 97.

Figure 58:
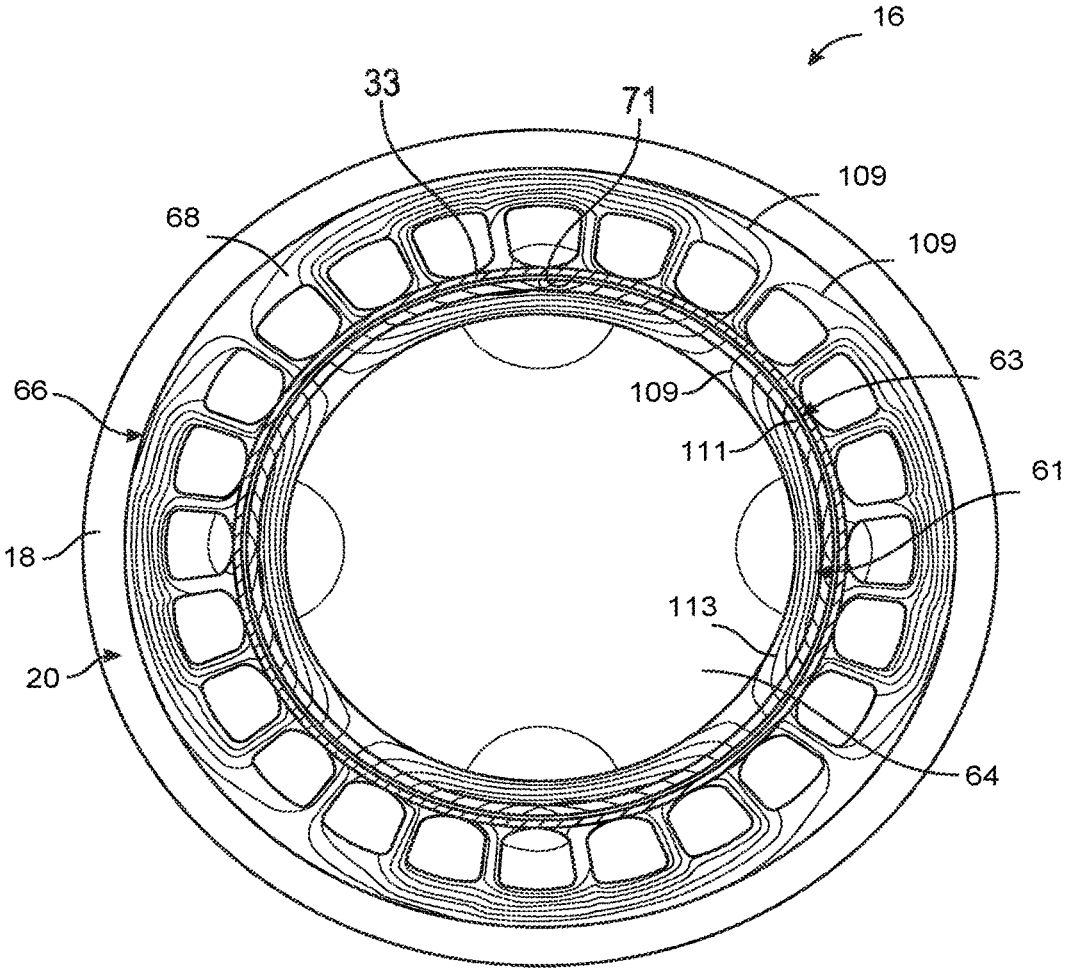
FIG. 58 is a cross-sectional illustration taken through an axis of an embodiment of the integrated pump and motor to illustrate magnetic lines, according to an embodiment of the disclosure.

In FIG. 58, a cross-sectional illustration of the integrated pump and motor 20, taken perpendicularly through the axis of the integrated pump and motor 20, is provided to show an example of an arrangement of magnetic lines 109. In this example, the motor 20 comprises stator 66 and is arranged in the form of a 3-phase, 4-pole, 24-slot configuration. Additionally, the impellers 46 are each arranged to have magnet 63 in the form of a permanent magnet ring 111 and magnetic component 61 in the form of a magnetic steel hub 113. Thus, each impeller 46 includes impeller body 64, magnetic steel hub 113, and permanent magnet ring 111. In embodiments including a tube 33, for example as shown in FIG. 58, the impellers 46 are disposed within the passage/bore 71 formed by the tube 33 which is again sealed to protect stator 66. For example, the tube 33 may be positioned to seal off and thus protect stator laminations 68 located between tube 33 and outer housing 18.

Figure 59:
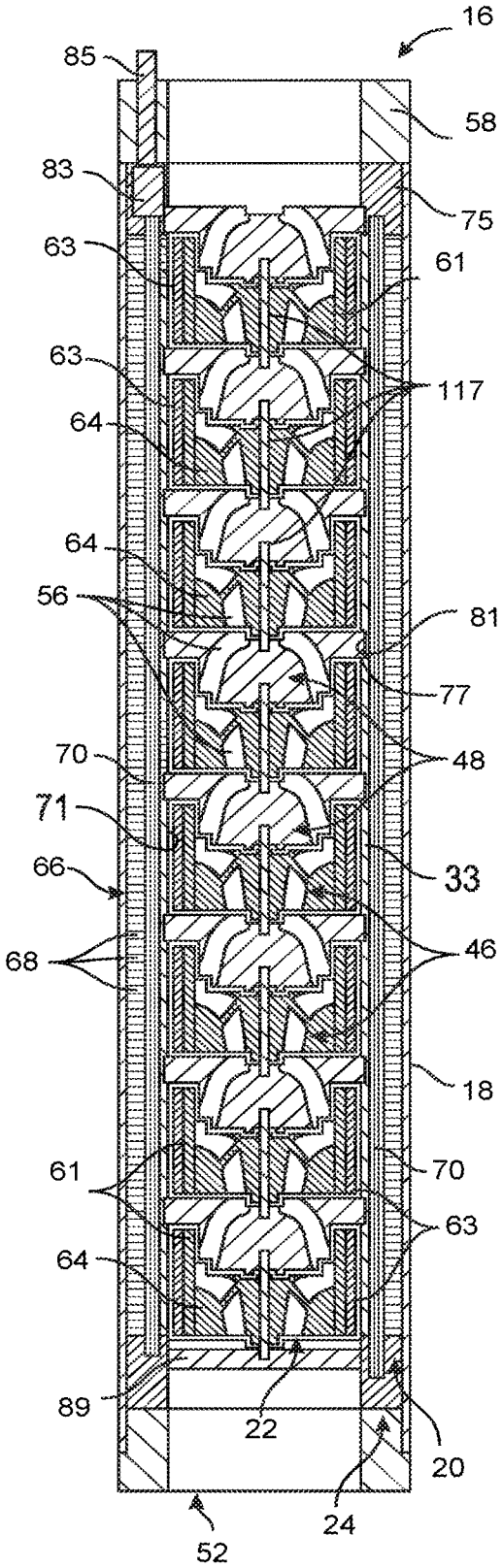
FIG. 59 is a cross-sectional illustration of another example of an integrated pump and motor of the ESP system having a protective tube, according to an embodiment of the disclosure.

Referring generally to FIG. 59, another embodiment of pumping section 16 is illustrated. In this example, a pin 117 or a plurality of pins 117 may be used to connect sequential magnetic impellers 46. By way of example, the pin(s) 117 may be located along an axis of the pumping section 16. In this embodiment, the pin or pins 117 are constructed for providing radial and/or axial stability rather than for transferring torque as with certain types of shafts. As with other embodiments, the magnet wire 70 may extend through the stator laminations 68 to enable rotation of impellers 46 within tube 33 when electric power is supplied via electric cable 85.

Depending on the parameters of a given application, the torque producing component, e.g. impeller 46, may be constructed in a variety of forms. In embodiments described above, for example, a torque producing component or components may be created using an impeller body 64 combined with a magnetic component 61 and an annular permanent magnet 63. However, the torque producing component, e.g. magnetic components of impeller 46, may be constructed in various other configurations. Examples of such configurations include an induction cage, a reluctance rotor, or another suitable component able to generate torque when electricity is applied via cable 85.

Figure 60:
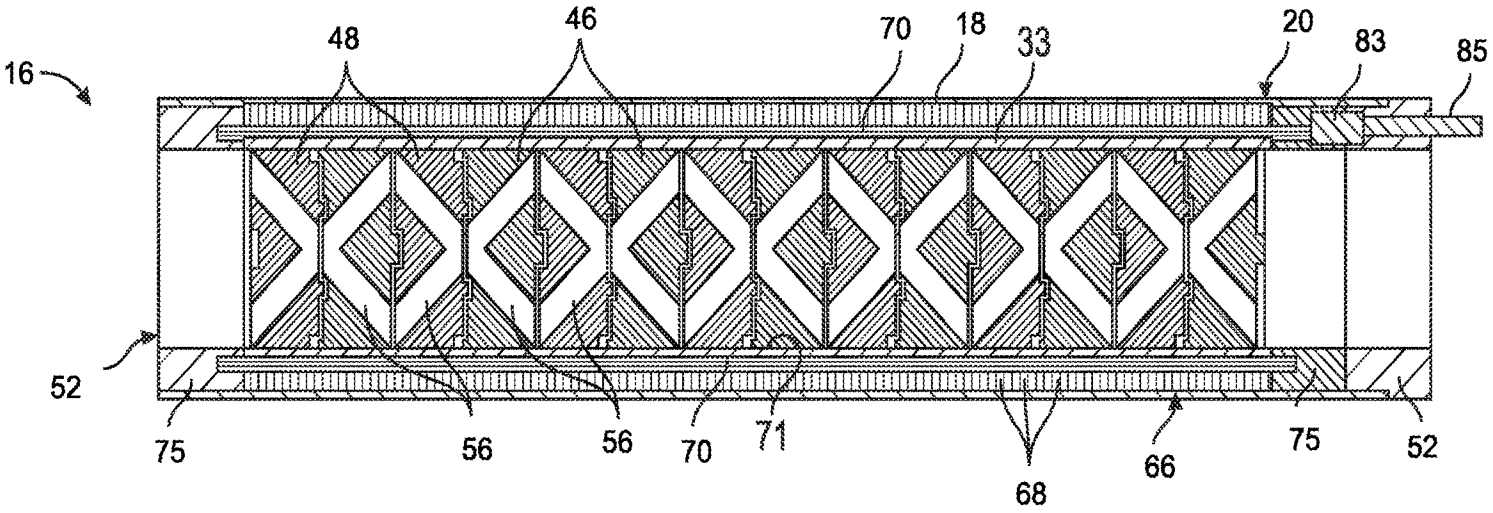
FIG. 60 is a cross-sectional illustration of another example of an integrated pump and motor of the ESP system having a protective tube, according to an embodiment of the disclosure.

Referring generally to FIG. 60, another embodiment of pumping section 16 is illustrated. In this example, impellers 46 are constructed from a magnetic material which electromagnetically interacts with stator magnetic poles of stator 66 through tube 33. As with other embodiments described herein, the impellers 46 are constructed to function as a rotor of motor 24 for interaction with the stator magnetic poles. Simultaneously, the impellers 46 function as conventional pump impellers of pump 22 so as to move fluid, e.g. well fluid, generally in an axial direction along flow channel 56.

Figure 61:
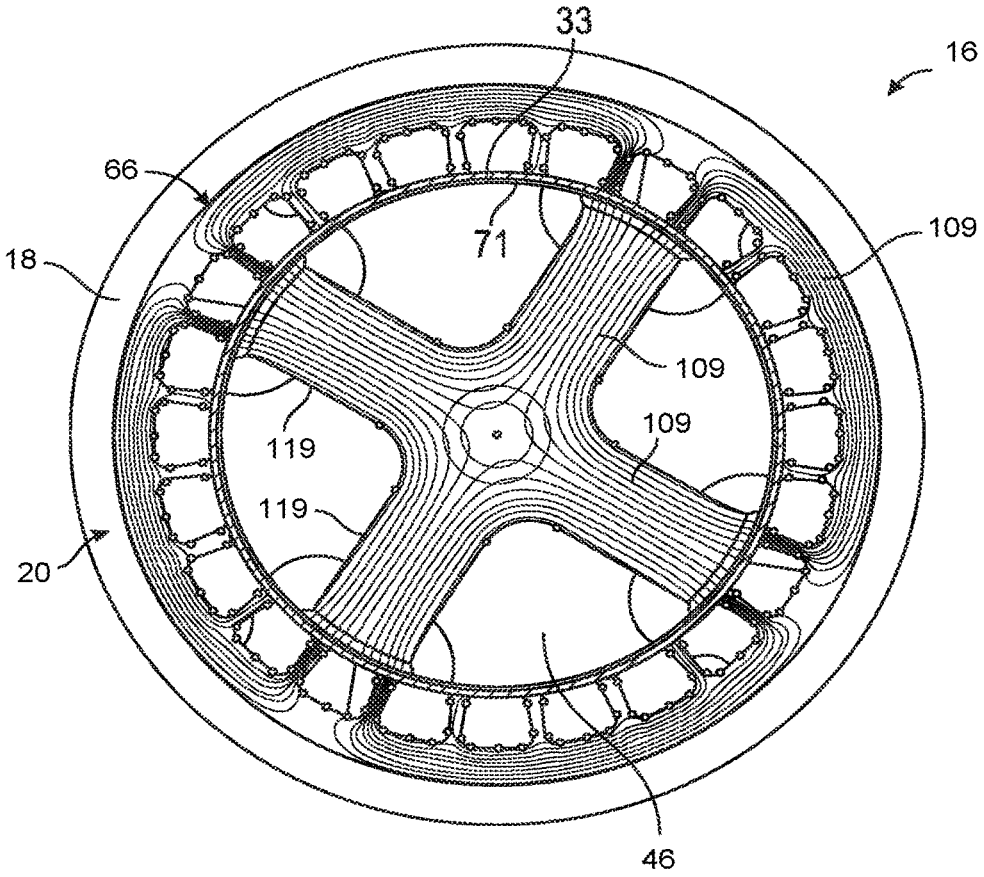
FIG. 61 is a cross-sectional illustration taken through an axis of another embodiment of the integrated pump and motor to illustrate magnetic lines, according to an embodiment of the disclosure.

In FIG. 61, a cross-sectional illustration of the integrated pump and motor 20, taken perpendicularly through the axis of the integrated pump and motor 20, is provided to show another example of an arrangement of magnetic lines 109. In this example, the impellers 46 each comprise impeller vanes 119 which are made of magnetic material. The magnetic material allows the impellers 46 to function as both a motor rotor and a pump impeller simultaneously. In this example, the impellers 46 are constructed such that the motor 24 operates as a reluctance motor.

Figure 62:
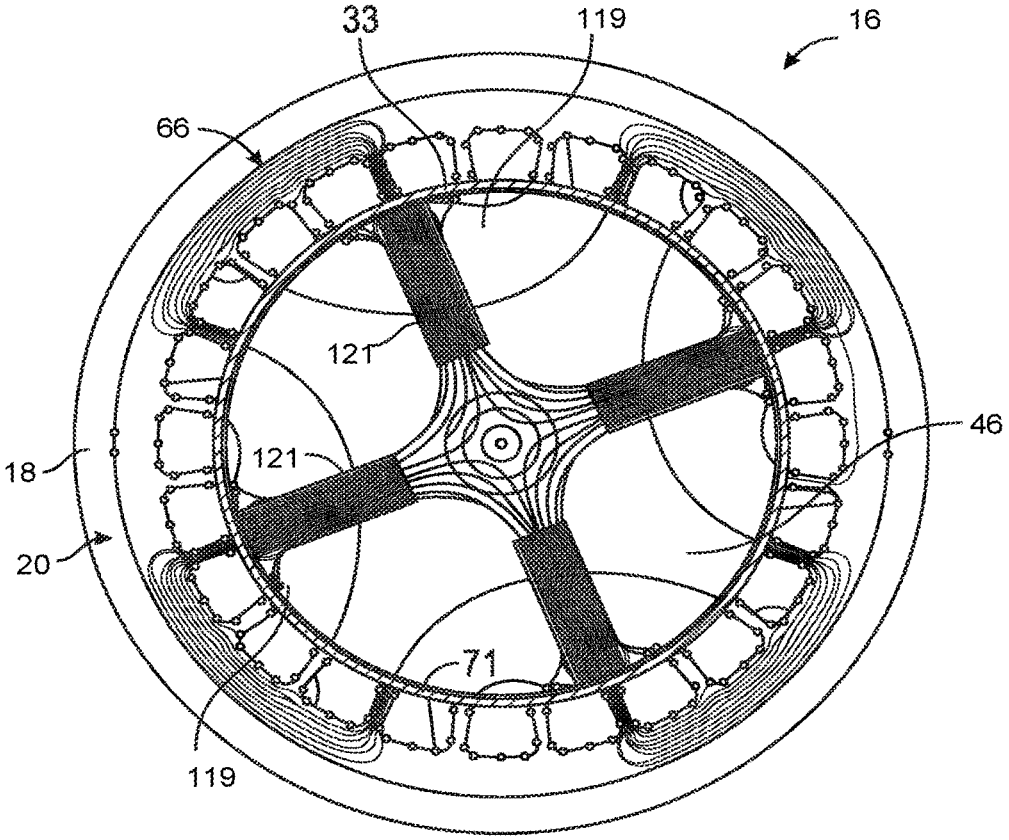
FIG. 62 is a cross-sectional illustration taken through an axis of another embodiment of the integrated pump and motor to illustrate magnetic lines, according to an embodiment of the disclosure.

In FIG. 62, a cross-sectional illustration of the integrated pump and motor 20, taken perpendicularly through the axis of the integrated pump and motor 20, is provided to show another example of an arrangement of magnetic lines 109. In this example, the impellers 46 each comprise permanent magnets 121 embedded into impeller vanes 119 which again allows the impellers 46 to function as both a motor rotor and a pump impeller simultaneously.

With respect to embodiments described herein, the stator 66/laminations 68 may be protected by various configurations of tube 33. The tube 33 may be constructed as a scaling mechanism to provide a sealed environment for the stator 66 as well fluids are pumped through integrated pump and motor 20. Depending on the type of motor 24, the tube 33 may have a variety of structures and shapes which provide a conduit surrounding the region of fluid flow. For example, the tube 33 may be cylindrical in shape or it may have a variety of other cross-sectional shapes, e.g. rectangular shapes or custom shapes to accommodate various motor components.

The tube 33 also may be a thin, single long cylindrical section or a plurality of short sections joined together and/or joined with other system components via welding or other sealing techniques, e.g. O-rings. The ends of the tube 33 also may be sealed to components, e.g. coil end encapsulations 75, of the integrated pump and motor 20 via welding, O-ring seals, or other suitable scaling techniques. In some embodiments, the tube 33 may be sealed to the head and the base of the corresponding equipment section.

Additionally, the torque generating components (e.g. combined impeller body 64, magnetic components 61, and permanent magnet 63) may or may not be constructed to provide hydrodynamic functions of pump stage components such as impeller vanes. For example, permanent magnets 63 of impellers 46 may be constructed in the form of impeller vanes 119, may be mounted along the impeller vanes 119, or may be mounted at other suitable locations of the impellers 46 that do not participate in fluid pumping. In some embodiments, the impellers 46 may be constructed from a magnetic steel and function as a rotor of a synchronous reluctance motor. In this type of embodiment, the impellers 46 again generate torque when being exposed to a rotating magnetic field of the stator 66.

Various embodiments described herein enable the elimination of one or more traditional ESP components, such as motor protector (seal), traditional motor, traditional pump shafts, couplings, motor lead extensions, and/or other components. The integrated pump and motor 20 may be constructed to provide a combined section having a reduced number of component parts combined with a shortening of the overall length of the ESP system 20 relative to a traditional ESP system. However, multiple combined sections may be connected in tandem to provide sufficient head desired for a given pumping system.

Additionally, the integrated pump and motor 20 may be constructed with different types of fluid pumping structures, e.g. different types of impellers. For example, the fluid pumping structure 46 may be in the form of a helical rotor in a progressive cavity pump. In this type of embodiment, the helical rotor is equipped with a torque producing element, e.g. a permanent magnet element or a magnetic steel element, and surrounded by tube 33 and stator 66. The stator 66 may utilize a winding of magnet wire 70 to produce a rotating magnetic field.

By eliminating certain traditional components, e.g. shafts, as described above, embodiments of ESP system 12 allow for the flexible connection of pumping section 16 with other components of a well string. This ability negates application restraints related to trajectory of the wellbore in three-dimensional space and facilitates use of the pumping system in wellbores with greater dogleg severity. A flexible connection between sections of the well string may be achieved by a variety of methods including use of materials which allow a certain level of deformation and flexibility, articulating joints which permit relative angular movement between connected sections, or other suitable flexible connections.

The various components of pumping system 12 may be constructed from a variety of materials. For example, the impeller body 64 may be constructed from steel, aluminum, plastic, ceramic, or other suitable materials for a given application. In some embodiments, the impellers 46 may be constructed with suitable types of magnetic material. For example, the impeller body 64 may be constructed from the same material as magnetic component 61. The magnetic components 61 also may be formed from various magnetic materials, such as magnetic steel. Similarly, the stator 66 may be constructed in various configurations using laminations 68 or other suitable structures. The electric cable 85 may have various materials and configurations and may be coupled with magnet wire 70 via various types of connectors 83, e.g. motor lead extensions. Additionally, the pumping section 16 may be combined with many other types of components in the overall pumping system.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

an electric submersible pumping system having a fluid intake and a fluid discharge, the electric submersible pumping system comprising:

a housing;

a stator disposed within the housing;

a plurality of non-magnetic diffusers disposed within the housing in a locked position with respect to the stator, each non-magnetic diffuser of the plurality of non-magnetic diffusers includes an inner bore;

a plurality of magnetic impellers disposed within the housing in cooperation with the plurality of non-magnetic diffusers such that application of electric power to the stator causes rotation of the plurality of magnetic impellers, wherein each magnetic impeller of the plurality of magnetic impellers includes an impeller hub and a snap ring engaged with an outer surface of the impeller hub;

a plurality of bearing stacks, each bearing stack including a radial bearing configured to support radial loads and a thrust runner configured to support axial loads, wherein each impeller hub is disposed within the inner bore of a respective non-magnetic diffuser, and wherein each bearing stack is disposed radially about each impeller hub and radially within the inner bore of the respective non-magnetic diffuser; and a tube disposed between the plurality of magnetic impellers and the stator to isolate the stator from fluid pumped via the plurality of magnetic impellers.

2. The system according to claim 1, wherein each magnetic impeller of the plurality of magnetic impellers comprises a body, a magnetic component disposed about the body, and a permanent magnet.

3. The system according to claim 1, wherein the stator comprises laminations sealed between the housing and the tube.

4. The system according to claim 1, wherein the plurality of magnetic impellers comprise a magnetic material.

5. The system according to claim 1, wherein each non-magnetic diffuser of the plurality of non-magnetic diffusers comprises a fluid conduit for transporting a fluid from a first side of the non-magnetic diffuser to a second side of the non-magnetic diffuser.

6. The system according to claim 2, wherein the permanent magnet has an annular shape.

7. The system according to claim 1, wherein the tube is formed as a single cylindrical section.

8. The system according to claim 1, wherein the plurality of magnetic impellers rotate in response to a flow of electricity through a magnet wire.

9. A method, comprising:

providing an electric submersible pumping system with an outer housing containing an integrated pump and motor within the outer housing, wherein the integrated pump and motor includes:

a plurality of non-magnetic diffusers, each non-magnetic diffuser of the plurality of non-magnetic diffusers includes an inner bore;

a plurality of magnetic impellers, each magnetic impeller of the plurality of magnetic impellers including an impeller hub and a snap ring engaged with an outer surface of the impeller hub; and a plurality of bearing stacks, each bearing stack including a radial bearing configured to support radial loads and a thrust runner configured to support axial loads, wherein each impeller hub is disposed within the inner bore of a respective non-magnetic diffuser, and wherein each bearing stack is disposed radially about each impeller hub and radially within the inner bore of the respective non-magnetic diffuser;

conveying the electric submersible pumping system downhole into a borehole;

using a tubing to sealingly isolate a stator of a motor of the integrated pump and motor;

applying electrical power to the motor of the integrated pump and motor to establish a fluid pumping motion; and pumping a fluid through the integrated pump and motor within the outer housing without exposing the stator to the fluid.

10. The method as recited in claim 9, wherein the plurality of non-magnetic diffusers are mounted within the stator and the plurality of magnetic impellers rotatably mounted within the stator in cooperation with the plurality of non-magnetic diffusers.

11. The method as recited in claim 9, wherein the stator comprises laminations sealed between the outer housing and a tube.

12. The method as recited in claim 9, wherein a body of each magnetic impeller of the plurality of magnetic impellers comprises a magnetic material.

* * * * *